US012152854B2

(12) United States Patent
Kolev et al.

(10) Patent No.: US 12,152,854 B2
(45) Date of Patent: Nov. 26, 2024

(54) SEMIAUTOMATIC FIREARM

(71) Applicant: Savage Arms, Inc., Westfield, MA (US)

(72) Inventors: Ivan Kolev, Suffield, CT (US); John Linscott, Easthampton (UA)

(73) Assignee: Savage Arms, Inc., Westfield, MA (US)

( * ) Notice: Subject to any disclaimer, the term of this patent is extended or adjusted under 35 U.S.C. 154(b) by 0 days.

(21) Appl. No.: 18/229,108

(22) Filed: Aug. 1, 2023

(65) Prior Publication Data

US 2024/0133646 A1 Apr. 25, 2024

Related U.S. Application Data

(63) Continuation of application No. 17/036,610, filed on Sep. 29, 2020, now Pat. No. 11,713,933, which is a (Continued)

(51) Int. Cl.
*F41A 19/10* (2006.01)
*F41A 3/12* (2006.01)

(Continued)

(52) U.S. Cl.
CPC ..... *F41A 3/46* (2013.01); *F41A 3/12* (2013.01); *F41A 3/66* (2013.01); *F41A 3/70* (2013.01); *F41A 3/72* (2013.01); *F41A 19/27* (2013.01)

(58) Field of Classification Search
CPC ..... F41A 17/46; F41A 17/74; F41A 17/82; F41A 19/42; F41A 19/44
See application file for complete search history.

(56) References Cited

U.S. PATENT DOCUMENTS 361,100 A * 4/1887 Wesson ..... F41A 19/53 42/65
533,101 A 1/1895 Tesch (Continued)

FOREIGN PATENT DOCUMENTS

CH 626717 A 11/1981
DE 102007034672 1/2009

(Continued)

OTHER PUBLICATIONS

PCT International Preliminary Report on Patentability in International Application No. PCT/US2015/031210, dated Nov. 24, 2016, 17 pages.

(Continued)

*Primary Examiner* — Derrick R Morgan
(74) *Attorney, Agent, or Firm* — Christensen, Fonder, Dardi & Herbert PLLC; Douglas J. Christensen; Timothy J Busse

(57) ABSTRACT

A reciprocating bolt assembly has delayed blowback and a firing pin block. Features prevent out-of-battery firing, when the bolt assembly is not fully engaged to the firing chamber or barrel face, a movable member within a bolt body functions as a blocking member that blocks the firing pin and prevents the firing pin from striking a cartridge. In embodiments, the firing pin has two stop portions that the movable member can engage depending on the cycle status of the firearm. A reverse cam mechanism associated with the firing pin blocking provides a resistance to and delays blowback.

19 Claims, 62 Drawing Sheets

Related U.S. Application Data continuation of application No. 15/352,330, filed on Nov. 15, 2016, now Pat. No. 10,788,277, which is a continuation of application No. PCT/US2015/031210, filed on May 15, 2015, which is a continuation of application No. 14/599,199, filed on Jan. 16, 2015, now Pat. No. 9,599,417, and a continuation of application No. 14/599,408, filed on Jan. 16, 2015, now Pat. No. 9,513,076, and a continuation of application No. 14/599,396, filed on Jan. 16, 2015, now Pat. No. 9,810,496.

(60) Provisional application No. 61/993,541, filed on May 15, 2014, provisional application No. 61/993,569, filed on May 15, 2014, provisional application No. 61/993,563, filed on May 15, 2014.

(51) Int. Cl.

| | |
|---|---|
| ***F41A 3/46*** | (2006.01) |
| ***F41A 3/66*** | (2006.01) |
| ***F41A 3/70*** | (2006.01) |
| ***F41A 3/72*** | (2006.01) |
| ***F41A 17/46*** | (2006.01) |
| ***F41A 19/12*** | (2006.01) |
| ***F41A 19/27*** | (2006.01) |

(56) References Cited

U.S. PATENT DOCUMENTS

| | | | | |
|---|---|---|---|---|
| 1,043,670 | A | 11/1912 | Chronis | |
| 1,410,270 | A | 3/1922 | Pedersen | |
| 1,656,961 | A | 1/1928 | Cesare | |
| 1,737,974 | A | 12/1929 | Pedersen | |
| 1,786,536 | A * | 12/1930 | Holek | F41A 19/46 89/143 |
| 2,089,671 | A | 8/1937 | Stecke | |
| 2,270,683 | A | 1/1942 | Frantisek | |
| 2,453,830 | A | 11/1948 | Chadwick et al. | |
| 2,465,749 | A | 3/1949 | Rataiczak | |
| 2,473,373 | A | 6/1949 | Howell | |
| 2,527,895 | A | 10/1950 | Tassan | |
| 2,576,973 | A | 12/1951 | Simpson | |
| 2,579,736 | A * | 12/1951 | Gartner | F41A 19/17 42/70.08 |
| 2,585,195 | A | 2/1952 | Walker | |
| 2,594,354 | A | 4/1952 | Schnepel | |
| 2,601,808 | A | 7/1952 | Clarke | |
| 2,603,019 | A | 7/1952 | Elkas | |
| 2,626,474 | A | 1/1953 | Lochhead | |
| 2,638,694 | A | 5/1953 | Morris | |
| 2,848,832 | A | 8/1958 | Lee | |
| 2,856,718 | A * | 10/1958 | Fischer | F41A 17/46 42/70.05 |
| 2,873,546 | A | 2/1959 | Allyn | |
| 2,900,877 | A | 8/1959 | Sloan | |
| 2,912,779 | A | 11/1959 | Catlin et al. | |
| 2,921,502 | A | 1/1960 | Amsler | |
| 2,962,936 | A | 12/1960 | Hans et al. | |
| 2,975,680 | A | 3/1961 | Wilson | |
| 3,153,982 | A | 10/1964 | Seifried | |
| 3,235,993 | A | 2/1966 | Magardo | |
| 3,292,492 | A * | 12/1966 | Sturtevant | F41A 17/46 89/142 |
| 3,415,000 | A * | 12/1968 | Koucky | F41A 17/46 89/137 |
| 3,566,745 | A | 3/1971 | Jauch et al. | |
| 3,631,622 | A | 1/1972 | Walker et al. | |
| 3,738,223 | A | 6/1973 | Post et al. | |
| 3,848,510 | A | 11/1974 | Wolpert | |
| 3,857,325 | A | 12/1974 | Thomas | |
| 3,893,369 | A | 7/1975 | Benelli | |
| 4,069,607 | A | 1/1978 | Jurek | |
| 4,203,243 | A | 5/1980 | Hickman | |
| 4,270,295 | A | 6/1981 | Grehl | |
| 4,344,246 | A | 8/1982 | Bauman et al. | |
| 4,547,988 | A | 10/1985 | Nilsson | |
| 4,677,898 | A | 7/1987 | Malhotra | |
| 4,754,568 | A * | 7/1988 | Brandt | F41A 17/46 42/70.01 |
| 4,815,356 | A | 3/1989 | Hupp et al. | |
| 4,922,640 | A | 5/1990 | Toombs | |
| 5,157,209 | A | 10/1992 | Dunn | |
| 5,259,137 | A | 11/1993 | Blenk et al. | |
| 5,267,407 | A | 12/1993 | Bornancini | |
| 5,614,691 | A | 3/1997 | Taylor | |
| 5,655,326 | A | 8/1997 | Levavi et al. | |
| 5,666,754 | A | 9/1997 | de Oliveira Masina | |
| 5,726,376 | A | 3/1998 | Menges et al. | |
| 5,760,328 | A * | 6/1998 | Robbins | F41A 19/46 89/142 |
| 5,900,576 | A | 5/1999 | Gabriel | |
| 5,974,942 | A | 11/1999 | Dionne | |
| 6,256,918 | B1 | 7/2001 | Szabo | |
| 6,349,495 | B1 | 2/2002 | Fluhr | |
| 6,418,655 | B1 | 7/2002 | Kay | |
| 6,553,706 | B1 * | 4/2003 | Gancarz | F41A 17/46 42/70.01 |
| 6,782,791 | B2 | 8/2004 | Moore | |
| 7,055,422 | B1 | 6/2006 | Dindl et al. | |
| 7,204,051 | B2 | 4/2007 | Thomele et al. | |
| 7,854,084 | B1 * | 12/2010 | Rutherford | F41A 19/43 42/69.01 |
| 7,874,240 | B2 | 1/2011 | Akhavan | |
| 8,074,391 | B2 | 12/2011 | Petrůj | |
| 8,122,633 | B2 | 2/2012 | Kerbrat et al. | |
| 8,220,193 | B1 * | 7/2012 | Lynch | F41A 19/16 42/70.08 |
| 8,250,799 | B2 | 8/2012 | Duperry et al. | |
| 8,528,458 | B2 | 9/2013 | Windauer | |
| 8,807,010 | B2 | 8/2014 | Bubits | |
| 9,046,313 | B1 * | 6/2015 | Lutton | F41A 19/14 |
| 9,429,379 | B2 * | 8/2016 | Fellows | F42B 5/32 |
| 9,488,431 | B2 | 11/2016 | Bubits | |
| 9,513,076 | B2 | 12/2016 | Kolev et al. | |
| 9,664,466 | B2 | 5/2017 | Gryparis | |
| 9,810,496 | B2 | 11/2017 | Kolev et al. | |
| 9,964,369 | B2 | 5/2018 | Garrow | |
| 9,970,724 | B1 * | 5/2018 | Acker | F41A 17/46 |
| 10,006,734 | B1 * | 6/2018 | Findlay | F41A 19/12 |
| 10,156,409 | B1 * | 12/2018 | Laney | F41A 17/46 |
| 10,175,019 | B1 | 1/2019 | Al-Mutawa | |
| 10,247,502 | B2 * | 4/2019 | Kilic | F41A 17/46 |
| 10,337,818 | B1 * | 7/2019 | Sampson, Jr. | F41A 3/66 |
| 10,670,361 | B2 * | 6/2020 | Galie | F41A 19/58 |
| 10,788,277 | B2 | 9/2020 | Kolev et al. | |
| 10,895,424 | B2 | 1/2021 | Tertin | |
| 10,989,490 | B2 * | 4/2021 | Dunham | F41A 19/10 |
| 11,274,894 | B1 * | 3/2022 | Hill | F41A 17/46 |
| 11,713,933 | B2 | 8/2023 | Kolev et al. | |
| 2003/0089014 | A1 | 5/2003 | Schuerman | |
| 2003/0150322 | A1 | 8/2003 | Barrett | |
| 2005/0132875 | A1 | 6/2005 | Murello | |
| 2005/0188578 | A1 | 9/2005 | Engel | |
| 2005/0217473 | A1 | 10/2005 | Murello | |
| 2005/0235817 | A1 | 10/2005 | Murello | |
| 2005/0257682 | A1 | 11/2005 | Hajjar et al. | |
| 2006/0086031 | A1 * | 4/2006 | Geissele | F41A 19/44 42/69.03 |
| 2009/0308240 | A1 | 12/2009 | Kneppler et al. | |
| 2010/0024273 | A1 | 2/2010 | Duperry et al. | |
| 2010/0186581 | A1 | 7/2010 | Hajjar et al. | |
| 2010/0313459 | A1 | 12/2010 | Gomez | |
| 2011/0079137 | A1 | 4/2011 | Audibert et al. | |
| 2011/0099871 | A1 * | 5/2011 | Geissele | F41A 19/44 42/69.03 |
| 2011/0167696 | A1 * | 7/2011 | Gangl | F41A 19/14 42/108 |
| 2012/0148662 | A1 | 6/2012 | Gross et al. | |
| 2013/0074390 | A1 | 3/2013 | Wossner et al. | |
| 2013/0199069 | A1 | 8/2013 | Kerbrat et al. | |

(56) References Cited

U.S. PATENT DOCUMENTS

| | | | | |
|---|---|---|---|---|
| 2014/0196341 | A1* | 7/2014 | Tasyagan | F41A 17/46 42/69.01 |
| 2014/0317983 | A1 | 10/2014 | Bush | |
| 2015/0330734 | A1 | 1/2015 | Kolev et al. | |
| 2015/0316335 | A1 | 11/2015 | Withey | |
| 2015/0330727 | A1 | 11/2015 | Kolev | |
| 2015/0330731 | A1 | 11/2015 | Kolev et al. | |
| 2016/0018176 | A1* | 1/2016 | Fellows | F41A 19/14 42/69.03 |
| 2016/0131449 | A1* | 5/2016 | Horch | F41A 19/12 42/69.01 |
| 2016/0161202 | A1* | 6/2016 | Larue | F41A 19/45 42/69.01 |
| 2016/0252316 | A1 | 9/2016 | Garrow | |
| 2016/0370139 | A1* | 12/2016 | Geissele | B23H 9/00 |
| 2017/0122685 | A1 | 5/2017 | Kolev et al. | |
| 2017/0122686 | A1* | 5/2017 | Fellows | F41A 19/10 |
| 2017/0138689 | A1* | 5/2017 | Biegel | F41A 19/14 |
| 2017/0328663 | A1* | 11/2017 | Fellows | F41A 19/24 |
| 2018/0209755 | A1* | 7/2018 | Fellows | F41A 19/24 |
| 2019/0003795 | A1* | 1/2019 | Fellows | F41A 17/46 |
| 2019/0257606 | A1* | 8/2019 | Olson | F41A 19/10 |
| 2020/0096278 | A1* | 3/2020 | Olson | F41A 19/44 |
| 2020/0124370 | A1* | 4/2020 | Kolev | F41A 19/10 |
| 2020/0248979 | A1* | 8/2020 | Dunham | F41C 7/06 |
| 2020/0292271 | A1* | 9/2020 | Williams | F41B 5/126 |
| 2020/0363154 | A1* | 11/2020 | Lake | F41A 17/46 |
| 2022/0034615 | A1* | 2/2022 | Fellows | F41A 19/24 |
| 2022/0325971 | A1* | 10/2022 | Bray | F41A 19/10 |
| 2023/0080197 | A1* | 3/2023 | Anderson | F41A 17/46 42/69.01 |
| 2023/0097725 | A1* | 3/2023 | Davis | F41A 17/46 42/69.01 |
| 2023/0221087 | A1* | 7/2023 | Strbac | F41A 17/48 42/69.01 |
| 2023/0375299 | A1* | 11/2023 | Olson | F41A 19/44 |

FOREIGN PATENT DOCUMENTS

| | | |
|---|---|---|
| EP | 0017506 | 10/1980 |
| WO | WO199409334 | 4/1994 |

OTHER PUBLICATIONS

PCT International Search Report and Written Opinion in International Application No. PCT/US2015/031210, dated Jan. 29, 2016, 6 pages.

shootingtimes.com [online], "Innovative, Remarkable, Reliable . . . Getting Inside Savage's Accutrigger", Guns & Ammo Network, posted on Sep. 23, 2010, retrieved from URL: http://www.shootingtimes.com/long-guns/longgun_reviews_savage 0813/, 8 pages.

* cited by examiner

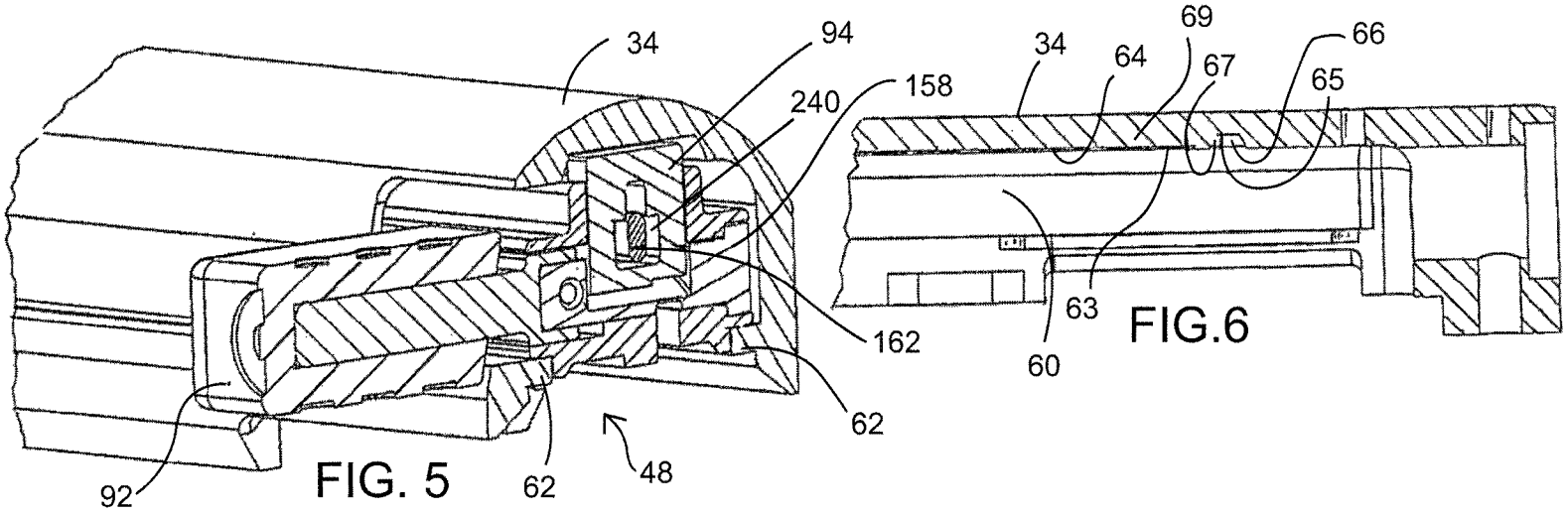
FIG.6
FIG. 5
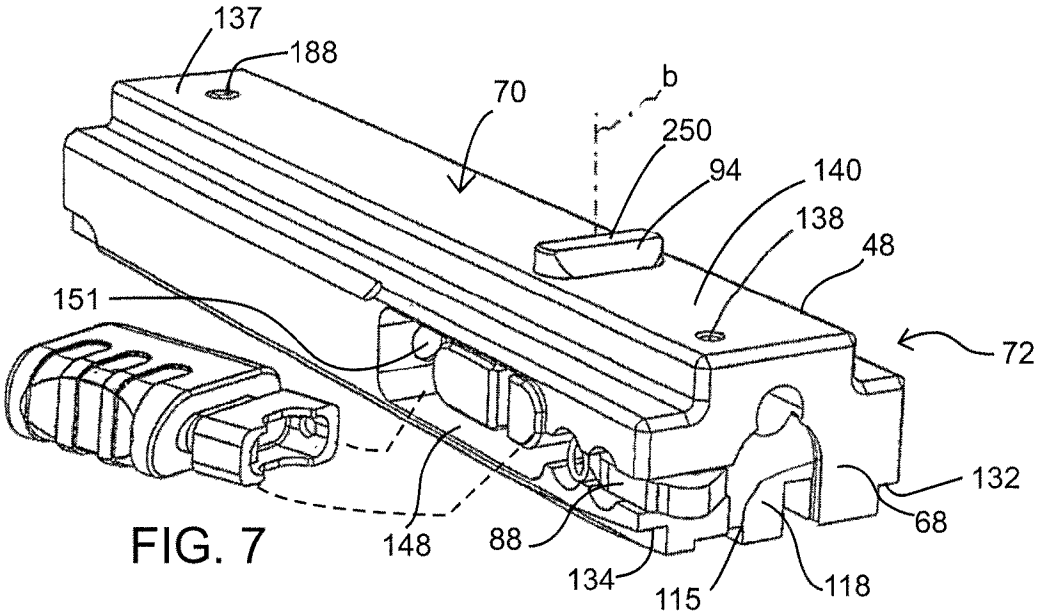
FIG. 7

93
233
233
66
67
32
239
94
82
238
159
237
32
234
233
48
161
50
231
119
235
aa
50
32
48
162
94
93
67
230
82
119

50
32
162
94
48

50
93
94
159

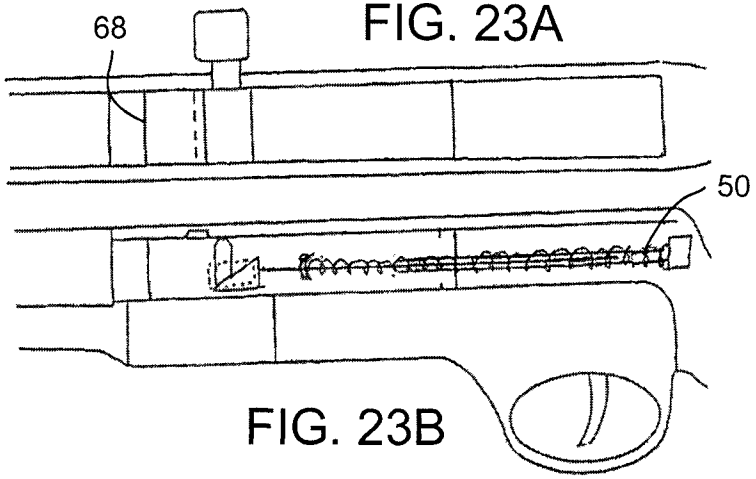
FIG. 23A
FIG. 23B
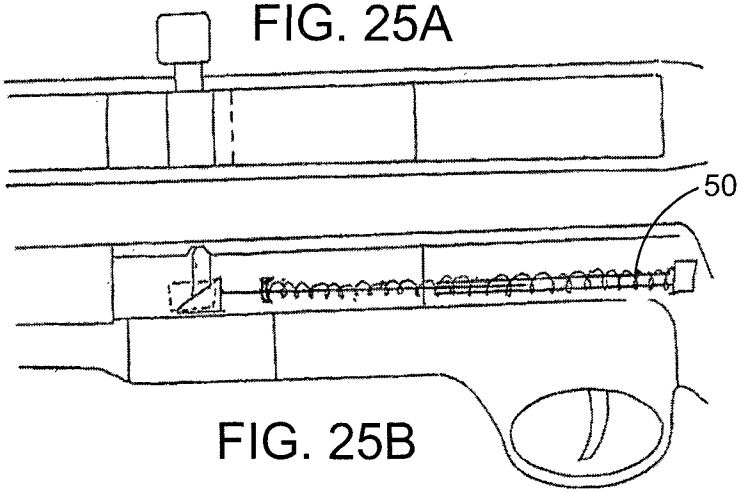
FIG. 25A
FIG. 25B
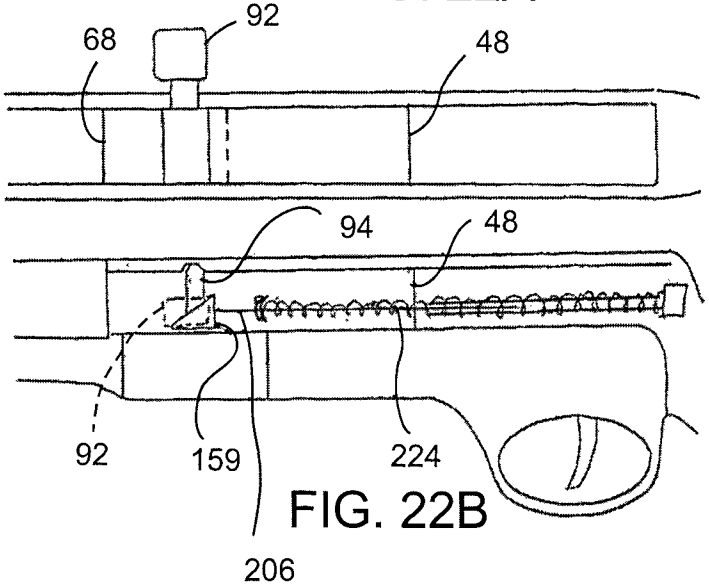
FIG. 22A
FIG. 22B
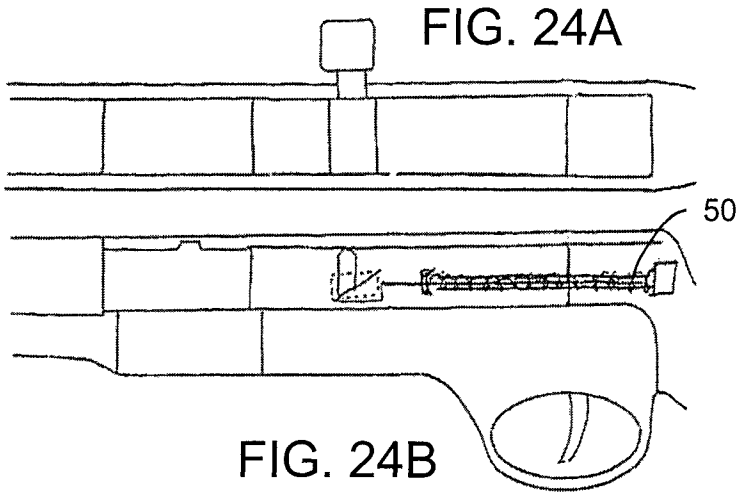
FIG. 24A
FIG. 24B

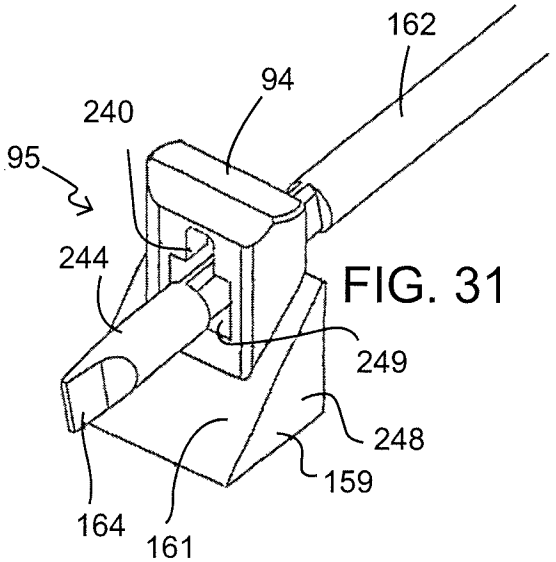
FIG. 31
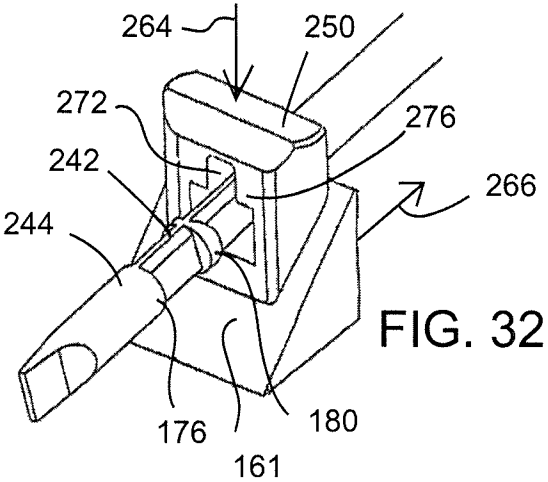
FIG. 32
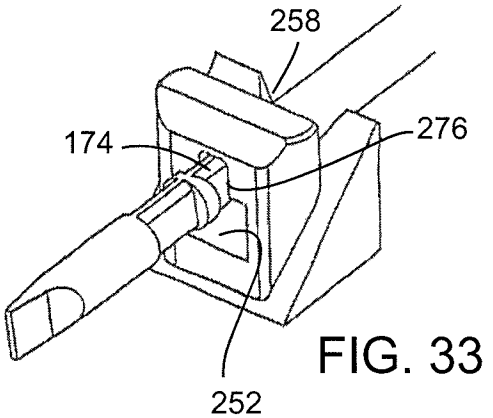
FIG. 33
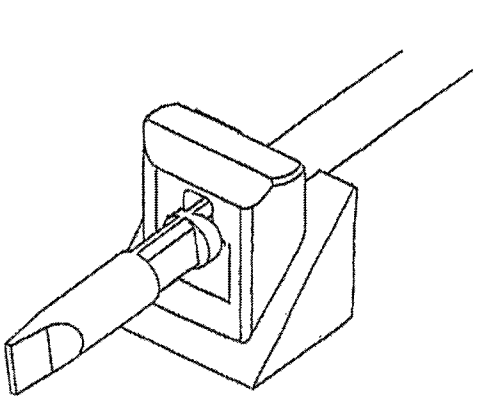
FIG 34
FIG. 35
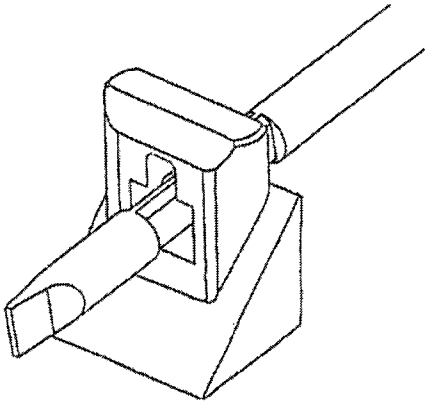
FIG. 36

SEMIAUTOMATIC FIREARM

RELATED APPLICATIONS

This application is a continuation of U.S. patent application Ser. No 0.17/036,610 filed Sep. 29, 2020, now U.S. Pat. No. 11,713,933, which is a continuation of U.S. patent application Ser. No. 15/352,330, filed Nov. 15, 2015, now U.S. Pat. No. 10,788,277, which is a continuation of PCT/US2015/031210, filed on May 15, 2015, which claims priority to U.S. patent application Ser. No. 14/599,396, filed Jan. 16, 2015, Now U.S. Pat. No. 9,810,496, U.S. patent application Ser. No. 14/599,199, filed Jan. 16, 2015, now U.S. Pat. No. 9,599,417 and U.S. patent application Ser. No. 14/599,408, filed Jan. 16, 2015, now U.S. Pat. No. 9,513,076. PCT/US2015/031210 also claims the benefit of U.S. Provisional Patent Application No. 61/993,541, filed May 15, 2014, U.S. Provisional Patent Application No. 61/993,563, filed May 15, 2014, and U.S. Provisional Patent Application No. 61/993,569, filed May 15, 2014. The above-recited applications are hereby incorporated by reference herein in their entireties.

BACKGROUND OF THE INVENTION

The inventions herein relates to semiautomatic firearms. Certain aspects relate to cycling mechanisms for such firearms. Such mechanisms require that the cartridge be retained in the firing chamber essentially until the bullet has left the barrel or the projectile velocity and performance will be impaired. These cartridges, for example the 0.17 Winchester Super Magnum (WSM) and the 0.17 Hornady Magnum Rimfire (HMR) are relatively inexpensive compared to high power centerfire cartridges and therefore have high consumer appeal for the recreation sport shooting market. Traditional rimfire semiautomatic recycling mechanisms generally rely on the weight of the bolt for providing a delay in "blowback" of the bolt. These mechanisms have not been proven suitable for high power necked rimfire cartridges due to the higher power and much greater rearward blowback force associated with these cartridges. Such mechanisms, for these cartridges, do not provide enough delay in the blowback of the bolt or the bolt weight is excessively heavy. The cycling mechanisms for the more powerful necked centerfire cartridges are not suitable either in that the rimfire cartridges generally do not provide sufficient gas pressures for such mechanisms, for example, gas operated cycling mechanisms used in AR-15 type rifles. Even if such mechanisms could be adapted to the necked rimfire cartridges, such mechanism are complicated, requiring many moving parts and thus would be relatively expensive; particularly compared to semiautomatic rifles for non-necked .22 caliber cartridges. Previous attempts at reasonably priced consumer oriented semiautomatic rifles for these high power rimfire cartridges have had performance issues, such as jamming and out-of-battery firing of cartridges. A reliable, mechanically simple, semiautomatic firearm with improved performance, particularly for high power necked rimfire cartridges, would be welcome. Moreover, enhanced safety and redundant systems are also welcomed.

Inventions herein relate to firearm extraction mechanisms, particularly for semi-automatic firearms. Such mechanisms often rely on a somewhat tenuous arrangement for securing a shell casing to a bolt of the firearm. The uncertainties associated with manufacturing tolerances of cartridges, as well as the spurious nature of the frictional forces exerted thereon, leads to instability during the extraction process that can cause failures to eject and sporadic ejection patterns. This can particularly be a problem when handling smaller diameter casings that are generally associated with rimfire cartridges (i.e., cartridges that are fired by impingement of a firing pin near the periphery of the base of the cartridge), particularly higher powered rimfire cartridges.

Also, the instability of traditional extractor mechanisms is more problematic when the retracting bolt speed is variable. Where the bolt is moved too slowly the cartridge case can become instable long before it's delivered to the ejector.

An ejector mechanism that overcomes these problems would be welcomed.

SUMMARY OF THE INVENTION

Improved mechanisms operate together to provide a highly reliable and robust semiautomatic firearm particularly suited to high powered rimfire cartridges. In particular embodiments, a system delays blowback in firearms with reciprocating bolt assemblies in semiautomatic firearms and is particularly suitable for high power necked rimfire cartridges. A feature and advantage of embodiments of the invention is that enhanced reliability and minimization of out-of-battery firing of cartridges is provided. In embodiments, a semiautomatic firearm utilizes cooperating and common components to provide both a delayed blowback and a lockout of the firing pin when a bolt assembly is out-of-battery.

In embodiments of the invention, a movable member within a bolt body functions as a blocking member that blocks the firing pin and preventing the firing pin from striking a cartridge when the bolt is not in battery. In embodiments, the firing pin has two stop portions that the movable member can engage depending on the cycle status of the firearm. One stop portion, when blocked, prevents the firing pin from traveling into cartridge headspace when the hammer receiving end of the firing pin is struck by the hammer, the other stop portion, when blocked, prevents the firing pin from retracting to the ready to fire position such that the hammer receiving end of the firing pin is not exposed and thus cannot be struck.

In embodiments, in an in-battery position, when the bolt assembly is closed on the firing chamber, a movable blocking member is in a non-blocking position with respect to the firing pin. The movable blocking member has a projecting portion extending from the bolt body to be removably received in a recess of the firearm housing, for example a ceiling of the receiver. The movable blocking member may be biased to urge the projecting portion outwardly into the recess. When the blocking member is in the non-blocking position the firing pin is free to travel past the blocking member and into headspace of the bolt body to achieve ignition. In embodiments, the blocking member may be engaged with a spring assembly for providing the bias. In embodiments, a separate blocking member carrier or cammed intermediary member, movably forwardly and rearwardly in the bolt body, may be engaged with a spring assembly to provide the outwardly bias to the blocking member through the intermediary member. The intermediary member may have a ramp portion that the blocking member rides up with the spring assembly urging the ramp portion against the blocking member thereby urging the blocking member to ride up the ramp.

In embodiments, the bias urging the blocking member outwardly may be manually removed by a manual handle, for example by manually retracting the ramp portion that is engaged with and urging the blocking member outwardly.

The manual handle may be moved slightly rearwardly to back off the ramp and allow the movable member to retract to again put the blocking member in a blocking position with respect to the firing pin. Further motion of the manual handle then can pull the bolt assembly rearwardly to eject a cartridge engaged with the bold assembly.

In embodiments of the invention, a movable member, such as a lug, performs a locking function with respect to the in-battery position of the bolt assembly such that upon firing there is a delay in the retraction of the bolt assembly while the movable member unlocks. The movable member may extend from the bolt body outwardly to engage a recess in the firearm housing and be retractable inwardly between, respectively, a locked and an unlocked position. The movable member can extend and retract along an axis normal or transverse to the axis of the reciprocating bolt assembly and the axis as defined by the barrel bore. The movable member may have a bias towards the extended-locked position. In an embodiment the bias is provided by a ramp portion that is biased forwardly by a recoil spring assembly pushing a wedge under the movable member providing the bias outwardly. When the movable member is received in the recess in the housing an outwardly facing cam surface of the movable member engages a transition cam surface (an inclined surface) of the firearm housing requiring the transition cam surface to push the movable member inwardly with respect to the bolt assembly in order to escape the recess. Such inward movement requires retracting of the ramp portion within the bolt body, and due to the change of direction of the force, from normal or transverse to the axis of the reciprocating bolt assembly to a direction parallel to said axis, requires substantially more force than the force to overcome a force provided by the recoil spring assembly, for example, under the movable member. The movable member attempting to push the ramp portion downwardly is, appropriately termed, a reverse cam mechanism. The downward force increases the frictional resistance between the ramp portion and the surface upon which it slides and only a component of the downward force is translated to move the ramp portion. This component acts against and must overcome the frictional resistance as well as any additional spring force provided to resist the movement.

A feature and advantage of embodiments of the invention is that a cam mechanism is utilized in a normal forward fashion in association with a manual handle in a reciprocating bolt assembly of a semiautomatic firearm and is used in a reverse manner to delay blowback.

A feature and advantage of embodiments of the invention is a movable member slidingly constrained within the bolt body that locks out the firing pin, the movable member can be moved with respect to the lockout of the firing pin by cam surfaces engaging opposing ends of the movable member. A feature and advantage is that the movable member may be block shaped, a lug, with a firing pin opening therethrough that provides the firing pin block. A feature and advantage is that the block shaped movable member is not attached by pins or the like within the bolt and is simply slidingly constrained within open spaces in the bolt and breech region. Such a configuration eliminates wear issues, dirt and debris issue, and lubrication associated with using joints and pivot points for constraining moving parts. Moreover, in that the movable member has opposite ends which both are utilized as cam follower surfaces, this "float" of the movable member, with some free play in the constraint of the movable member, facilitates even engagement of the cam surfaces which the cam followers follow.

In embodiments, the movable member has a projecting locking tab that extends to engage a recess or stop surface in the ceiling of the receiver. The firing pin is blocked, or locked out, except when the tab is extending. The only recess or place for the locking tab to extend correlates to an in-battery position of the bolt assembly in an engaged ready-to-fire position.

A feature and advantage of embodiments of the invention is that mechanisms are utilized for delaying blowback that are contained mostly within the bolt body and therefore have minimal or reduced exposure to firing byproducts and contaminants.

A feature and advantage of embodiments of the invention is that the bias provided to the delayed blowback mechanism is a readily accessible spring that may be easily inspected and replaced if necessary.

In embodiments of the invention, the bolt assembly can be manually moved forwardly and rearwardly and pushed into an in-battery position if it is not in such a position. A manual handle extends from the bolt assembly and is directly engaged with the movable member carrier that traverses from the left side of the bolt body to the right side. The movable member carrier is moveable in a forward and rearward direction a limited amount within the bolt body, the limited movement associated with moving the movable blocking member up and down the ramp. The movable blocking member carrier may have the ramp surface, effectively a cam surface, engaged with the movable blocking member such that forward and/or rearward movement of the movable blocking member carrier moves the cam surface and a cam follower surface on the movable blocking member engaged with the cam surface causes the movable blocking member to move upwardly or downwardly.

A feature and advantage of embodiments of the invention is a semiautomatic firearm with a blocking member as part of a bolt assembly that moves in a vertical direction, up and down, between a blocking and non-blocking position with the firing pin. The blocking member needs to be in an upward or extended position, the non-blocking position, for the firing pin to be able to be struck by the hammer and translate forward to reach and impact a cartridge in a firing chamber.

A feature and advantage of embodiments of the invention is that particular components have multiple functions, thereby saving weight and minimizing the number of moving parts. For example, the movable member provides a delayed blowback mechanism for the bolt assembly and also provides a blocking or lockout for the firing pin when the bolt is not fully in the in-battery position. Moreover, the recoil spring assembly connected between the bolt assembly and the firearm frame may provide at least two functions. First the spring assembly provides forward bias to the bolt such that as the bolt is blown backwards the spring assembly cycles the bolt assembly forwardly, and second, the spring assembly provides an outward bias to the blocking member an intermediary member that engages the blocking member with a cam surface to urge the blocking member upwardly.

A feature and advantage of embodiments of the invention is that a delay in the bolt assembly blowback is affected by the disengagement of a projection extending from the bolt engaging the receiver that secures the receiver in an in-battery motion translation mechanism operating against spring aligned in the axis of the bolt assembly. A feature and advantage of embodiments is that the projection can be manually retracted from the receiver with a handle connecting to member that, by way of a ramp or cam surface extends and retracts the projection which allows opening of the bolt.

A feature and advantage of embodiments of the invention is that delay in the bolt assembly blowback is provided first by two serially connected motion translation mechanisms, in particular, two cam/cam follower mechanisms. In an embodiment, a spring bias is provided to the second cam follower mechanism. Moreover, the delayed blowback mechanism does not require a connection to the receiver by the mechanism, only a cam/cam follower engagement.

A feature and advantage of embodiments of the invention is the simplicity in that a single component both engages with a stop portion fixed with respect to the receiver for locking the bolt assembly in an in battery position and also engages with the firing pin to block the firing pin when the bolt assembly in an out of battery position. The movable member alternately locks the bolt and then blocks the firing pin providing simplicity of design and enhanced reliability, which is particularly effective in minimizing out-of-battery misfires.

In embodiments, a semiautomatic firearm with a reciprocating bolt in a receiver, the bolt may be manually retracted by pulling rearwardly a manual handle attached to a ramp portion that releases the engagement of the ramp with an outwardly projecting movable locking member with a stop portion fixed with respect to the receiver. The manual handle first releases the locking member with the rearward manual force on the handle, and then moves the bolt rearwardly with the continuing rearward manual force on the handle. Moreover, releasing the outwardly projecting movable locking member then blocks the firing pin decreasing out of battery misfires.

In embodiments of the invention, a bolt assembly of a semiautomatic firearm comprises a firing pin that has travel between a ready-to-fire position, a fire position, and two intermediate positions where it may be held or blocked. In embodiments the firing pin is held in the two intermediate positions by a blocking member that moves into and out of a blocking position. In embodiments the blocking member is the movable member that moves inwardly and outwardly with respect to the bolt body as the bolt assembly travels forwardly and rewardly.

In embodiments of the invention, a method of delaying the blowback of a bolt in an in-battery position after firing is provided by constraining a movable member within the bolt, the member movable in a direction transverse to the blowback direction of the bolt, positioning the movable member in a recess fixed with respect to a frame constraining the bolt, whereby the bolt cannot blowback until the movable member retracts, and providing a bias to resist the retraction, In embodiments the bias may be provided by a spring operating directly on the movable member. In embodiments, the method further may having the movable member engaging with a ramp portion such that the ramp portion must be moved, pushed out of the way, by the movable member pressing against a ramped surface of the ramp portion. In embodiments further comprising biasing the ramp portion to resist the movable member pushing it out of the way. The method comprising pushing the ramp portion out of the way to retract the movable member from the recess which then allows blowback of the bolt. Further, embodiments provide methods of locking out the firing pin depending on the positioning of the movable member.

Embodiments of the invention feature a sliding bolt assembly with a movable member with an outward projection, the outward projection having a sliding engagement surface. The movable member is part of the bolt assembly so it moves with the bolt assembly but also is movable in a direction transverse to the sliding direction of the bolt assembly (the bolt assembly moves forwardly and rearwardly). The movable member moves inward and outward by slidingly engaging a surface with structure on the receiver or firearm frame as the bolt reciprocates. In embodiments of the invention, the movable member provides an in-battery lock and provides a firing pin block when the bolt is not in the in-battery position. In embodiments of the invention, the outward projection is an end of two opposing ends, the opposite end of the outward projection, an inward sliding engagement surface that engages a wedge portion. The wedge portion is movable in the forward/rearward direction with respect to the bolt assembly and the wedge is biased forwardly to push the movable member outwardly. In embodiments the movable member floats within and is captured by a bolt body of the bolt assembly. In other embodiments the movable member is pivotal with respect to the bolt body.

A feature and advantage of the inventive aspects herein, such as the particular mechanisms and components accomplishing the delayed blowback and lockout of the firing pin, the extraction, and trigger pull adjustments, may be suitable for firearms that fire cartridges other than the necked rimfire cartridges such as .22 caliber rimfire (non-necked) and necked or non-necked centerfire cartridges.

Various embodiments of semiautomatic firearms with robust and redundant systems for reducing malfunctions are disclosed, particularly suitable for use with higher powered rimfire cartridges, such as 0.17 HSR and 0.17 WSM. The embodiments disclosed herein may also be utilized in firearms that fire centerfire cartridges and in .22 caliber firearms. A safety trigger is provided that is passively actuated in advance of a firing trigger. The safety trigger maintains redundant safety mechanisms that prevent inadvertent or accidental actuation of the firing trigger. Accordingly, the firing trigger can be configured for actuation with a very low magnitude or "soft" pull without compromising safety. That is, conventional firearms require substantial pull to be actuated in order to assure that the trigger doesn't misfire during otherwise routine handling. For the disclosed embodiments, the safety trigger assures that the firearm is discharged only upon deliberate actuation of the firing trigger. In one embodiment, a trigger pull adjustment mechanism provides adjustment of the pull of the firing trigger to a desired force required by the operator. The disclosed trigger pull adjustment mechanism reduces the number of components and complexity of the machined parts over conventional trigger pull adjustment mechanisms.

In some embodiments, a firearm with a safety trigger component must be retracted prior to the firing trigger being retracted to fire the firearm, the safety trigger providing a plurality of firing inhibitors. In one embodiment, the safety trigger component includes a direct hammer catch positioned in an interfering or catch position when the safety trigger is in an unretracted position and one or more additional firing inhibitors controlled by the safety trigger. In various embodiments, a firing inhibitor controlled by the safety trigger is a sear portion block. In some embodiments, the safety trigger moves a sear blocking portion between a blocking position and a non-blocking position with respect to the sear portion. Optionally, the sear portion is part of a unitary trigger component. In some embodiments, the safety trigger controls a firing trigger block that is positioned to prevent the pivoting of the firing trigger component about the pivot axis, thus inhibiting the retraction of the firing trigger.

Structurally, various embodiments of a trigger assembly of a firearm is disclosed, the trigger assembly including passive and redundant safety mechanisms to prevent unintentional firing when the firearm is in a firing mode. In some embodiments, the trigger comprises: a hammer rotatable about a first axis, the hammer including structure defining a capture feature; a firing trigger component rotatable about a second axis and including a first finger hook portion, the firing trigger component including a sear portion releasably coupled to the hammer; and a safety trigger component rotatable about the second axis and including a second finger hook portion, the second finger hook portion extending forwardly of the first finger hook portion. In some embodiments, a first of the redundant safety mechanisms includes a catch portion defined on the safety trigger component and, when the safety trigger is in a battery position, is aligned for arresting the capture feature of the hammer as the hammer rotates to prevent discharge of the firearm. In some embodiments, a second of the redundant safety mechanisms includes a blocking member operatively coupled with the safety trigger component for maintaining the blocking member in a blocking position when the safety trigger component is in a battery position, the blocking member blocking an underside of the firing trigger component when in the blocking position to prevent release of the sear portion from the hammer, the blocking member being operatively coupled with the safety trigger component for moving the blocking member out of the blocking position by moving the safety trigger out of the battery position to enable release of the sear portion from the hammer. In one embodiment, a rearward deflection of the safety trigger component causes rotation of the blocking member.

In certain embodiments, the blocking member includes an arcuate base portion rotatable about a third axis, the arcuate base portion defining a recess and being operatively coupled with the safety trigger component for rotation about the third axis. In one embodiment, the arcuate base portion blocks the underside of the firing trigger component from being actuated when the safety trigger component is in the battery position, and the recess aligns with the firing trigger when the safety trigger component is rotated out of the battery position to enable the firing trigger to release the hammer.

In some embodiments, the blocking member includes a lever portion operatively coupled with the safety trigger component for rotation about a third axis, wherein the lever portion blocks the underside of the firing trigger component to prevent disengagement of the firing trigger component from the hammer, the lever portion being maintained in the blocking position by the safety trigger when the safety trigger is in the battery position, the lever portion being selectively rotatable out of the blocking position by rotating the safety trigger out of the battery position.

Alternatively or in addition, the trigger assembly comprises a manual safety mechanism actuated by a push button forward of the first finger hook portion and laterally actuated for selectively placing the firearm in one of a safety mode and a firing mode, the manual safety mechanism being operatively coupled to the blocking member for preventing the safety trigger component from moving the blocking member out of the blocking position when in the safety mode, and enabling the safety trigger component to move the blocking member out of the blocking position when in the firing mode.

For embodiments including the fore-mentioned manual safety mechanism, the blocking member can include an arcuate base portion rotatable about a third axis, the arcuate base portion defining a recess and being operatively coupled with the safety trigger component for rotation about the third axis, wherein: the arcuate base portion blocks the underside of the firing trigger component from being actuated when the safety trigger component is in the battery position and when the firearm is in the safety mode and in the firing mode; and the recess aligns with the firing trigger when the firearm is in the firing mode and the safety trigger component is rotated out of the battery position to enable the firing trigger to release the hammer. Optionally, the lever portion that extends from the arcuate base portion of the blocking member.

In some embodiments, the blocking member includes a lever portion operatively coupled with the safety trigger component for rotation about a third axis, wherein the lever portion blocks the underside of the firing trigger component to prevent disengagement of the firing trigger component from the hammer, the lever portion being maintained in the blocking position by the safety trigger when the safety trigger is in the battery position and the firearm is in the firing mode, the lever portion being selectively rotatable out of the blocking position when the firearm is in the firing mode by rotating the safety trigger out of the battery position. In some embodiments, the lever portion contacts the firing trigger when the safety trigger is in the battery position.

In various embodiments, the firearm includes a bolt assembly translatable forwardly and rearwardly, the bolt assembly including a firing pin that is offset from the barrel axis for firing rimfire cartridges, and wherein the chamber is configured for necked cartridges. Some embodiments provide for arresting the hammer to facilitate semi-automatic operation. In various embodiments, a trigger pull adjustment mechanism is provided for adjusting a pull required to actuate the firing trigger component.

In various embodiments of the disclosure, a firearm having a fully cocked configuration and a triggered configuration is disclosed, comprising: a hammer including a sear engagement portion; a biasing element operatively coupled with the hammer that shifts the hammer from a first orientation that corresponds to the fully cocked configuration to a second orientation that corresponds to the triggered configuration; a firing trigger component including a sear portion that engages the sear engagement portion of the hammer when the trigger assembly is in the fully cocked configuration, the firing trigger component being actuatable for disengagement of the sear portion from the sear engagement portion, enabling the biasing element to shift the hammer from the first orientation to the second orientation; a safety trigger component selectively movable between a blocking position and a non-blocking position; and a blocking member that engages the safety trigger component and is moveable by the safety trigger component between a first position wherein the safety effector member prevents actuation of the firing trigger component when the safety trigger component is in the blocking position and a second position wherein the safety effector member enables actuation of the firing trigger component when the safety trigger component is in the non-blocking position.

The safety trigger component can optionally comprise a catch that prevents the hammer from reaching the second orientation from the first orientation when the safety trigger component is in the blocking position. The manual safety mechanism can include a safety bar accessible from outside the housing. In some embodiments, a housing contains the hammer and the biasing element, wherein the blocking member is selectively engageable with the housing to prevent the safety trigger component from moving the safety effector member. The blocking member can operatively coupled with a manual safety mechanism that selectively engages the safety effector member with the housing. The firing trigger component can be actuatable by rotation about a pivot, the pivot being operatively coupled with the housing.

In various embodiments of the disclosure, a semiautomatic firearm is presented having a fire trigger with a curvature and a central slot and a safety trigger disposed in the slot and having a curvature conforming to the curvature of the fire trigger, the fire trigger having a normal position and a fire position rearward of the normal position, the safety trigger having a normal position extending forwardly of the normal position of the fire trigger, and a fire position at or rearwardly of the normal position of the fire trigger, the safety trigger associated with at least two firing inhibitors, the firing inhibitors in a inhibiting position when the safety trigger is in the normal position and in a non-inhibiting position when the safety trigger is in the fire position.

Various embodiments of the disclosure include a hammer that pivots about a pivot axis and has capture features on opposing sides. In some embodiments, the hammer includes a first engagement portion that operates as a hammer to prevent the hammer release unless a safety trigger is retracted, and the hammer includes a second engagement portion as an arrestor that prevents automatic firing action and captures the hammer should the firing trigger remain retracted during a recoil cycle.

Some embodiments of the disclosure include a semiautomatic firearm suitable for high powered rimfire cartridges that incorporates a trigger assembly with a plurality of firing inhibitors to minimize misfires and out-of-breach firings of cartridges and that still allows for a low pressure trigger pull that can be adjusted by the user, for example, field adjustable.

Some embodiments disclose a semiautomatic firearm having a fire trigger with a curvature and a central slot and a safety trigger disposed in the slot and having a curvature approximating the curvature of the fire trigger, the safety trigger being connected to a plurality of firing inhibitors that each have an inhibiting position and a non-inhibiting position.

In various embodiments, a semiautomatic firearm is disclosed having a fire trigger with a curvature and a central slot and a safety trigger disposed in the slot and having a curvature substantially conforming to the curvature of the fire trigger, the fire trigger having a battery position and a fire position rearward of the battery position, the safety trigger also having a battery position extending forwardly of the battery position of the fire trigger, and a fire position at or rearwardly of the battery position of the fire trigger, the safety trigger associated with at least two fire inhibitors, the fire inhibitors being in an inhibiting position when the safety trigger is in the battery position and in a non-inhibiting position when the safety trigger is in the fire position.

Various embodiments of the disclosure provide a mechanism for stably securing a spent cartridge casing to a bolt assembly during extraction. In some embodiments, the same mechanism provides stability for a cartridge that is inserted onto a bolt assembly for the reloading process. In some embodiments, the extraction mechanism is tailored to accommodate high powered small caliber rounds, such as, for example, 0.17 Hornady Magnum Rimfire (0.17 HMR) and 0.17 Winchester Super Magnums (0.17 WSM) cartridges.

Various embodiments of the disclosure address the instability of traditional extractor mechanisms when the retracting bolt speed. Positive cartridge/casing retention of the extractor allows the system to not be speed dependent.

Structurally, an extraction mechanism for a firearm is disclosed, comprising a bolt assembly including a bolt with a bolt face, the bolt assembly being translatable along a central axis. A recess sized to accommodate the base of a cartridge is defined on the bolt face, the recess including a base surface on the bolt face, the base surface being substantially normal to the central axis. In various embodiments, the recess defines an access on a lateral face of the bolt. The access can be concentric about a lateral axis. A ledge portion partially surrounds the base surface of the bolt face, the ledge portion including an inclined face that defines a normal vector including an axial component parallel to the central axis that is directed toward the base surface. In various embodiments, the axial component is in the range of 40 degrees to 70 degrees inclusive from the normal vector. In one embodiment, a cross-section of the inclined face is substantially straight, so that the inclined face and the base surface define an acute angle therebetween. In one embodiment, the ledge portion includes an arcuate segment about the central axis, and can also include a substantially straight portion tangential to the arcuate segment. A retractable extractor can be disposed proximate the recess, the retractable extractor being extendable over the base surface. In one embodiment, a firing pin that selectively extends into the recess in a direction normal to the base surface.

The inclined face of the ridge enables the spent cartridge casing to be adequately secured to the bolt face, while enabling the spent cartridge casing to slide upward and outward from the recess when brought into contact with the ejector.

In various embodiments, a semi-automatic firearm is disclosed, comprising a barrel defining a chamber centered about a barrel axis for holding a rimfire cartridge and a bolt assembly operatively coupled to the barrel. The bolt assembly is movable along the barrel axis to an engagement position with the barrel and is adapted to discharge the rimfire cartridge. The bolt assembly can comprise a unitary bolt body having a distal end portion, the distal end portion defining a recess for receiving a head of a rimfire cartridge. The recess is bound by a base surface that is normal to the barrel axis, an undercut portion that extends distally from the recessed base surface, and a ledge portion distal to the undercut portion that protrudes radially inward toward the barrel axis relative to the undercut portion. The ledge portion defines a central axis and includes an inclined face that faces the base surface. In one embodiment, the inclined face presents a rearwardly facing partial frusto-conical surface for engaging an exposed portion of a rim of a rimfire cartridge in the recess. In various embodiments, the semi-automatic firearm is in combination with a rimfire cartridge.

In one embodiment, the recess sized for receiving a head of a rimfire cartridge. The base surface and undercut portion can be sized such that the head of the rimfire cartridge is slidable on the base surface in all radial directions from the central axis for positioning a rim of the rimfire cartridge to contact the inclined face of the ledge portion. In one embodiment, the barrel axis and the central axis are non-concentric for seating a rim of a rimfire cartridge against the inclined face of the ledge portion when the bolt assembly is in the engagement position with the barrel. An extractor can be pivotally engaged with the bolt body, the extractor having a hook portion biased toward the central axis and extending over the recess. The hook portion can configured for engagement with a spent cartridge casing to push a rim of the spent cartridge casing into engagement with the inclined face of the ledge portion.

In various embodiments, at least part of the ledge portion is diametrically opposite the extractor. In one embodiment, at least a portion of the ledge portion is opposite the extractor, the hook portion being positioned for engaging a case wall of a rimfire cartridge to slide the rimfire cartridge on the base surface of the recess to contact with the inclined face of the ledge portion. In some embodiments, the ledge portion defines an arcuate segment.

The semi-automatic firearm can further include a receiver operatively coupled to the barrel, the bolt assembly being movably engaged within the receiver, the firearm including an ejector member positioned in an opening of the bolt body for ejecting a spent cartridge casing from the recess when the bolt assembly moves rearwardly.

In one embodiment, the inclined face of the ledge portion defines an acute angle facing inwardly toward the central axis. In various embodiments, the acute angle can be in a range of 25 degrees to 85 degrees inclusive, 25 to 65 degrees inclusive, 35 to 60 degrees inclusive, 35 to 55 degrees inclusive, or 40 to 50 degrees inclusive. In various embodiments, the ledge portion extends at least 30 degrees and less than 180 degrees around the recess.

In some embodiments, the recess is sized for a .22 caliber or smaller cartridge. The bolt recess can be sized to enable movement of the head of the cartridge at least 4% of the diametric distance of a standard cartridge size at the head of the cartridge.

In various embodiments of the disclosure, a semi-automatic firearm is disclosed for firing rimfire ammunition, the firearm comprising including a barrel defining a chamber for receiving and firing a rimfire cartridge, a receiver operatively coupled to the barrel, and a bolt assembly operatively coupled to the receiver and adapted for loading, firing, and ejecting a rimfire cartridge. The bolt assembly is translatable rearwardly along a central axis to a rearward position for withdrawal of a cartridge casing from the chamber and ejection of the casing, the bolt assembly being translatable from the rearward position forwardly for loading a rimfire cartridge from a magazine into the chamber. The bolt assembly can comprise a bolt body with a forward bolt face, and a recess defined on the forward bolt face for receiving the head of a rimfire cartridge, the recess being proximally bound by a base surface on the bolt face, the base surface being substantially normal to the central axis, the recess surface being oversized compared to a head of a rimfire cartridge. In various embodiments, the recess defines an access on a lateral face of the bolt. The access can be concentric about a lateral axis that intersects the central axis at a right angle.

The bolt assembly can further include a ledge portion that partially surrounds the base surface of the bolt face, the ledge portion including an inclined face that defines a normal vector including an axial component parallel to the central axis that is directed toward the base surface. The axial component is in a range of 40 degrees and 70 degrees inclusive relative to the normal vector. A retractable extractor, such as a claw-type extractor, can be disposed proximate the recess, the retractable extractor being extendable over the base surface. In some embodiments, a firing pin, such as a rim-type firing pin, selectively extends into the recess in a direction normal to the base surface, the firing pin parallel to and non-concentric with the central axis to effect rimfiring of a rimfire cartridge.

The ledge portion optionally includes an arcuate segment and a substantially straight portion tangential to the arcuate segment. In one embodiment, the retractable extractor is substantially centered at a location diametrically opposed to a junction point of the straight portion and the arcuate segment.

In various embodiments of the disclosure, an extraction mechanism for a firearm is disclosed comprising a bolt assembly including a bolt with a bolt face, the bolt assembly being translatable along a central axis. A recess is defined on the bolt face, the recess being proximally bounded by a base surface on the bolt face, the base surface being substantially normal to the central axis. A ledge portion can partially surround the base surface of the bolt face, the ledge portion including an inclined face that defines a normal vector including an axial component parallel to the central axis that is directed toward the base surface. In some embodiments, the axial component is in the range of 40 degrees and 85 degrees inclusive from the normal vector.

In some embodiments, a retractable extractor is disposed proximate the recess, the retractable extractor being extendable over the base surface. In one embodiments, a firing pin that selectively extends into the recess in a direction normal to the base surface. Optionally, the bolt assembly defines an off-axis bore that is parallel to and non-concentric with the central axis, the firing pin being disposed in the off-axis bore, wherein the firing pin is a rim-type firing pin.

The ledge portion can include an arcuate segment, the arcuate segment defining a radius about the central axis. The ledge portion optionally includes a substantially straight portion tangential to the arcuate segment, wherein the retractable extractor is substantially centered at a location diametrically opposed to a junction point of the straight portion and the arcuate segments.

In some embodiments, there is a firing chamber distal to the bolt assembly, the firing chamber being concentric about a barrel axis. Optionally, the firing chamber includes structure defining a circular access opening and a ridge, the ridge including an edge that is immediately adjacent the circular access opening, wherein the retractable extractor engages the ridge to rotate the retractable extractor away from the recess when the firearm is in a firing position. The central axis and the barrel axis can be parallel and non-concentric. In one embodiment, the central axis and the barrel axis are spaced apart and the ledge portion is dimensioned for engagement of a cartridge rim with the inclined face of the ledge portion when the firearm is in a firing configuration.

In various embodiments of the disclosure, a firearm is disclosed, comprising a firing chamber distal to the bolt assembly, the firing chamber being concentric about a barrel axis; a bolt assembly including a bolt with a bolt face, the bolt assembly being translatable along a central axis, the central axis and the barrel axis being substantially parallel and non-concentric; a recess defined on the bolt face, the recess being proximally bounded by a base surface on the bolt face, the base surface being substantially normal to the central axis; and a ledge portion and an undercut portion that partially surrounds the base surface of the bolt face, the ledge portion extending towards the central axis relative to the undercut portion and defining an inclined face that faces the base surface, the ledge portion including an arcuate segment, the arcuate segment defining a radius centered about the central axis. The ledge portion is dimensioned and the central axis and the barrel axis are spaced apart for engagement of a cartridge rim with the inclined face of the ledge portion when the bolt is engaged with the firing chamber in a firing configuration. The inclined face of the ledge portion can define a frusto-conical headspace. Optionally, the inclined face can define a profile that is arcuate and convex.

In various embodiments, a method for extracting a spent cartridge casing from a firing chamber of a firearm includes providing a bolt translatable along a central axis and including a bolt face, a recess defined on the bolt face that includes a base surface that is substantially normal to the central axis, a ledge portion that partially surrounds the base surface, the ledge portion including an inclined face that defines a normal vector including an axial component parallel to the central axis that is directed toward the base surface, and a retractable extractor disposed proximate the recess that is extendable over the base surface; and causing the retractable extractor to extend over the base surface as the bolt is translated away from the firing chamber for engagement with the spent cartridge casing, the engagement of the shell casing causing a rim portion of the spent cartridge casing to engage the inclined face of the ledge portion, thereby capturing the rim portion of the shell casing.

The various mechanisms provide for a highly robust, reliable, semiautomatic firearm.

DESCRIPTION OF THE DRAWINGS

FIG. 5 is a cross sectional view of the firearm of FIG. 3A taken through the manual handle with the outwardly projectable movable member in a recess in the ceiling of the receiver in a non-blocking position with respect to the firing pin.

FIG. 6 is a cross-sectional view of the receiver of FIGS. 4 and 5 illustrating a recess including a cam surface in the ceiling of the receiver for receiving/engaging the movable member.

FIG. 7 is a perspective view of a bolt assembly with the manual handle separated therefrom.

FIG. 22A is top schematic plan view of a semiautomatic firearm with the bolt assembly in an in battery position.

FIG. 22B is a side schematic elevation view of the semiautomatic firearm of the FIG. 22A illustrating the position of the movable member.

FIG. 23A is top schematic plan view of the semiautomatic firearm of FIGS. 22A and 22B showing the position of the bolt assembly out of battery, for example after firing a cartridge.

FIG. 23B is a side schematic elevation view of the semiautomatic firearm of the FIG. 23A illustrating the position of the movable member.

FIG. 24A is top schematic plan view of the semiautomatic firearm of FIG. 23A with the bolt assembly in a full retracted position.

FIG. 24B is side schematic elevation view of the semiautomatic firearm of the FIG. 24A illustrating the position of the movable member.

FIG. 25A is top schematic plan view of a semiautomatic firearm of FIGS. 22A to 24B after the bolt assembly has recoiled to the in-battery position and the locking member is received in the recess in the receiver.

FIG. 25B is side schematic elevation view of the semiautomatic firearm of the FIG. 25A illustrating the position of the movable member.

FIG. 31 is a perspective view of the movable member engaged with the ramp portion and in a non-blocking position with respect to the firing pin when the bolt assembly is in the in-battery position.

FIG. 32 is a perspective view of the assembly of FIG. 31 with the firing pin in the most forwardly position for firing the cartridge.

FIG. 33 is a perspective view of the assembly of FIGS. 31 through 32 with the outwardly projectable movable member lowered to be in a blocking position with the firing pin immediately after a cartridge is fired, the firing stop portion still forward of the movable member.

FIG. 34 is a perspective view of the assembly of FIG. 33 with the stop portion of the firing pin engaged with the movable member.

FIG. 35 is a perspective view of the assembly of FIGS. 31 through 34 with the movable member moving up the ramp from the position in FIG. 34 and the firing pin moving to a release position with the movable member.

FIG. 36 is a perspective view of the assembly of FIGS. 31 through 35 the movable member in the non-blocking position with respect to the firing pin.

DETAILED DESCRIPTION

Figure 1A:
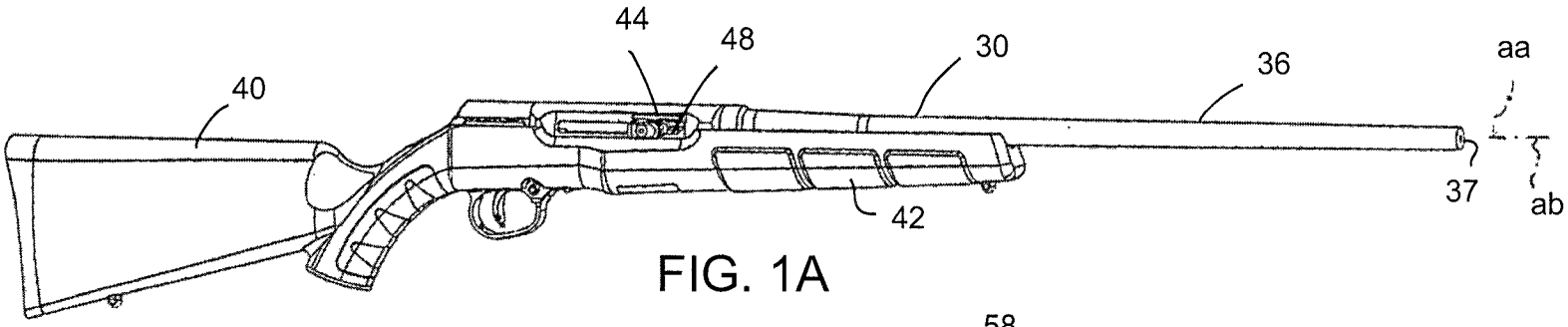
FIG. 1A is a perspective view of a semiautomatic firearm in accord with the inventions herein.
Figure 1B:
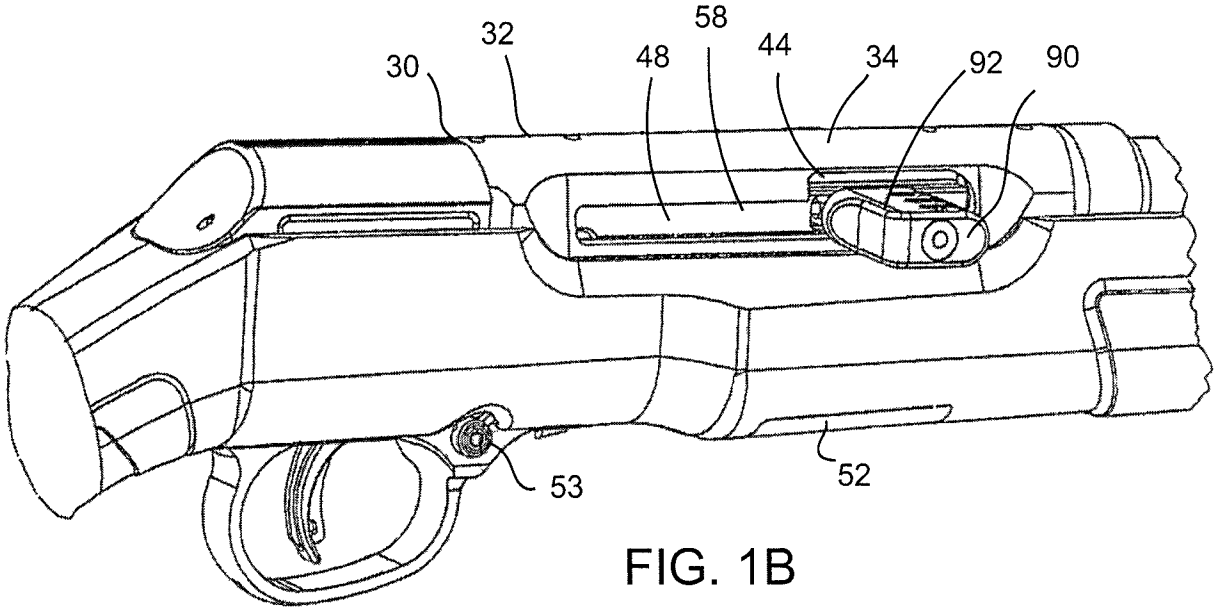
FIG. 1B is a more detailed perspective view of the semiautomatic firearm of FIG. 1.
Figure 2:
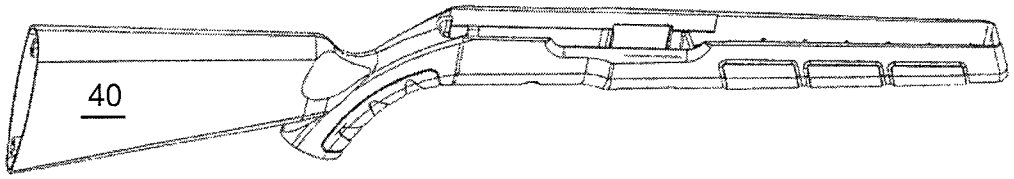
FIG. 2 is a perspective view of a molded stock for receiving the receiver, barrel, and trigger and firing mechanism of the firearm of FIG. 1.
Figures 3A, 3B:
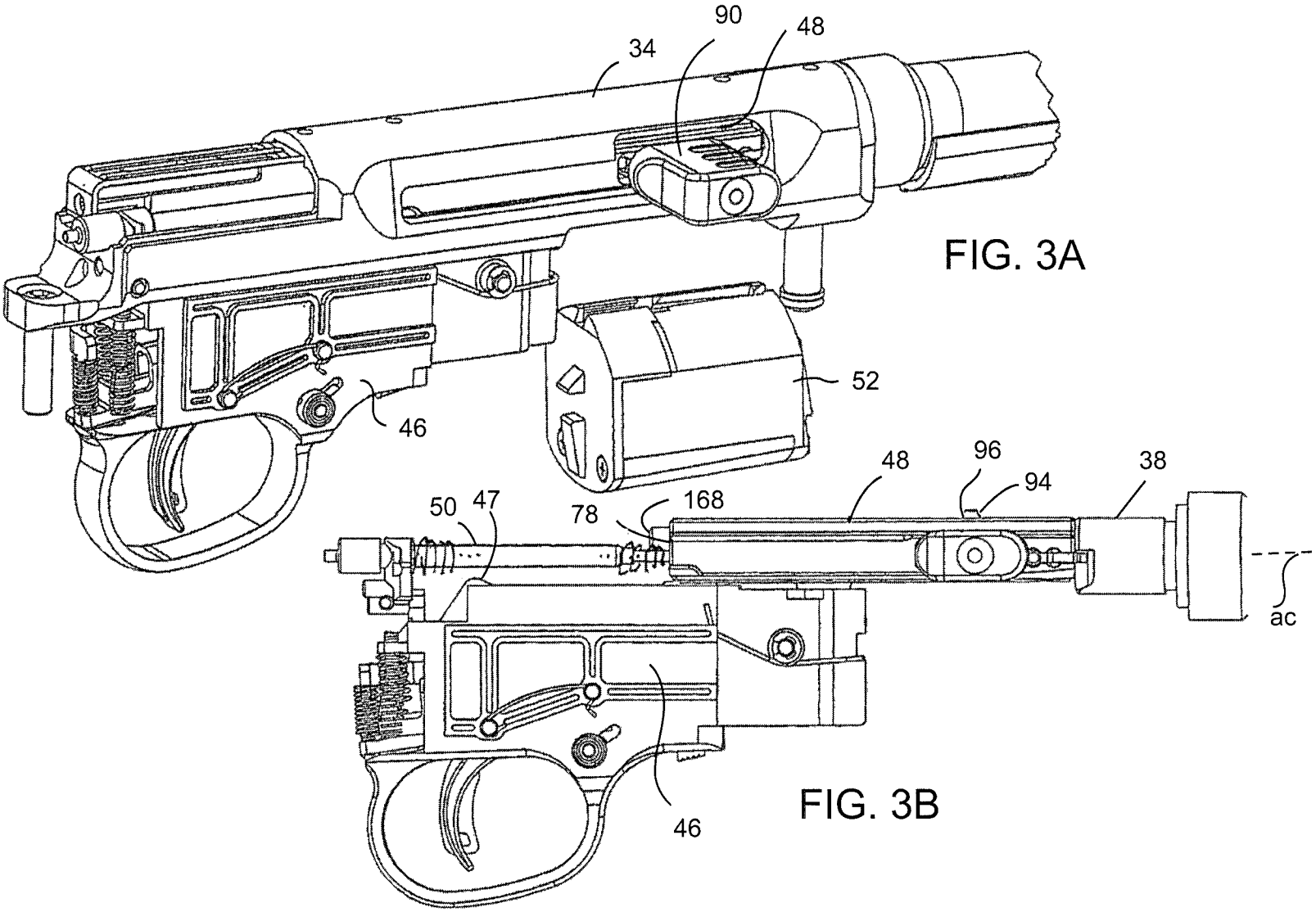
FIG. 3A is a perspective view of the firearm of FIGS. 1 and 2 with the stock and portions removed.
FIG. 3B is a side elevation view of the firearm of FIG. 3A with portions including the receiver removed.

Referring to FIGS. 1A-4, a semiautomatic firearm 30 according to embodiments of the invention is illustrated and generally comprises a housing 32 including a receiver 34, a barrel 36 with a bore 37 and a firing chamber 38, a stock 40 with a forestock portion 42, an ejection port 44, a trigger and firing assembly 46 with a hammer 47, a bolt assembly 48, a recoil spring assembly 50, and a magazine 52. In one example, the trigger and firing assembly may be inserted into the unitary stock and forestock component as shown in FIG. 2. Then the barrel and upper receiver assembled on top of that and coupled to the trigger and firing assembly. The bolt assembly and recoil spring assembly inserted into the rear upward opening 56 of the receiver with panels added.

The bolt assembly 48 is slidingly engaged in the receiver 34 to move forwardly and backwardly along a bolt assembly travel axis aa which also is also coincident with a barrel axis ab of the bore 37 and is generally a central axis ac of the firearm. The receiver generally has an interior 57 defining a breech region that receives the bolt assembly, an opening 58 that defines the ejection port 44, an inner surface 60 and a ceiling 61. Ledges 62 on the receiver 34 constrain the bolt assembly and may provide bearing surfaces for sliding engagement with the bolt assembly. An engagement surface defining a longitudinal cam surface 63 is fixed with respect to the receiver and may be on the ceiling 61 of the receiver. The cam surface includes a first surface 64 that is at a first elevation 64, a second displaced surface at a second elevation 65 that is configured as a recess surface 65, and a transition cam surface 67 which provides an inclined surface leading from the first surface to the second surface. The first surface is part of a linear portion 69 as illustrated is an inward cam portion 64 with respect to the bolt assembly. The recess surface 65 defining an outward cam portion 65 and the transition cam surface 67 being an inclined surface. In other embodiments the cam portions and cam surfaces may be part of a rib extending inwardly in the breech area or a separate piece attached to the receiver.

Referring generally to FIGS. 1-17, details of an embodiment of the bolt assembly 48 are illustrated, particularly showing features of the assembled bolt assembly. The bolt assembly has a forward face 68, a top side 70, a left side 72, a right side 74, a bottom side 76, and a rearward side 78. The bolt assembly comprises a bolt body 82 that may be a unitary form, a firing pin assembly 86, a retractable extractor 88, a manual handle assembly 90 with a manual handle 92, a bolt locking mechanism 93 including a movable member 94 that moves upwardly and downwardly about an axis b transverse to the axis aa, which may be perpendicular to the axis b, and that engages the cam surface 63 of the inside surface of the receiver. In embodiments, the bolt assembly has a firing pin blocking mechanism 95, discussed in detail below, which may utilize componentry of the bolt locking mechanism. The movable member has a cam follower surface 96 that engages a cam surface on the ceiling of the receiver. When engaged in the recess 66, the bolt assembly is in a locked position with respect to the in-battery position. Unlocking the bolt assembly, requires disengagement of the cam follower surface with the recess. When out of the recess the bolt is in an unlocked position. The cam surface may be part of the receiver or a separate component attached to the receiver.

Figure 15:
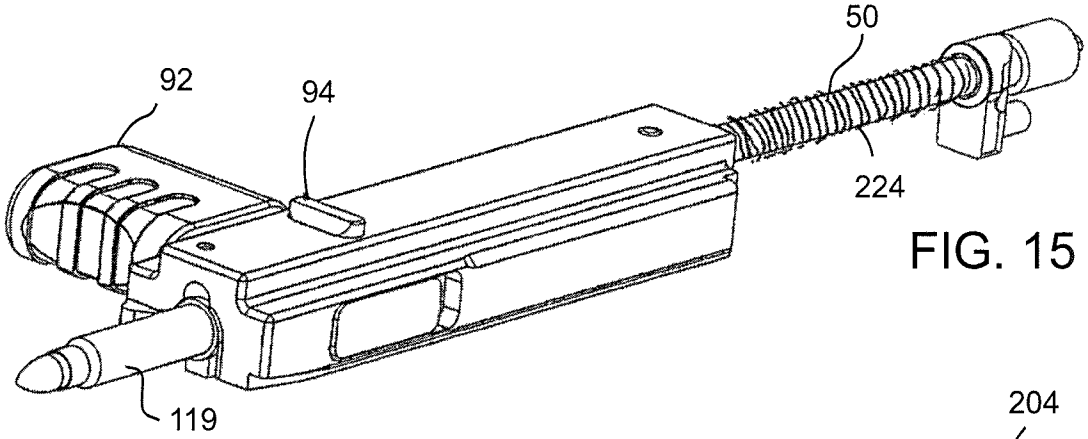
FIG. 15 is a perspective view of the bolt assembly with the recoil spring assembly engaged therewith and with a necked rimfire cartridge in the bolt headspace.
Figure 16:
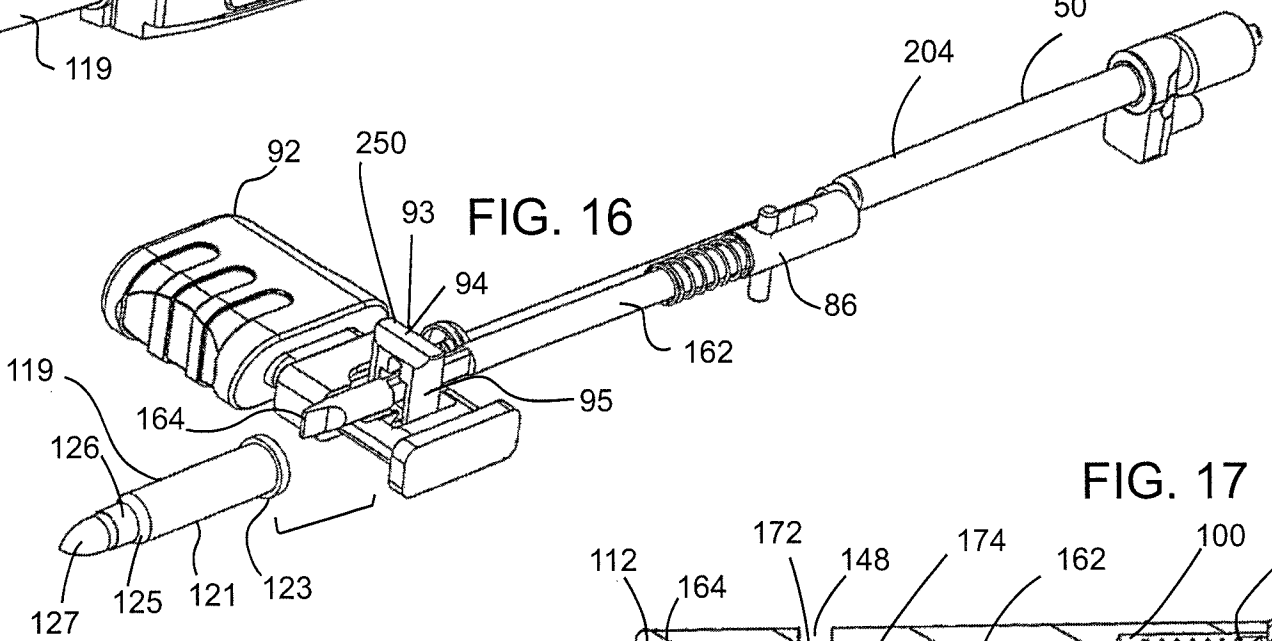
FIG. 16 is a perspective view of the bolt assembly of FIG. 15 with the bolt body removed.
Figure 17:
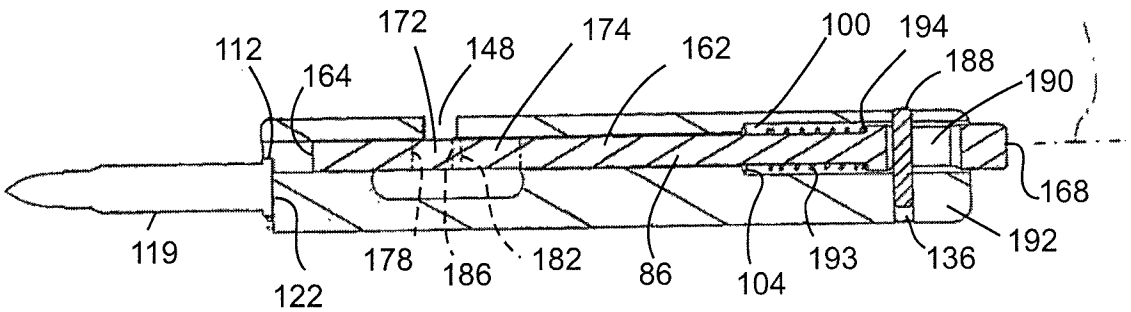
FIG. 17 is a cross-sectional through the bolt body and firing pin.
Figures 18, 19, 20, 21:
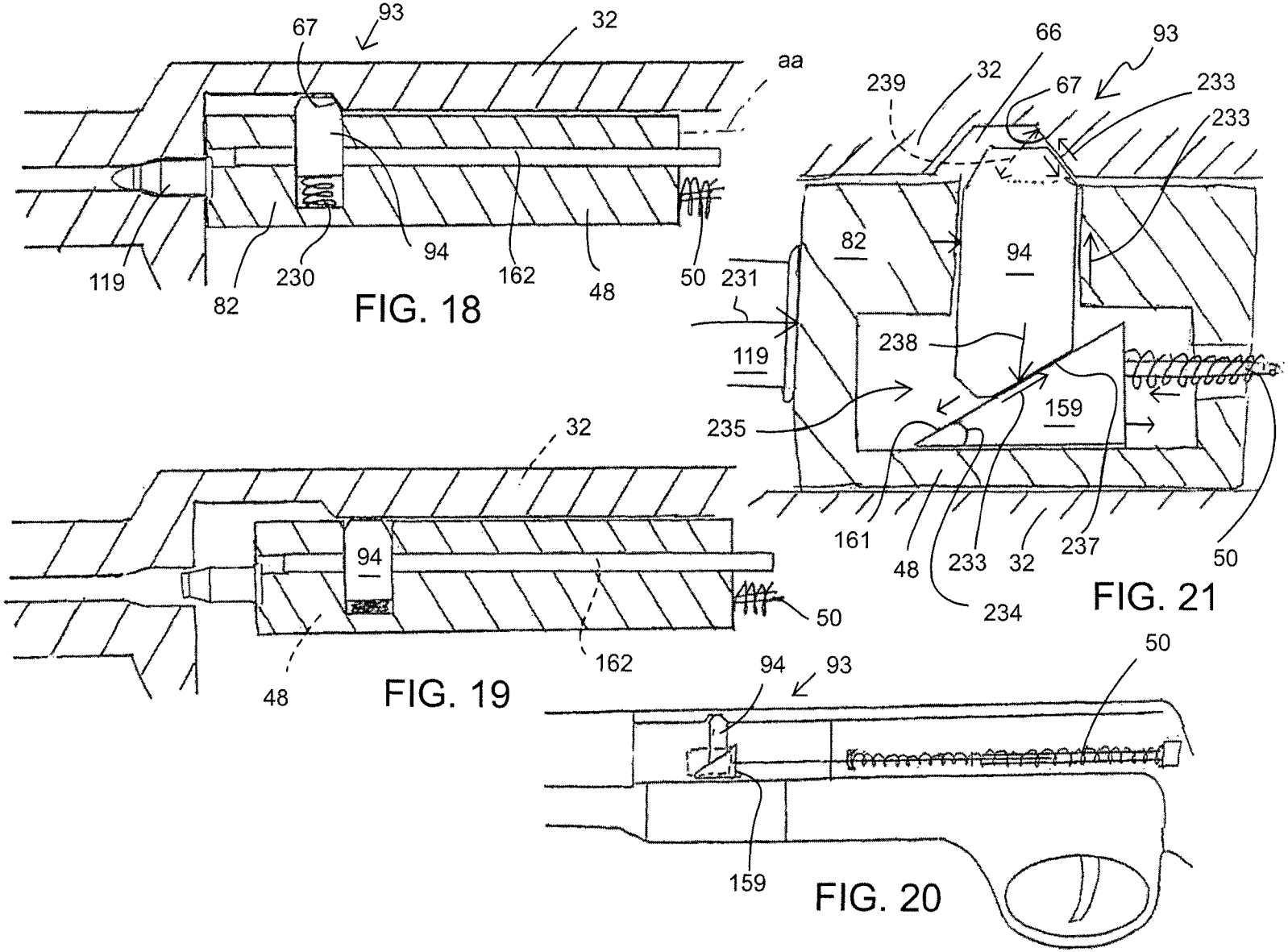
FIG. 18 is a side schematic elevation view of the semiautomatic firearm with a bolt locking mechanism.
FIG. 19 is a side schematic elevation view of the semiautomatic firearm of the FIG. 18 with the movable member unlocked.
FIG. 20 is a side schematic elevation view of the semiautomatic firearm with a bolt locking mechanism that has two reverse cam mechanisms.
FIG. 21 is a cross sectional view showing the bolt assembly mechanisms of FIG. 20 in detail.
Figure 30:
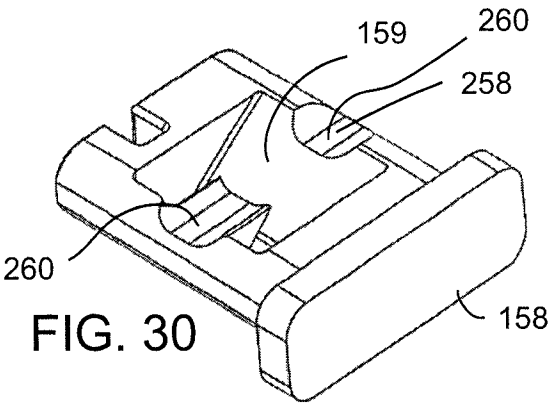
FIG. 30 is another perspective view of the carrier of FIG. 29.
Figure 29:
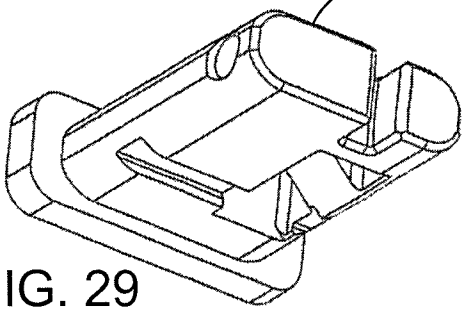
FIG. 29 is a perspective view a carrier for the movable/blocking member of FIGS. 26-28.
Figure 28:
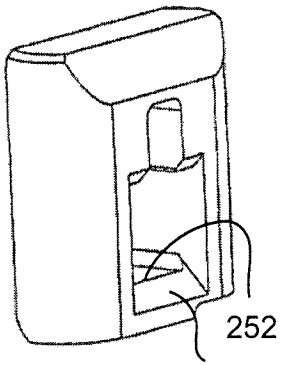
FIG. 28 is another perspective view of the movable/blocking member of FIGS. 26 and 27.
Figure 26:
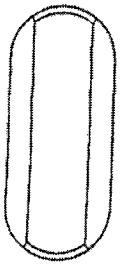
FIG. 26 is a top plan view of a movable/blocking member.
Figure 27:
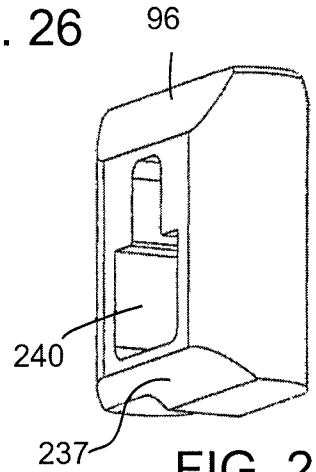
FIG. 27 is a perspective view of a movable/blocking member.

The bolt assembly 48 according to embodiments of the inventions, including the internal components, is illustrated in further detail in FIGS. 3-5, 7-17. The bolt body 82 has a firing pin opening or conduit 100 extending longitudinally through the bolt body that receives the firing pin assembly 86. The firing pin thus moves longitudinally in the opening along an axis af that is generally parallel to the central axis, the axis of the bolt assembly, The conduit is defined by the internal surface 102 and includes a spring stop surface 104 where greater bore 106 transitions to a lesser bore 108, see in particular FIG. 11. A cartridge head space 112 is defined on the forward face 68 of the body (and bolt assembly) and is defined by lip 114 which extends over an undercut region 115 and is generally of an inverted U-shape, defining a cartridge head receiving region 118 with a flat surface that engages the cartridge 119. As best illustrated in FIGS. 15 and 17, the cartridge 119, such as a necked rimfire cartridge, is received in the U-shaped recess and seats against the planar bolt head space surface, and is pushed into the undercut region by the retractable extractor 88. This is further described in a related application. The cartridge 119 is a high power rimfire cartridge and has a casing 121 with a casing head 122 and a rim 123. On the bullet end of the casing, a collar 125 and necked down portion 126 reduce the diameter of the casing to be sized for the bullet 127. When used herein, "necked rimfire cartridge" refer to these cartridges. Such cartridges have the primer propellant in the rim and do not have a central primer. The barrel and firing chamber are configured for receiving the necked rimfire cartridge as illustrated in FIGS. 18 and 19. The 0.17 HMR and 0.17 WSM are such cartridges.

The extractor and the cartridge head receiving region with the undercut has been found to reliably extract and eject cartridges in synergistic association with the componentry described herein and as such contribute to and are an integral part of providing a reliable, mechanically simple, semiautomatic firearm with improved performance, particularly for high power necked rimfire cartridges.

The trigger and firing mechanism 46 includes a double safety trigger 128 and pull adjustment 129. These are described in detail in a related application. The double safety trigger and trigger pull adjustment have been found to contribute to and are an integral part of providing a reliable, mechanically simple, semiautomatic firearm with improved performance, particularly for high power necked rimfire cartridges.

Figure 4:
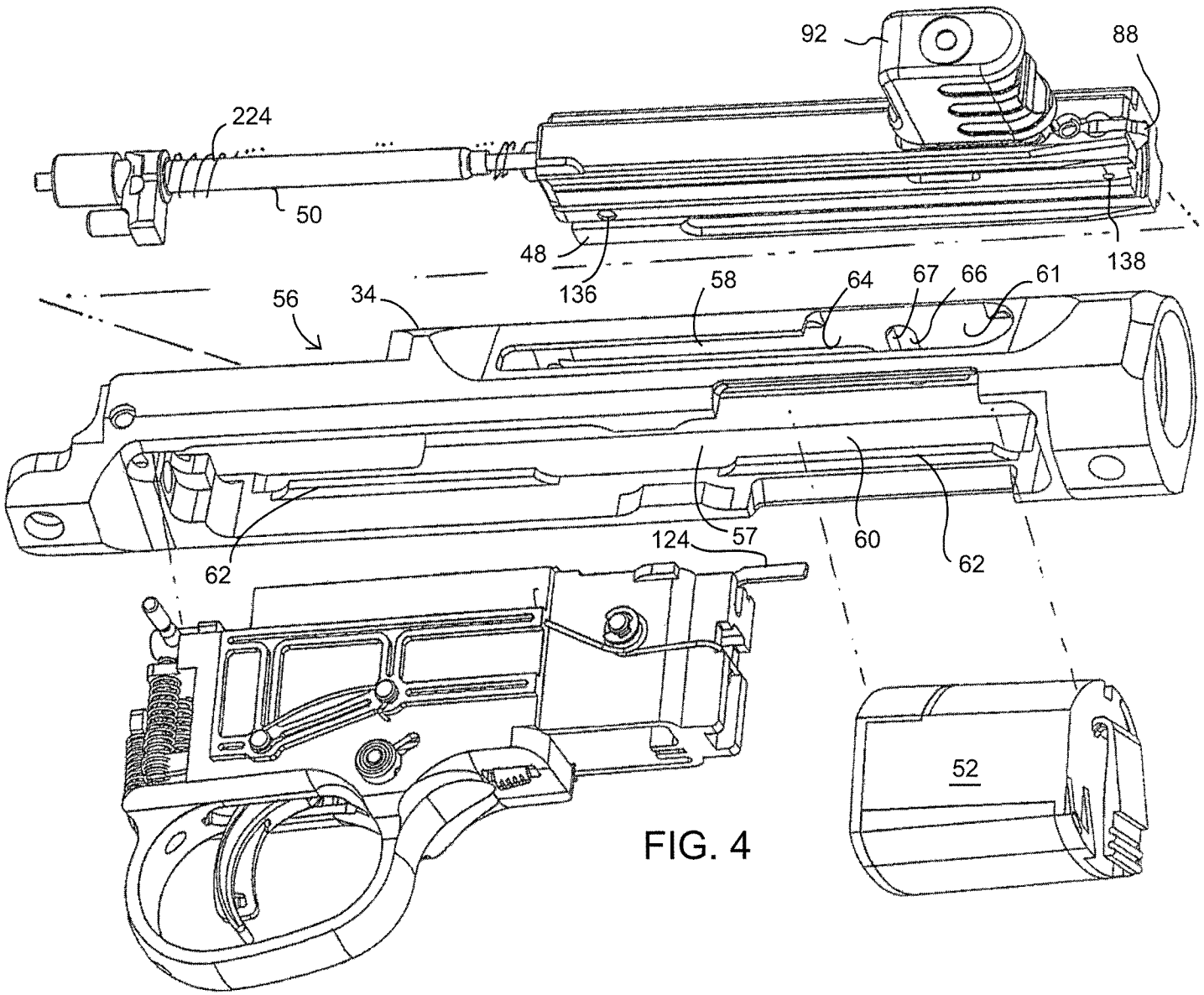
FIG. 4 is an exploded view of components of a firearm in accord with the inventions herein.
Figure 9:
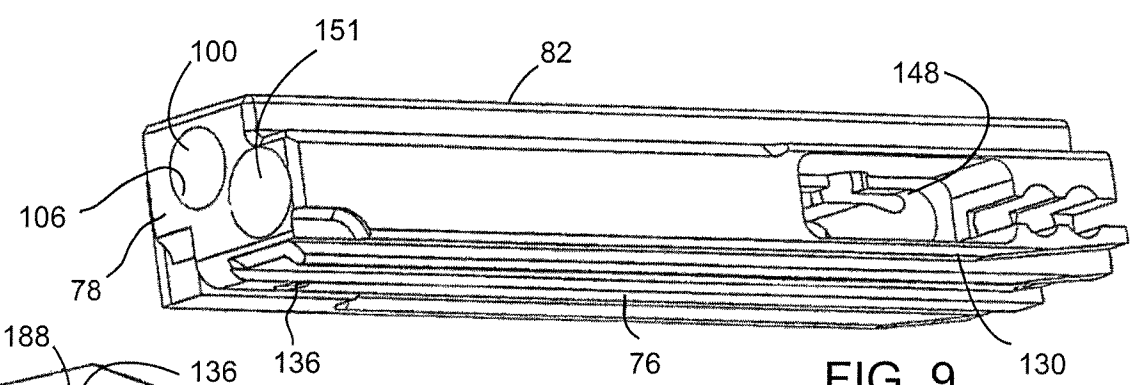
FIG. 9 is a perspective view of the bolt body of FIG. 13 taken from the right rear corner.
Figure 10:
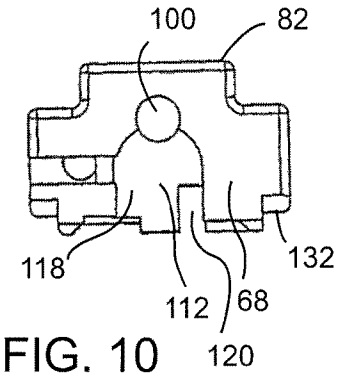
FIG. 10 is a front elevation view of the bolt body of FIGS. 13 and 14.
Figure 8:
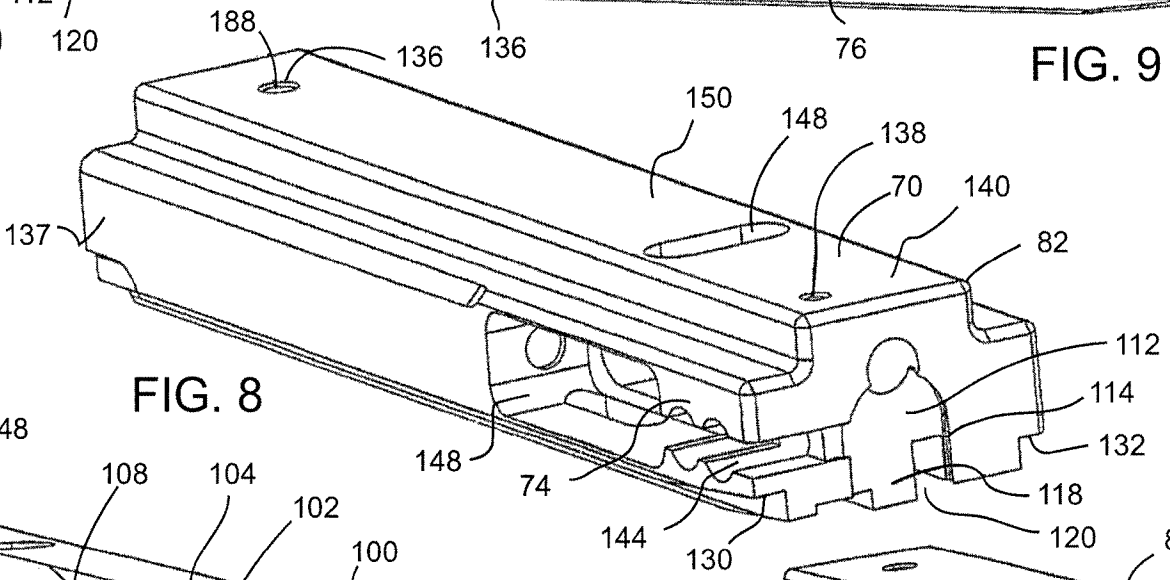
FIG. 8 is a perspective view of a bolt body taken from the right front corner
Figure 12:
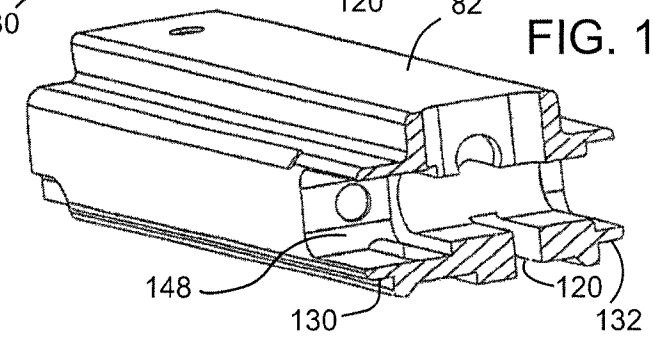
FIG. 12 is a cross-sectional view of a bolt body illustrating the apertures for the spanning member and the movable member.
Figure 11:
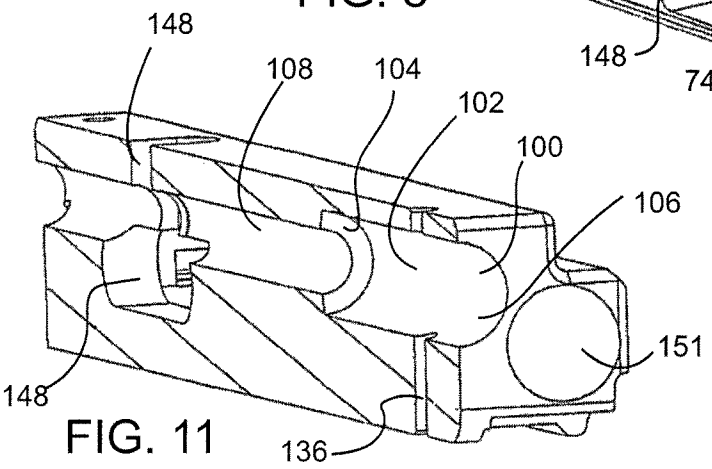
FIG. 11 is a cross-sectional view of the bolt body of FIG. 13 illustrating a spring recess for the bolt recycling spring assembly.
Figure 13:
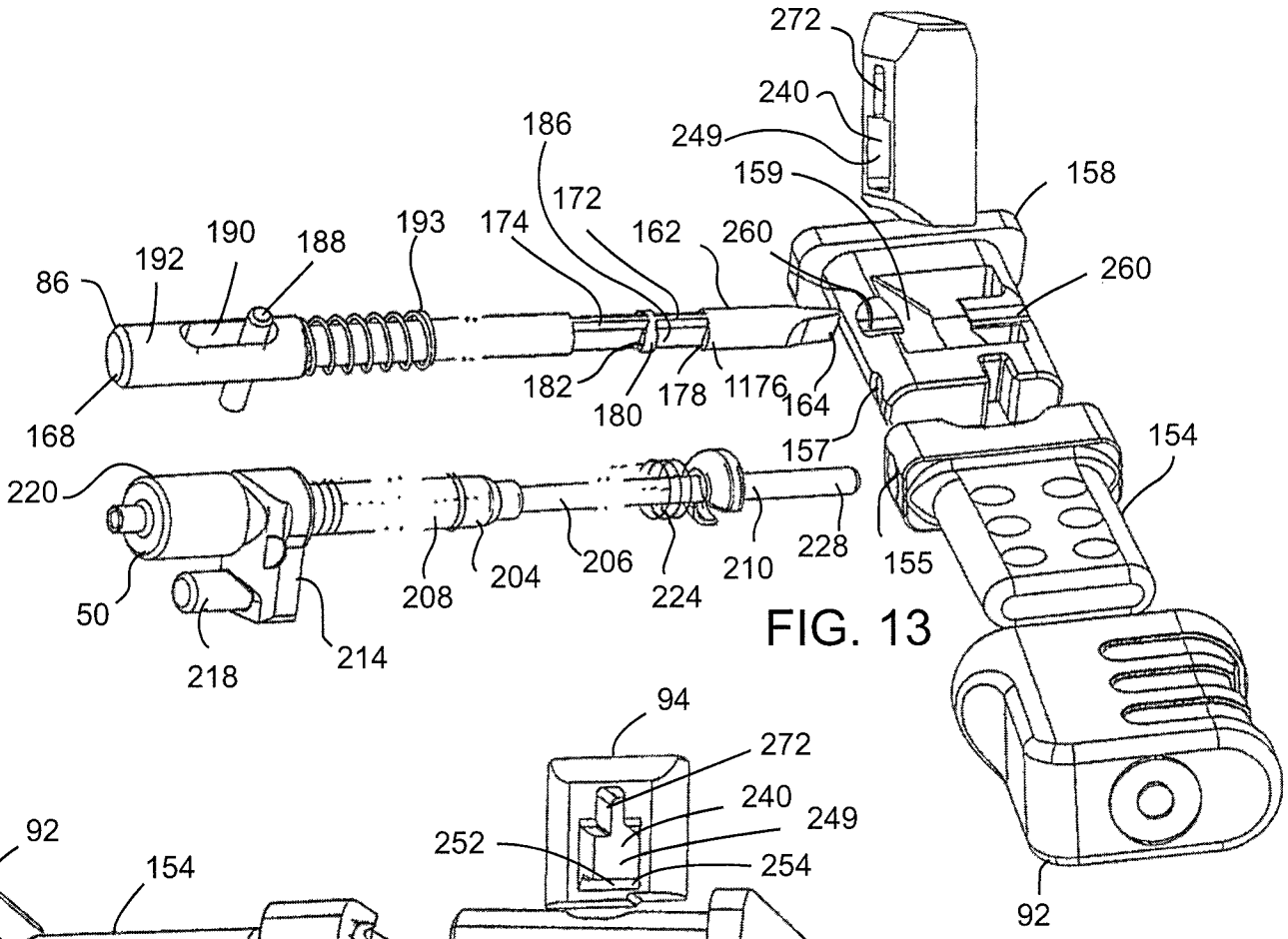
FIG. 13 is an exploded perspective view of the components of the bolt assembly except for the bolt body for purposes of illustration.
Figure 14:
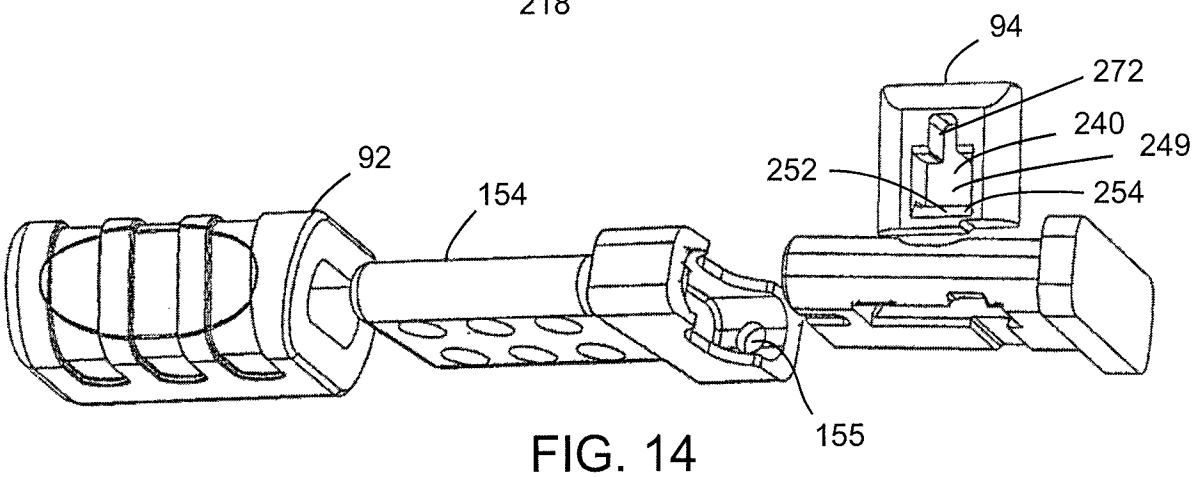
FIG. 14 is an exploded perspective view of the manual handle and connection means to the bolt body.

An ejector slot 120, shown best in FIGS. 8-10, receive the ejector 124, see FIG. 4, which extends along the bottom side 76 of the body. The ejector is fixed with respect to the receiver and kicks out a spent casing that is held by the bolt assembly, when the bolt assembly is blown back, see FIG. 9. Bearing surfaces 130, 132 of the bolt body, as seen in FIG. 8, engage the ledges 62 of the housing/receiver 34, see FIGS. 4 and 5. A pin aperture 136 for retaining the firing pin extends vertically through a rearward portion 137 of the bolt body, referencing FIGS. 8-12. A pin aperture 138 also extends vertically through a forward portion 140 of the bolt body 82 for retaining the retractable extractor 88. A slot 144 for receiving components of the extractor assembly extends horizontally inwardly on the right side of the forward portion of the bolt body. A further slot 148 for receiving components of the bolt locking mechanism and firing pin blocking mechanism (discussed below) extends through the forward portion of the bolt body from the left side to the right side and a slot on the top surface 150 of the bolt body guides and constrains the movable member 94, which in embodiments is part of the bolt locking mechanism 93 and the firing pin block 95. The movable member may thus be termed a movable blocking member or a blocking member or a locking member depending on context. The movable member may be said to "float" within the bolt body 82 in that it is only constrained and not fastened or directly attached to the bolt body. A longitudinally extending recoil spring assembly opening 151 extends from the rearward end to the slot 148 for the bolt locking mechanism and firing bin block.

The bolt assembly further has the manual handle 92 that extends out the ejection port 44 of the firearm. The manual handle is attached to an intermediary member 154 that has a side aperture 155 that is in alignment with the recoil spring assembly opening 151. A carrier or spanning member 158 for the movable member 94 is inserted into the slot 148 and extends from the left side of the bolt body to the right side and engages the movable member within the bolt body. The carrier member has a side aperture 157 in alignment with the intermediary member aperture 155 as well as the recoil spring assembly opening 151. The spanning member 158 has a ramp portion 159 with a ramp surface 161 that cooperates with a cooperating surface 160 on the movable member 94 such that as the ramp is moved forwardly or backwardly, the movable member raises or lowers respectively. The ramp surface acts as a cam surface and the movable member is a cam follower.

The firing pin assembly 86 and how it integrates with the bolt body is best seen in FIGS. 5, 11, 13, 16, and 17. The firing pin assembly, as illustrated, includes an elongate shaft defining the firing pin 162 and has a forward cartridge engagement tip 164 that has a flattened elongate shape for engaging the rims of rimfire cartridges and a blunt rearward end 168 that is struck by the hammer 47 (see FIG. 3). The firing pin has a pair of reduced diameter, or thinned, portions 172, 174 that define a forward stop portion 176 and first forward stop surface 178. Additionally, a second rearward stop portion 180 and respective second stop surface 182 is defined by the rearward reduced diameter or thinned portion 174. A third intermediate stop surface 186 is positioned between the forward and rearward stop surfaces. The functionality of these are discussed below. The firing pin is retained in the opening 100 by way of a pin 188 secured in the pin aperture and extending through a slot 190 in the rearward end portion 192 of the firing pin. A spring 193 is positioned in the firing pin opening 100 between a spring stop 194 on the firing pin and the spring stop surface 104 defined in the bolt body. The spring 193 provides a rearward bias to the firing pin.

The recoil spring assembly 50 and how is integrates with the bolt assembly is best illustrated in FIGS. 3, 5, 7, 13-16. The recoil spring assembly has a shaft 204 that, in an embodiment as illustrated, is telescoping with an inner shaft portion 206 and an outer shaft portion 208. A spring stop 209 is positioned on a forward end 210 of the shaft. A housing engagement portion 214 with an attachment lug 218 connects to the shaft 204 and is secured thereto by a shaft end piece 220. A recoil spring 224 is positioned under compression on the telescoping shaft between the housing or receiver engagement portion and the spring stop. The assembly is inserted into the recoil spring assembly opening which is sized to allow freedom of movement of the spring and telescoping shaft, particularly to compress and expand. A forward end 228 of the shaft 204 is inserted in the aperture 155 on the handle intermediary member 154 and extends into the aperture on the spanning member 158 thereby effectively locking the handle assembly and bolt locking mechanism 93 in place in the bolt body.

Embodiments of bolt locking mechanism 93 in accord with the inventions herein are illustrated in FIGS. 5-7, 15-22B. In embodiments, the movable member 94 extends from the bolt body and is movable inwardly and outwardly which in a normal firing position of a firearm, is vertically. The movable member is movable from an extended position as shown in FIGS. 5, 7, 18, 21, 22B, 30, 31, 35 to a retracted position as illustrated by FIGS. 19, 23B, 24B, 32, 33 and back and forth. In an embodiment as illustrated in FIGS. 18 and 19, the vertically movable member 94 has an outward (shown also as upward) bias as provided by, for example, a coil spring 230 and a cam follower surface on one end. In another embodiment, such as shown in FIG. 21, the movable member has cam follower surfaces on opposite ends. When the rimfire cartridge 119 is fired by impact with the firing pin with the rim 236 of the cartridge, the bolt assembly 48 cannot move rearwardly until the movable member is retracted. Since the force provided to retract the movable locking member is acting essentially at 90 degrees from the needed direction of retraction, there is a substantial force multiplication requirement of what is needed at the bolt to accomplish the retraction at the movable member. In the embodiment of FIGS. 18 and 19, the spring force of the coil spring 230 can be adjusted to provide appropriate retraction resistance of the movable member to delay the retraction and blowback. The recoil spring assembly 151 directly engages the bolt body 82 in this embodiment. In embodiments, the movable member can be positioned in different locations on the bolt to interact with the cam surface on the housing adjacent thereto. Although embodiments in this application illustrate cooperation with the engagement or cam surface 67 on the ceiling 61, the upper part of the receiver, interaction could also take place on the sides of the receiver or housing. More than one such movable member and cooperating cam surfaces can be utilized.

Referring to FIGS. 20 and 21, a further embodiment which has the upward bias on the movable member 95 but the bias is provided through the ramp portion 159 that has a forward bias provided by a recoil spring coaxial with the axis of the firearm barrel. Arrow 231 indicates the force applied to the bolt assembly 48 by a fired cartridge, said force is transmitted to the movable member 94 through the bolt body 82. In order for the bolt assembly to move rearwardly, the movable member needs to retract from the recess 66. The inclined surface 67 provides the downward reactionary force to move the movable member 94 downwardly. Additional metal to metal frictional forces, indicated by the arrows 233 provide resistance to the downward movement.

Additionally, the movable member must push the ramp portion 159 rearward with respect to and within the bolt body 82 to retract. This is accomplished by way of the downward force on the ramp surface 161. This rearward movement is "squeezing" the ramp portion or wedge out-of-the-way of the movable member. It can also be described as a reverse cam mechanism with the component which is configured as a cam follower pushing on the component that is configured as having the cam surface to move that component—the ramp portion. The resistance of the ramp portion to moving rearward is highly dependent upon angle 234, the lesser the angle the more downward force, as indicated by arrow 238, is needed.

Significantly, the carrier with the ramp portion moving forward is essentially has a reverse cam mechanism 235. That is, what would be traditionally a cam follower, the lower surface 237 of the movable locking member 94 is forcing the movement of what would normally be the cam surface, the ramp portion 159. And forcing it in a direction substantially normal to the force provided by the movable member and the ramp portion is biased against the movement by the recoil spring assembly 151. This provides a great multiplication of the blowback resistance of the bolt over what would be provided in a simple blowback arrangement where the resistance to blowback is provided by the inertia of the mass of the bolt assembly and the resistance provided by the recoil spring and frictional resistance. This mechanism also provides a dramatic increase over the configuration of FIGS. 18 and 19. The arrangement shown schematically in FIGS. 22A-25B has been shown by the applicant, in necked rimfire cartridges, to provide a highly reliable semiautomatic cycling action. Such reliability has not been commercially seen previously in a semiautomatic rifle for necked rimfire cartridges. The incline angles 234, 239 of the sliding surfaces can be adjusted to increase or decrease the force multiplication for blowback of the bolt assembly.

Referring to FIGS. 22A-25B, the sequence of stages in recycling the firearm with such a delayed blowback configuration as described with reference to FIGS. 20 and 21 above is illustrated. FIGS. 22A and 22B shows the bolt assembly in an in-battery condition, ready to fire. The movable locking member 94 is engaged in the recess in the ceiling of the receiver. In FIGS. 23A and 23B, the rearward force provided by the firing of the cartridge has forced the locking member downwardly by pushing the ramp portion rearwardly against the bias of the spring 224. In FIGS. 24A and 24B, the bolt is in the full retraction position, the spring is compressed and will return the bolt assembly to the in-battery position as illustrated by FIGS. 25A and 25B and urge the movable locking member 94 into the recess by way of the ramp portion 159.

Figure 37A:
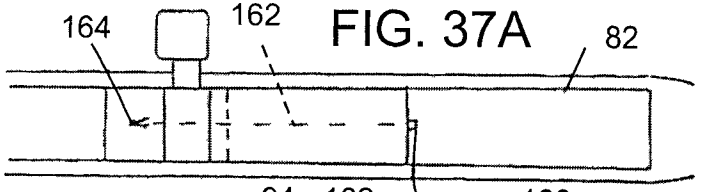
FIG. 37A is schematic plan view showing the position of the firing pin with respect to the bolt assembly in the in-battery position.
Figure 37B:
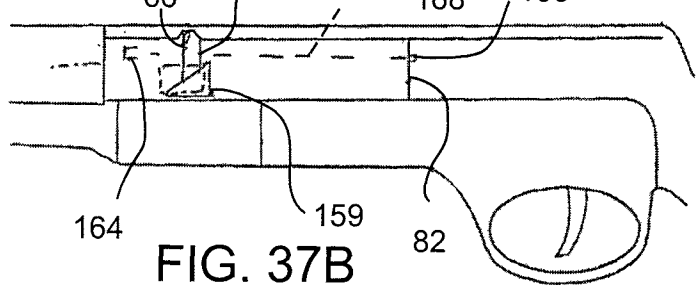
FIG. 37B is schematic elevation view showing the position of the firing pin and movable member with respect to the bolt position of FIG. 37A.

The firing pin blocking mechanism 95 is illustrated best in FIGS. 5-7, 13-17, 31-43. In embodiments, the firing pin mechanism may be locked out in two ways, first by an interference with forward motion and secondly by way of removing the exposed striking end of the firing pin such that the hammer cannot strike it. The outwardly projectable movable member 94 is a blocking member with respect to this mechanism and function. The blocking member may have an inverted T-shaped opening 240 that cooperates with structure 242 on a forward portion 244 of the firing pin 162. The wedge 248 as illustrated in FIGS. 31-36 represents the ramp portion 159 or cam surface of the blocking member carrier 158 and FIGS. 37A-40B further illustrate the positioning of the firing pin 162 during different stages of operation. FIGS. 17, 31, 32, 37A, 37B, 40A, 40B correspond to the in-battery position of the bolt assembly in a ready-to-fire mode with the blocking member at an elevated position on the ramp portion and with the outward engagement tip 250 or cam follower surface 96 of the movable member 94 engaged in the recess 66. The movable blocking member 94 is thus in a non-blocking position and the firing pin is extending through the widest or largest portion of the opening, the non-blocking opening portion 249, of the inverted T-shaped aperture. This allows the firing pin structure, specifically the stop portions 176, 180, to pass through unobstructed. The movable blocking member may have a bearing surface 252 including a tapered lead-in surface 254 on which the firing pin may rest or engage during forward and rearward motion. Similarly, the blocking member carrier 158 including the ramp portion 159 may have cut away portions 258 and bearing surfaces 260. In this in-battery position, as best seen in FIGS. 17, 37A and 37B, the rearward striking end 168 of the firing pin is exposed out of the bolt body 82 and the forward tip 164 is displaced from the cartridge head space 112 in the bolt body.

Figure 38A:
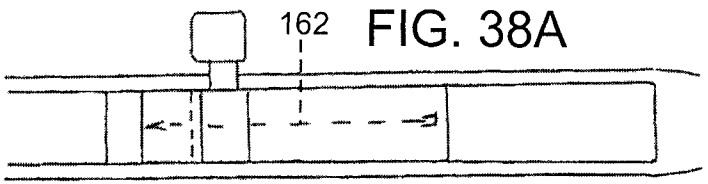
FIG. 38A is schematic plan view showing the position of the firing pin with respect to the bolt assembly after ignition of a cartridge and out of the in-battery position.
Figure 38B:
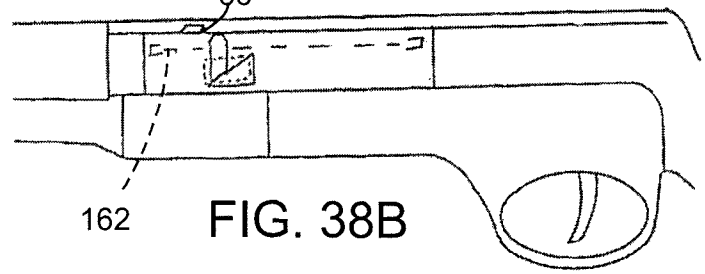
FIG. 38B is schematic elevation view showing the position of the firing pin and movable member with respect to the bolt position of FIG. 38A.
Figure 40A:
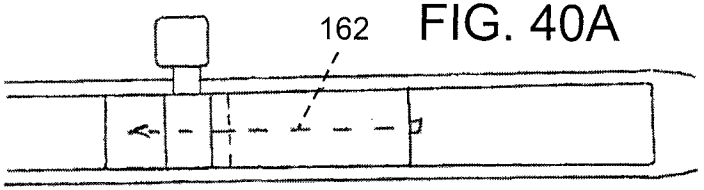
FIG. 40A is schematic plan view showing the position of the firing pin with respect to the bolt assembly having returned to the in-battery position from the full recoil position with the firing pin rearward end exposed.
Figure 40B:
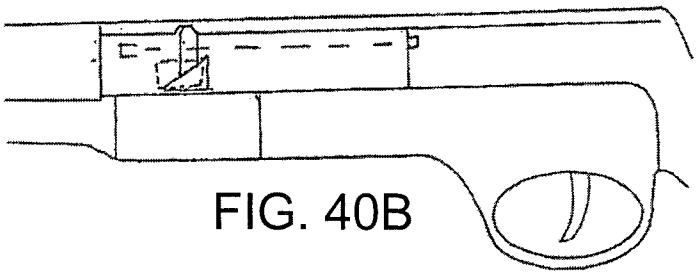
FIG. 40B is schematic elevation view showing the position of the firing pin and movable member with respect to the bolt position of FIG. 40A.
Figure 39A:
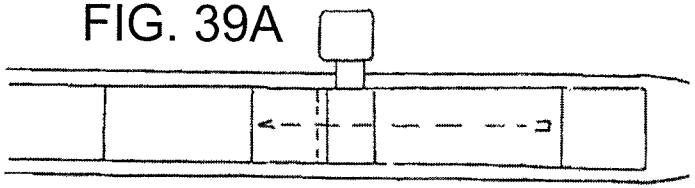
FIG. 39A is schematic plan view showing the position of the firing pin with respect to the bolt assembly in the full recoil position of the bolt assembly.
Figure 39B:
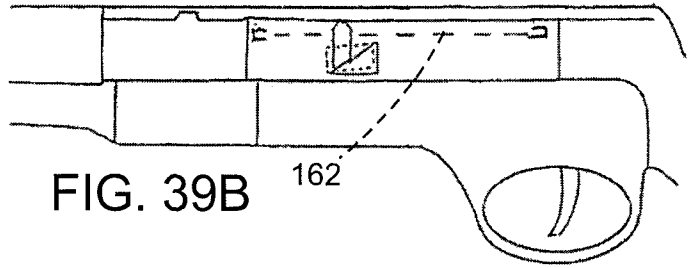
FIG. 39B is schematic elevation view showing the position of the firing pin and movable member with respect to the bolt position of FIG. 39A.
Figure 43:
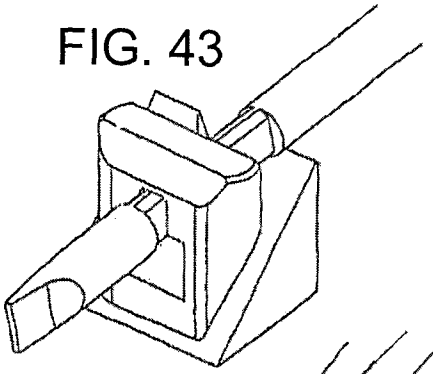
FIG. 43 is a perspective view of the assembly of FIG. 42 where the hammer has struck the firing pin and the blocking portion precludes the firing pin from traveling forward to the headspace of the bolt thereby precluding firing of a cartridge in the headspace.

FIG. 32 illustrates the position of the firing pin with respect to the blocking member upon being struck by the hammer and impacting the cartridge. This generally is the furthermost forward position of the firing pin. The movable blocking member 94 is still engaged in the recess 66 in the ceiling of the receiver 34. In FIGS. 33, 38A, and 38B the force from the ignited cartridge has acted upon the bolt assembly driving same rearwardly as it forces the cam follower portion of the blocking member inwardly (downwardly), as indicated by arrow 264 in FIG. 32, by way of the transition cam surface 67. This inward (or downward) forces transmits the force downward on the ramp portion and due to the inclined surface engagement, forces the ramp portion, as indicated by arrow 266, and the blocking member carrier 158 rearwardly within the bolt body and further blows the entire bolt assembly rearward against the resistance provided by the recoil spring 224. With the blocking member moved downwardly as illustrated in FIG. 22C, the firing pin now passes through the narrowed blocking portion 272 of the firing pin opening 240. In the embodiment illustrated, the firing pin did not have time to retract after impacting the cartridge and a blocking portion 276 of the movable blocking member engages the rearwardmost reduced diameter or thinned portion 174, of the firing pin, see FIG. 33, and interferes by way of the more rearward stop portion 180. Further rearward retraction of the firing pin continues, see FIG. 34, as urged by the recoil spring 224. At this stage, the firing pin is fully retracted within the bolt body as illustrated by FIGS. 38A and 38B, shielded from the hammer, and the bolt assembly proceeds to its full recoil position as shown in FIGS. 39A and 39B with the firing pin still completely enclosed in the bolt body. When the bolt assembly returns towards the in-battery position, movable blocking member 94 will transition, as illustrated by FIG. 35, into the recess. In the fully seated position of the blocking member in the recess of FIGS. 36, 40A, and 40B as illustrated, the firing pin is now in the non-block region of the opening, is exposed out the rearward end of the bolt body 82 and the firearm is ready to fire. FIG. 34 presents a first position for the movable member where the firing pin is blocked and FIG. 31 presents a second position where the firing pin is not blocked.

Figure 42:
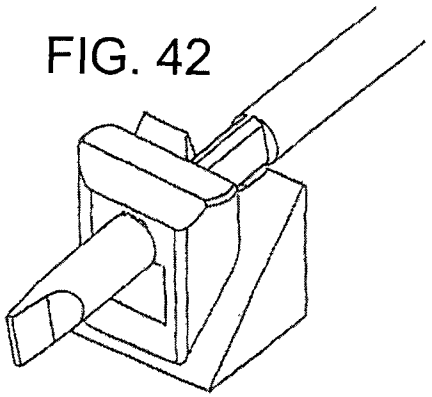
FIG. 42 is a perspective view of the assembly of FIGS. 31 through 36 with the ramp portion manually moved rearwardly lowering the movable blocking member to a blocking position also as portrayed in FIGS. 41A and 41B.
Figure 41A:
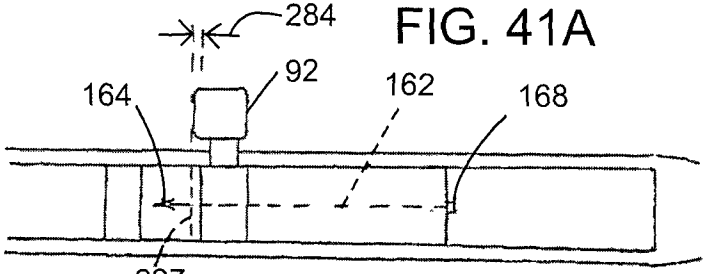
FIG. 41A is schematic plan view showing the position of the firing pin with respect to the bolt assembly with the manual handle and carriage being moved rearwardly with respect to the bolt body.
Figure 41B:
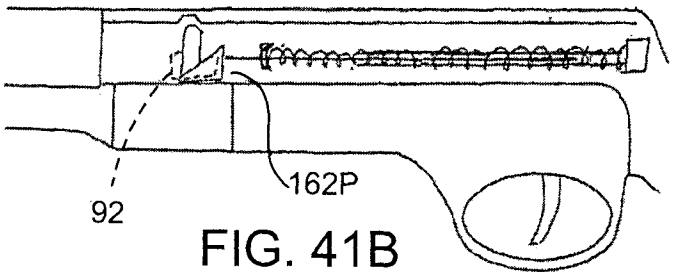
FIG. 41B is a schematic elevation view of the firing pin, movable member, and carrier, with respect to the position of FIG. 41A.
Figure 45:
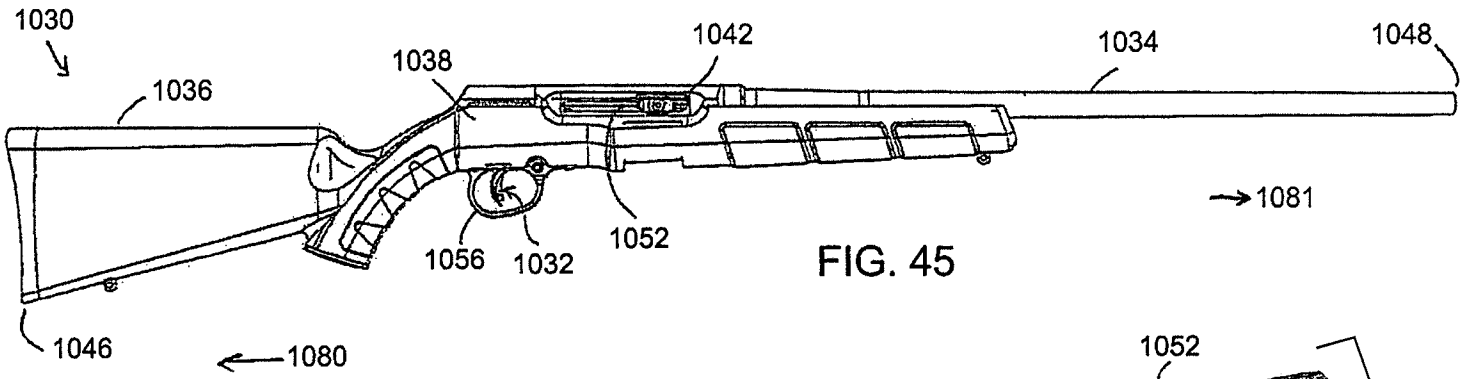
FIG. 45 is a side elevational view of a firearm in an embodiment of the disclosure.

Referring to FIGS. 15, 41A, 41B, 42, and 43, use of the manual handle 92 when the bolt assembly is in the in-battery position is illustrated. In that there is forward and backward clearance between the movable blocking member carrier 159 and the slot 148 in the bolt body 82, the engagement of the cooperation between the blocking member 94 and the ramp portion may be manually effected. With the bolt assembly in the in-battery position, as illustrated in FIGS. 17 and 31, 37A, and 37B, the manual handle may be grasped and urged rearwardly against the force of the recoil spring which is directly connected to the handle and carrier assembly. Referring to FIG. 41, the manual handle may be moved from the original position 227, shown by the dashed line, to the position of the solid lines. In an embodiment, this can be accomplished without taking the bolt assembly out of the in-battery position. The clearance 284, see FIG. 41A, is sufficient such that the ramp portion may be moved from the position where the movable blocking member is extended and on the upper portion of the inclined surface to the position where the blocking member is on the lower portion of the inclined surface without moving the entire bolt assembly. The tip of the blocking member then is no longer engaged with the recess in the ceiling of the receiver. Additionally, with the lowering of the blocking member, the forward thinned or reduced diameter portion of the firing pin is captured in the narrow portion of the opening in the blocking member as illustrated in FIG. 42. Rearward movement of the handle may withdraw the cartridge from the chamber and with the firing pin locked as shown in FIG. 42, striking of the exposed rearward end 168 of the firing pin by the hammer will restrict the forward motion of the firing pin to that shown in FIG. 42 which is insufficient for the firing pin to reach the headspace where the cartridge is seated in the bolt body. Continued rearward movement of the handle with take the bolt position to that as illustrated in FIGS. 24A and 24B, where, if a cartridge is in the bolt face, the cartridge can be ejected by the ejector 124, shown in FIG. 4. A cartridge in the magazine will be loaded as the bolt returns to the in-battery position. This sequence is utilized for loading the first cartridge from the magazine.

Figure 44:
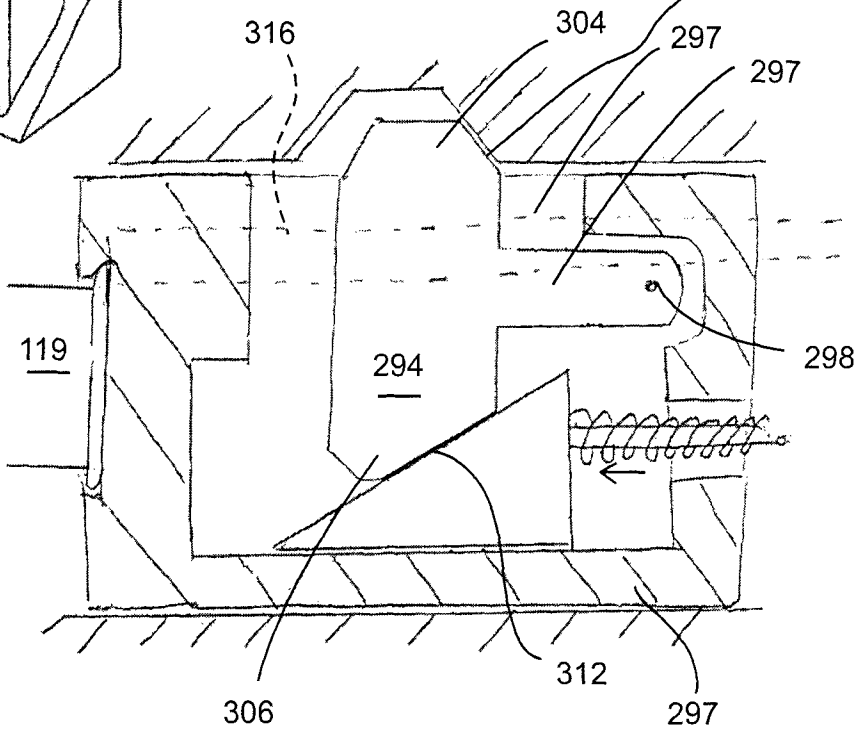
FIG. 44 is a side elevational view of an embodiment where the movable blocking member is attached to the bolt body at a pivot point.

Referring to FIG. 44, an embodiment is illustrated in which a movable member 294 has a pivot arm 296 and is pivotally connected to the bolt body 297 at a pivot point 298. The movable member has opposing ends 304, 304, with sliding engagement surfaces 310, 312. The movable member may have a recess or opening, not shown, for the firing pin 316 shown by dashed lines. Rather than floating within the bolt body, this embodiment has the member attached thereto. The motion is in an arc rather than the linear movement of the floating embodiment. In other embodiments, the configuration of FIGS. 18 and 19 could utilize a pivotally connected movable member as well and the spring bias, could be between the pivot arm and bolt body, or could be attached to other structure.

Firearms with delayed blowback mechanisms are known and firearms with firing pin blocks are known. See for example U.S. Pat. Nos. 4,344,246; 1,737,974; 1,410,270; 6,782791; 3,857,325; 2,975,680; and 5,666,754. These patents are incorporated by reference for all purposes. Aspects of the instant application will be suitable for incorporation in known mechanisms.

Referring to FIGS. 45-60, a firearm 1030 generally comprises a trigger assembly 1032, a barrel 1034 mounted in a stock 1036 and connecting to a receiver 1037. A firearm housing 1038 formed of the receiver 1037 and stock in this embodiment, engages and extends rearwardly from the barrel 1034 and houses a breech 1042 and the trigger assembly 1032. The breech 1042 is above and forward of the trigger assembly 1032 and rearwardly of the barrel. The barrel 1034 has a body portion with a smaller outer diameter male threaded portion 1040 defining a firing chamber 1041 concentric about a barrel axis 1043, the male threaded portion 1040 threadably engaging with a female threaded portion 1042 of the receiver 1037. In one embodiment, the chamber is configured for necked cartridges, such as the 0.17 HSR and 0.17 WSM. A locking nut 1044 can threadably engage a larger outer diameter threaded portion 1046 of the barrel and tighten against the forward end 1048 of the receiver 1037.

A bolt assembly 1052 is slidingly engaged within the receiver 1037 and includes a cartridge retraction mechanism 1051, and a manual handle 1056. A cycling spring assembly 1055 connects between the bolt assembly and the rearward end 1057 of the trigger assembly. A trigger guard 1056 extends from the housing 1038.

Figure 49A:
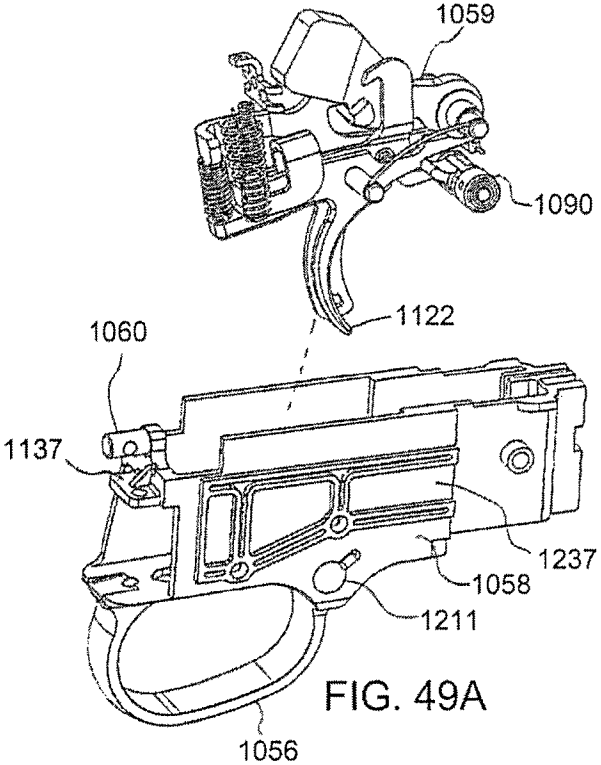
FIG. 49A is an exploded view of the trigger assembly of FIG. 47 with trigger component cluster depicted as removed from a trigger mechanism housing.

The trigger assembly 1032 is depicted in detail and various views throughout the figures. The trigger assembly 1032 is housed within the firearm housing 1038 comprising primarily the stock 1036. The trigger assembly 1032 has a trigger mechanism housing 1058 which receives a trigger component cluster 1059 as best shown in FIG. 49A. The trigger component cluster 1059 are generally movable components and pivot about shafts that are supported by the firearm housing 1038. The cluster 1059 is depicted in various views without the housing 1038 for purposes of clarity. The firearm housing 1038 is advantageously formed from injection molding polymers and may have specific metal inserts therein for reinforcement, for example at the rearward projection 1060 that is inserted in a cooperating aperture 1061 in the rearward end of the receiver 1037.

Referring to FIGS. 49A-56, within the trigger mechanism housing 1058, the trigger component cluster 1059 generally includes a hammer 1082, a firing trigger component 1084, a safety trigger component 1086, an arrestor 1088, and a manual safety mechanism 1090. The hammer 1082 includes a head portion 1092 and a cam portion 1094 having separated by a stem portion 1096. The cam portion 1094 defines an aperture 1098 that is mounted to and rotates about a bushing 1100 and shaft 1101 to define a hammer pivot 1102 that actuates about a rotational axis 1104. In one embodiment, the cam portion 1094 further includes an arcuate cam surface 1105 and a sear engagement portion 1106, the sear engagement portion 1106 having a radially extending bearing face 1108. The cam portion 1094 can also define a flat 1110 that extends at an angle θ from the bearing face 1108. In one embodiment, the angle θ is an obtuse angle. The hammer 1082 is also coupled with a biasing element 1112 which, in some embodiments, is a rotational spring 1114 (FIGS. 55 and 58-66) that is rotated about and coupled to the hammer pivot 1102 with the free ends engaged, for example, with the trigger mechanism housing 1058. The hammer 1082 can also include a capture feature 1116. In various embodiments, the capture feature 1116 includes an engagement surface 1115. A squared loop 1117 in the rotational spring 1114 can provide space at the projection for engagement of the projection with the safety trigger component, discussed below.

As best seen in FIGS. 50, 51, 52, 53 and 56, the firing trigger component 1084 includes a finger hook portion 1122 and a sear portion 1124, the sear portion 1124 having a sear surface or cam engagement surface 1140 cooperating with and being configured to engage the sear engagement portion 1106 and cooperating surface 1108 of the hammer 1082. The firing trigger component 1084 can be mounted to a trigger pivot 1126 configured as a shaft or pin and defining a rotational axis 1128 and extending from the trigger mechanism housing 1058 along the rotational axis 1128. In some embodiments, the firing trigger component 1084 further defines a slot 1132 that extends into the finger hook portion 1122 and lies on a plane that is substantially perpendicular to the rotational axis 1128. The firing trigger component 1084 can also include an extended portion 1134 that is engaged with a firing trigger return spring 1136 that biases finger hook portion 1122 of the firing trigger component 1084 in the forward direction 1081. The return spring 1136 may be engaged with a ledge or flange portion 1137 of the trigger mechanism housing (FIGS. 48, 49A 49B, 50 and 52).

In some embodiments, the firing trigger component 1084 includes a cam engagement surface 1140 that engages the arcuate cam surface 1105 of the hammer 1082.

The safety trigger component 1086 can include a finger hook portion 1142 and can be pivotally mounted to the trigger pivot 1126. In various embodiments, the finger hook portion 1142 of the safety trigger component 1086 is a flat structure, formed from, for example, sheet or plate, that is disposed in the slot 1132 of the finger hook portion 1122 of the firing trigger component 1084. The finger hook portion 1122 of the safety trigger component 1086 can also include an aperture 1144. The aperture 1144 can be utilized for insertion of a pin or lock, effectively preventing movement of the trigger hook portion particularly with respect to the hook portion of the firing trigger component. As discussed further below, this prevents the firing trigger component 1084 from being actuated.

Figure 46:
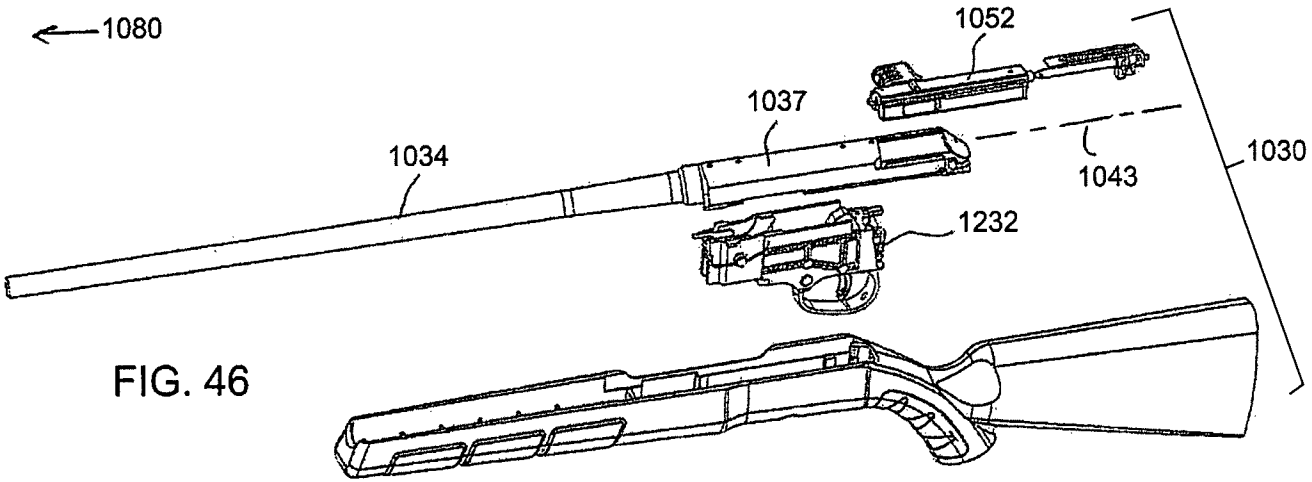
FIG. 46 is an exploded view of the firearm of FIG. 45.
Figure 47:
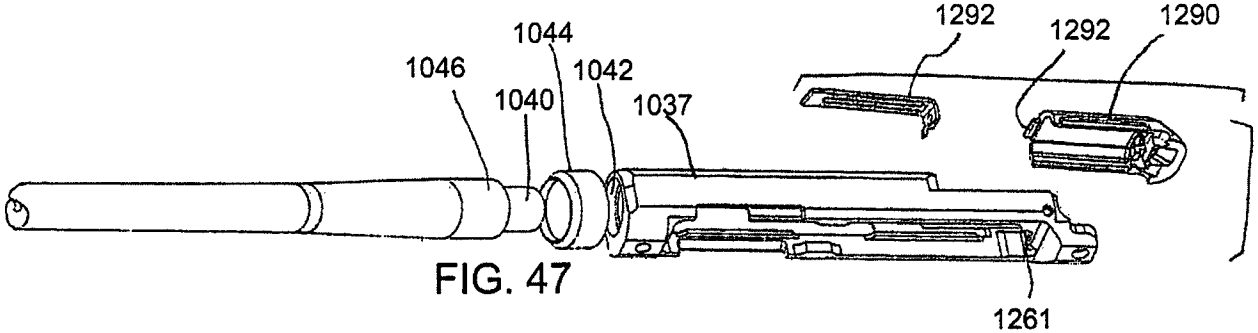
FIG. 47 is an exploded view of receiver and barrel of the firearm of FIG. 45.
Figure 48:
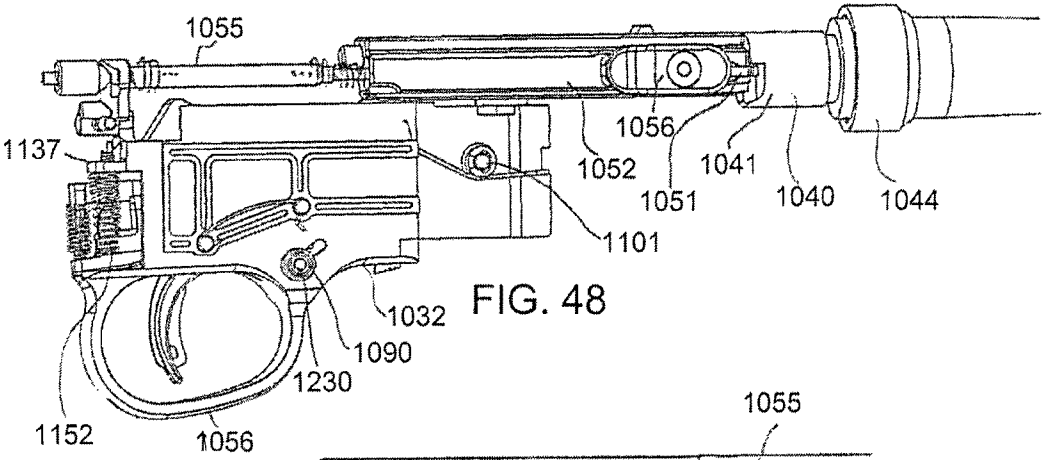
FIG. 48 is a detail view of the trigger assembly, bolt assembly, chamber, and barrel of a firearm with the receiver removed in an embodiment of the disclosure.

In one embodiment, the safety trigger component 1086 includes a catch portion 1146 that is laterally adjacent to the hammer 1082. The catch portion 1146 can resemble an inverted "J" shape, for example as depicted in FIGS. 46 and 47. The safety trigger component 1086 can also include an extended portion 1148 that is engaged with a safety trigger component return spring 1152. The return spring 1152 is attached to the ledge portion 1137 of the trigger mechanism housing configured as a ledge. In one embodiment, the extended portion 1148 of the safety trigger component 1086 includes an arm 1154 that extends out of the slot 1132 and wraps over and partially around the extended portion 1134 of the firing trigger component 1084, as best seen in FIGS. 49A 51, 52 and 53. A spring receiving member 1155 shaped as a projection receives the safety trigger return spring 1152.

Functionally, the safety trigger component return spring 1152 exerts a return force on the extended portion 1148 of the safety trigger component 1086 urging the finger hook portion 1142 of safety trigger component 1086 to be rotated to a full forward position within the slot 1132 of the firing trigger component 1084. In this unactuated or default orientation, the catch portion 1146 is positioned so that the catch portion 1146 is in a rotational path 1162 (FIG. 58) through which the capture feature 1116 of the hammer 1082 travels during firing and obstructs the hammer 1082. Accordingly, the catch portion 1146 intercepts the capture feature 1116 of the hammer 1082 if the catch portion 1146 of safety trigger component 1086 has not first been rotated out of the rotational path 1162. Hence, the safety trigger component 1086 provides an additional safety mechanism that helps prevent discharge of the firearm 1030 in the event of an unintentional release of the hammer 1082—for example, during an impact event where the weapon becomes jarred to the extent that the sear portion 1124 of the firing trigger component 1084 slips off the sear engagement portion 1106 of the hammer 1082.

During such an impact event, the safety trigger component 1086 may undergo rotational displacement that is commensurate with the rotational displacement of the firing trigger component 1084. However, in various embodiments, the rotational displacement required to rotate the catch portion 1146 out of the rotational path 1162 of the capture feature 1116 of the hammer 1082 is substantially greater than the rotational displacement required for the sear portion 1124 of firing trigger component 1084 to disengage the sear engagement portion 1106 of the hammer 1082 (see discussion below). Accordingly, the safety trigger component 1086 will generally still perform the function of intercepting the hammer 1082 even if the safety trigger component 1086 undergoes the same or even somewhat more rotational displacement than the firing trigger component 1084 in an impact event.

In the depicted embodiments, the capture feature 1116 is a lateral projection that extends laterally outward from the hammer 1082 in a direction parallel to the rotational axis 1104, for capture by the inverted "J" or other concavity defined by the catch portion 1146. In other embodiments, the capture feature 1116 can comprise a notch formed in the hammer 1082, and the catch portion 1146 can include a projection that is captured within the notch (not depicted).

Figure 57:
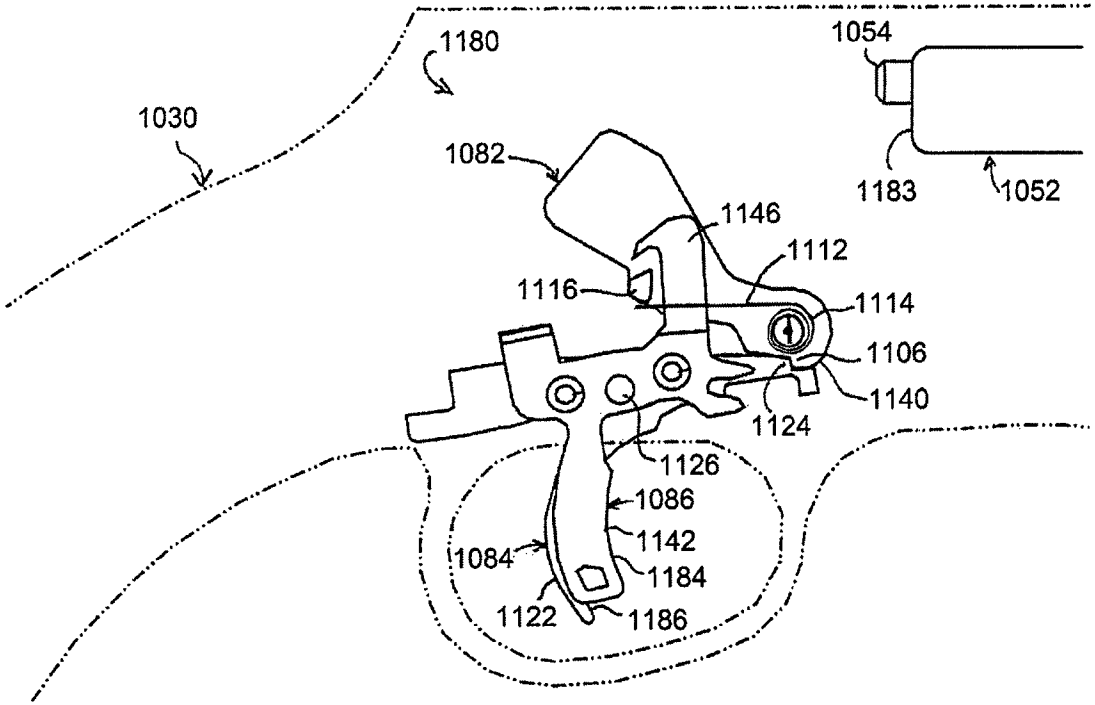
FIG. 57 is a side elevation schematic view of trigger assembly components in a battery position, illustrating a cocked configuration of a firing sequence, where a firing trigger and a safety trigger are in a battery position in an embodiment of the disclosure.
Figure 58:
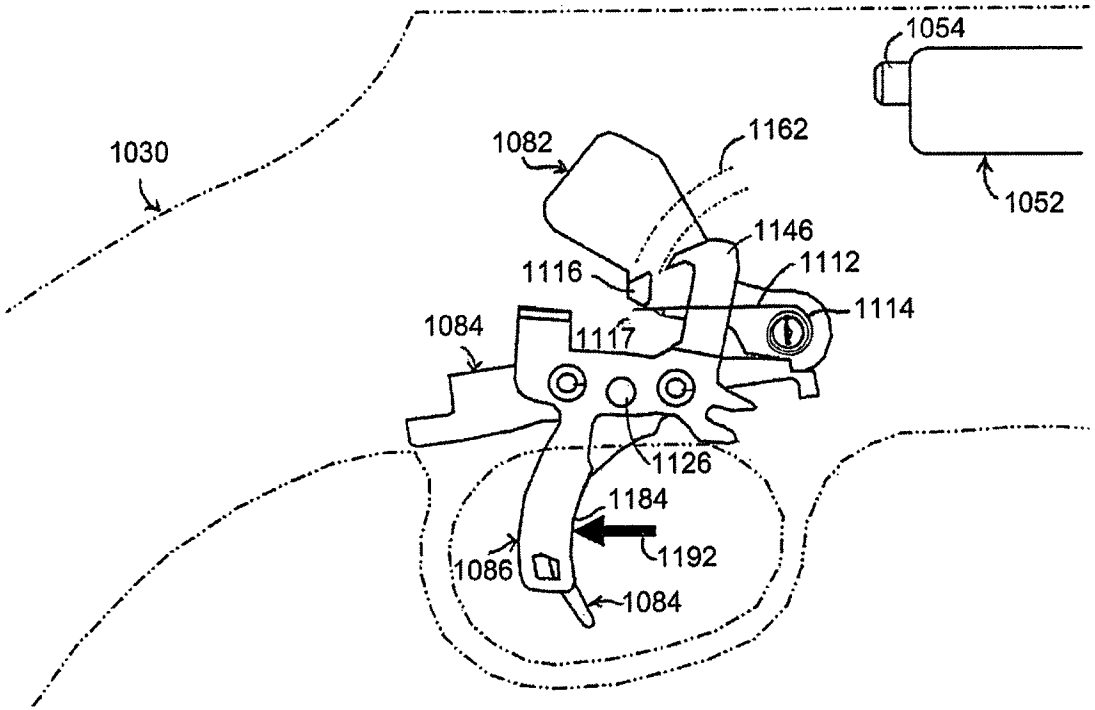
FIG. 58 is the trigger assembly components of FIG. 57 in an enabled configuration of a firing sequence, where the firing trigger is in a battery position and the safety trigger rotated out of the battery position in an embodiment of the disclosure.
Figure 59:
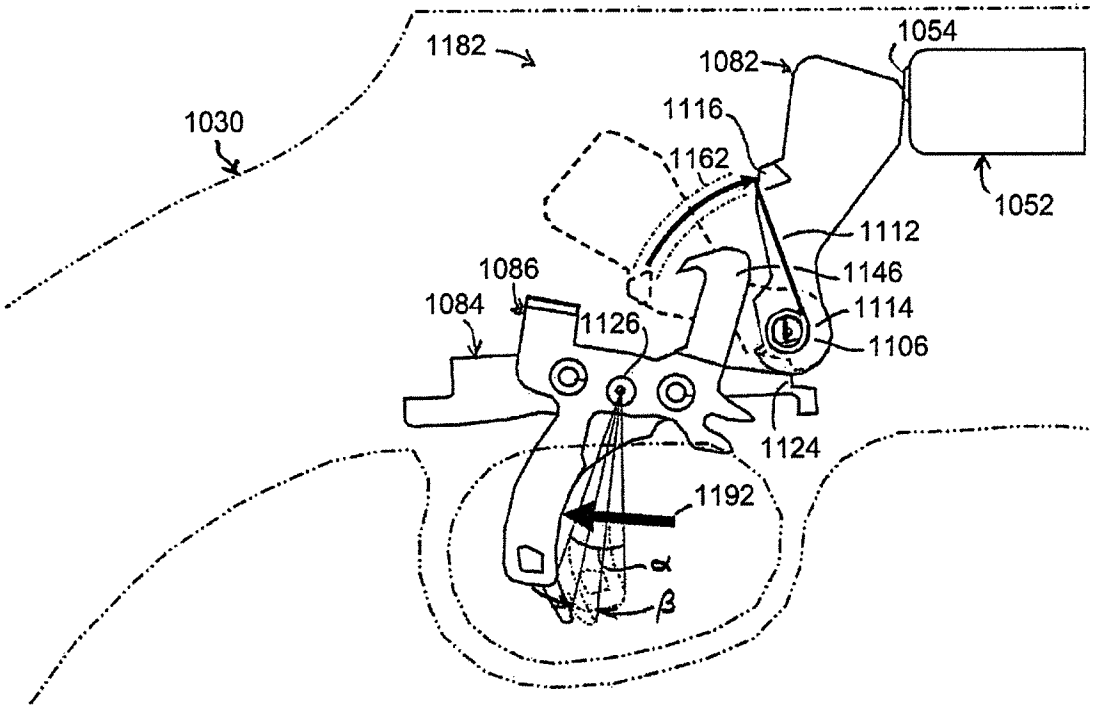
FIG. 59 is the trigger assembly components of FIG. 57 in a fired configuration of a firing sequence, where the safety trigger and the firing trigger are in a firing position in an embodiment of the disclosure.

Referring to FIGS. 57 through 59, an operation sequence of the hammer 1082, the firing trigger component 1084, the safety trigger component 1086, and the bolt assembly 1052 from a fully cocked configuration 1180 to a triggered configuration 1182 is depicted in one embodiment of the disclosure. The FIGS. 57-60 depict the hammer 1082, firing trigger component 1084, and safety trigger component 1086 at a mid-plane of the slot 1132, with various appurtenances removed for clarity of illustration.

Figure 50:
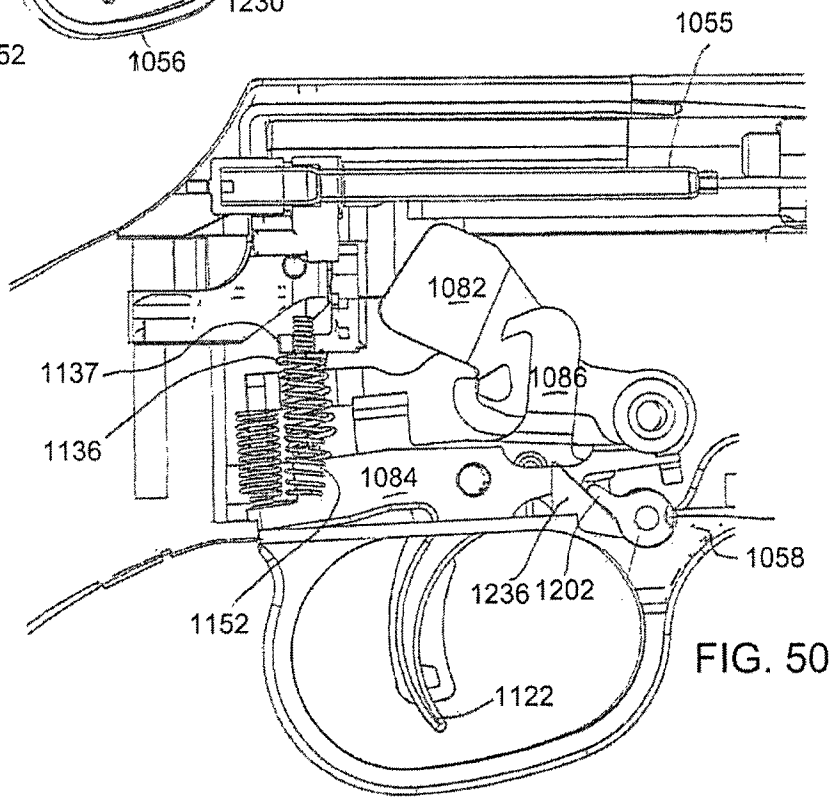
FIG. 50 is an elevational view of a firearm with the stock and trigger assembly housing removed in an embodiment of the disclosure.
Figure 49B:
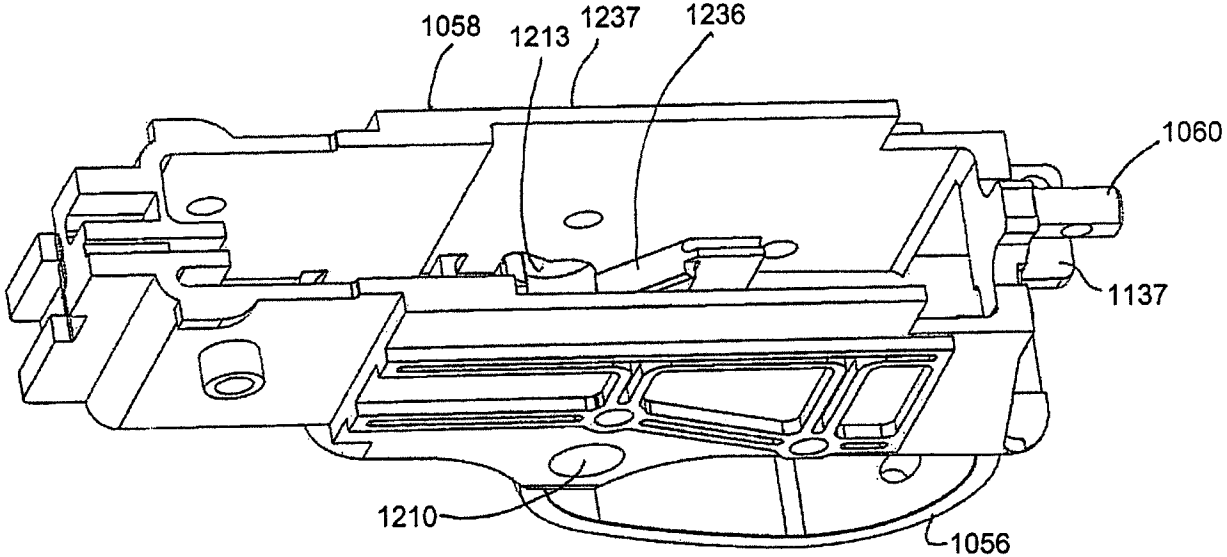
FIG. 49B is a top perspective view illustrating the interior of the trigger mechanism housing of FIG. 49A.
Figure 51:
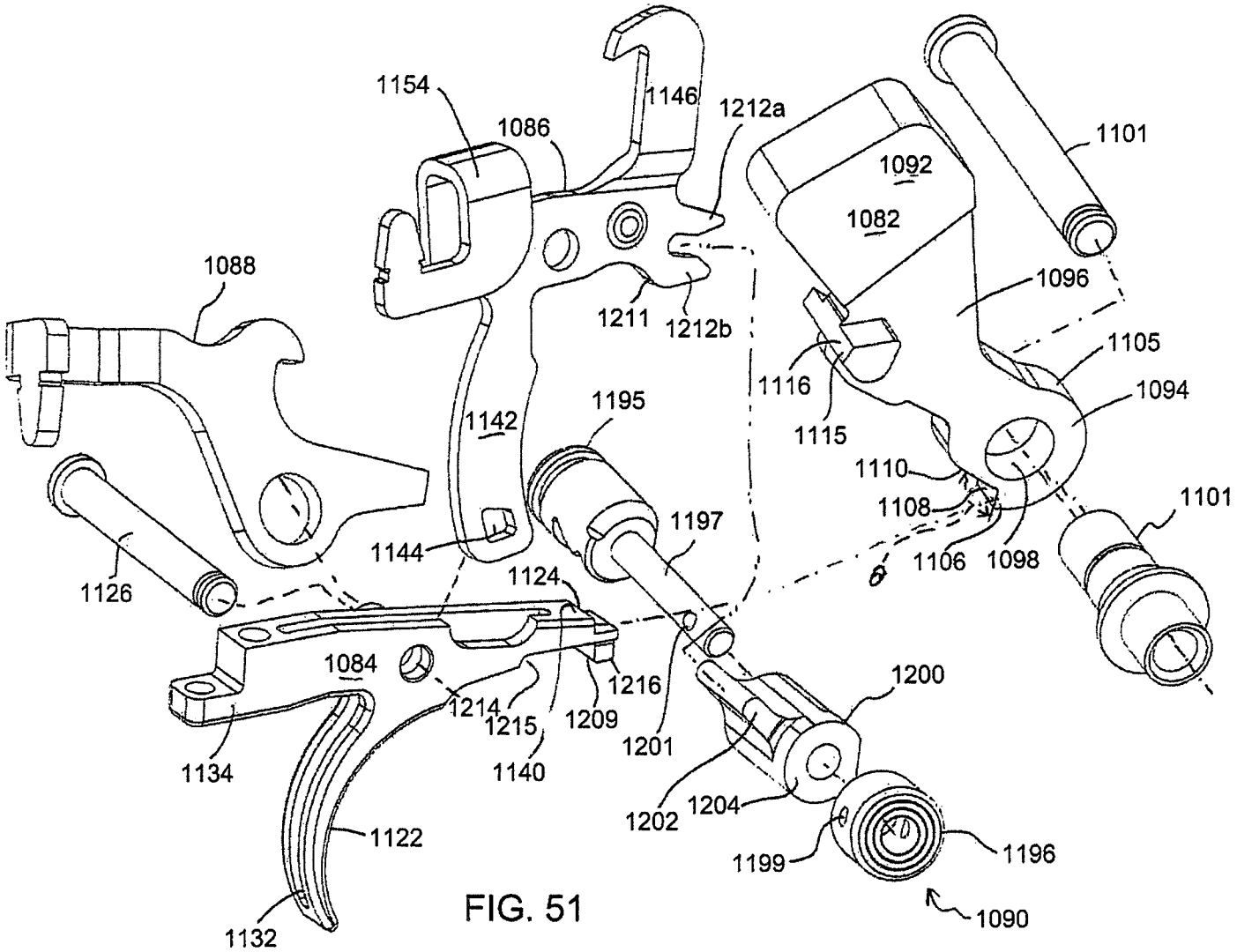
FIG. 51 is an exploded view of principal components of the trigger assembly in an embodiment of the disclosure.
Figure 52:
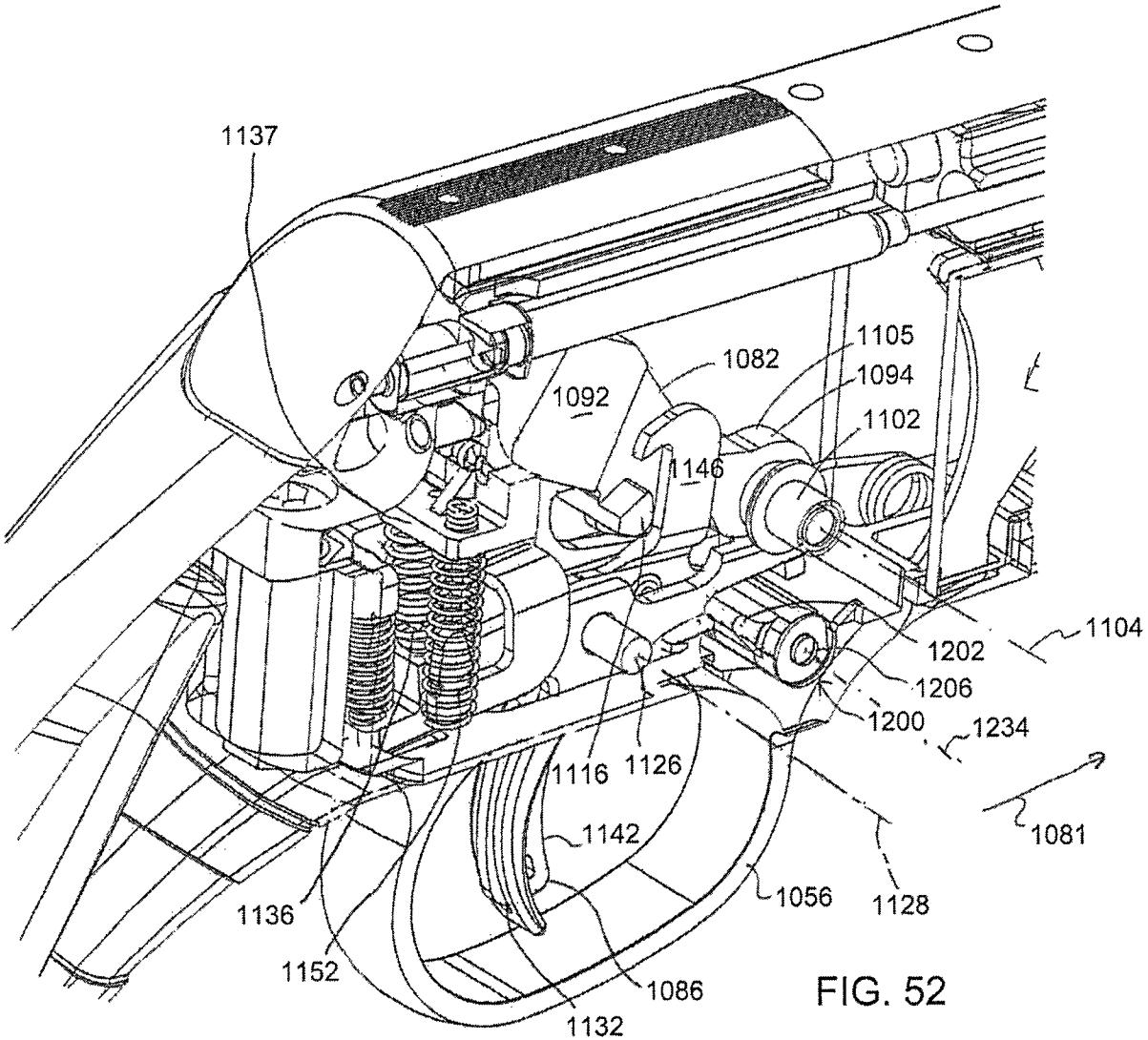
FIG. 52 is a rear cutaway perspective view of the stock and trigger assembly of FIG. 50 with portions of the stock and trigger mechanism housing removed for illustration.
Figure 53:
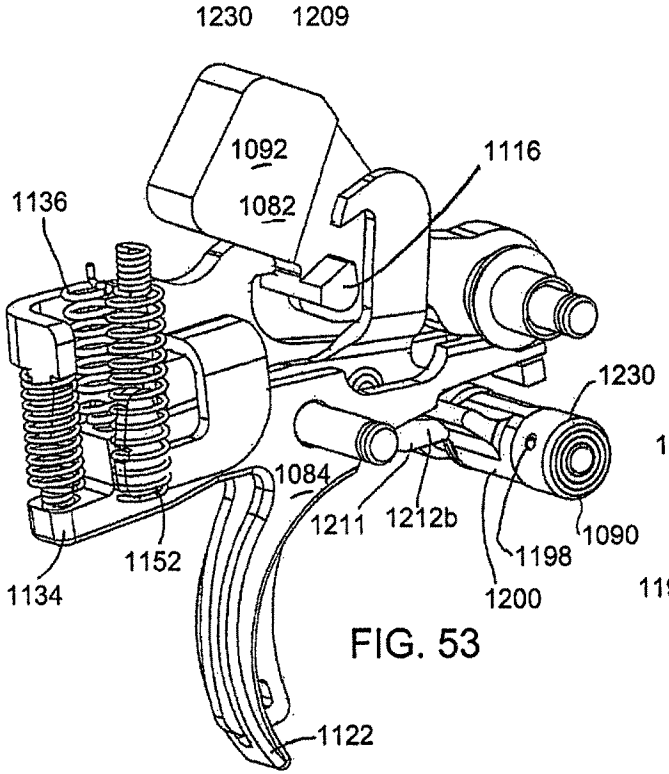
FIG. 53 is a forward looking right side perspective view of the principal components of the trigger assembly of FIG. 50 in isolation.
Figure 55:
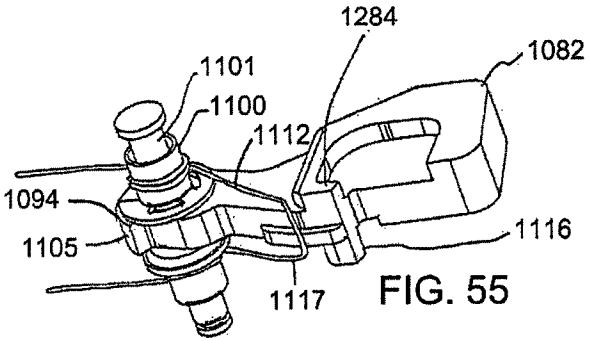
FIG. 55 is a upwardly looking perspective view of the hammer assembly in isolation with the hammer spring extended.

In the fully cocked or "battery" configuration 1180 (FIG. 57), the sear portion 1124 of the firing trigger component 1084 is in forced engagement with the sear engagement portion 1106 of the hammer 1082, the forced engagement being exerted by the biasing element 1112. The respective finger hook portions 1122 and 1142 of the firing trigger component 1084 and the safety trigger component 1086 are held in a forward most orientation by the respective return springs 1136 and 1152 (FIGS. 50, 52, 53). In the fully cocked configuration 1180, the bolt assembly 1052 is also in a firing position within the breech 1042, with a firing pin 1054 exposed and outwardly extending relative to a rearward end 1183 of the bolt assembly 1052. In one embodiment, the firing pin 1054 is substantially parallel to but offset from the barrel axis 1043 to facilitate firing of rimfire cartridges. Also in the fully cocked configuration 1180, a front edge 1184 of the safety trigger component finger hook portion 1142 extends distal to a front edge 1186 of the firing trigger component finger hook portion 1122.

An actuation force 1192 is applied to the front edge 1184 of the safety trigger component finger hook portion 1142 (FIG. 58), for example by a squeezing motion applied by a finger of a user. The actuation force 1192 causes the safety trigger component 1086 to rotate about the trigger pivot 1126, so that the catch portion 1146 is rotated out of the rotational path 1162 of the capture feature 1116, thereby clearing the hammer 1082 for an unobstructed rotation to the firing pin 1054. In the FIG. 58 depiction, the safety trigger component 1086 is progressing toward a firing position, while the firing trigger is in a battery position.

The actuation force 1192 then engages the firing trigger component 1084, thereby causing the firing trigger component 1084 and the safety trigger component 1086 to rotate effectively simultaneously about the trigger pivot 1126 and into firing positions. The rotation of the firing trigger component 1084 causes the sear portion 1124 to rotate away from the hammer 1082 and slide radially outward from the hammer pivot 1102 along the sear engagement portion 1106. When the sear portion 1124 slides off the sear engagement portion 1106, the hammer 1082 is released and swings into contact with the firing pin 1054, thereby establishing the triggered configuration 1182 where both the safety trigger component 86 and the firing trigger component 1084 are in a firing position (FIG. 59).

The positions of respective finger hook portions 1122 and 1142 of the firing trigger component 1084 and the safety trigger component 1086 for both the fully cocked configuration 1180 and the triggered configuration 1182 are presented in FIG. 59, with the positions from the fully cocked configuration 1180 being presented in phantom. Angular displacements a and ß of the safety trigger component 1086 and the firing trigger component 1086, respectively, are also overlaid onto FIG. 59. By this illustration and for this embodiment, the angular displacement a of the safety trigger component 1086 in transitioning from the fully cocked configuration to the triggered configuration is about three times greater than the angular displacement ß of the firing trigger component 1084. As such, the safety trigger component 1086 will generally still perform the function of intercepting the hammer even if the safety trigger component 1086 undergoes the same or even somewhat more rotational displacement than the firing trigger component 1084 in an impact event.

Figure 60:
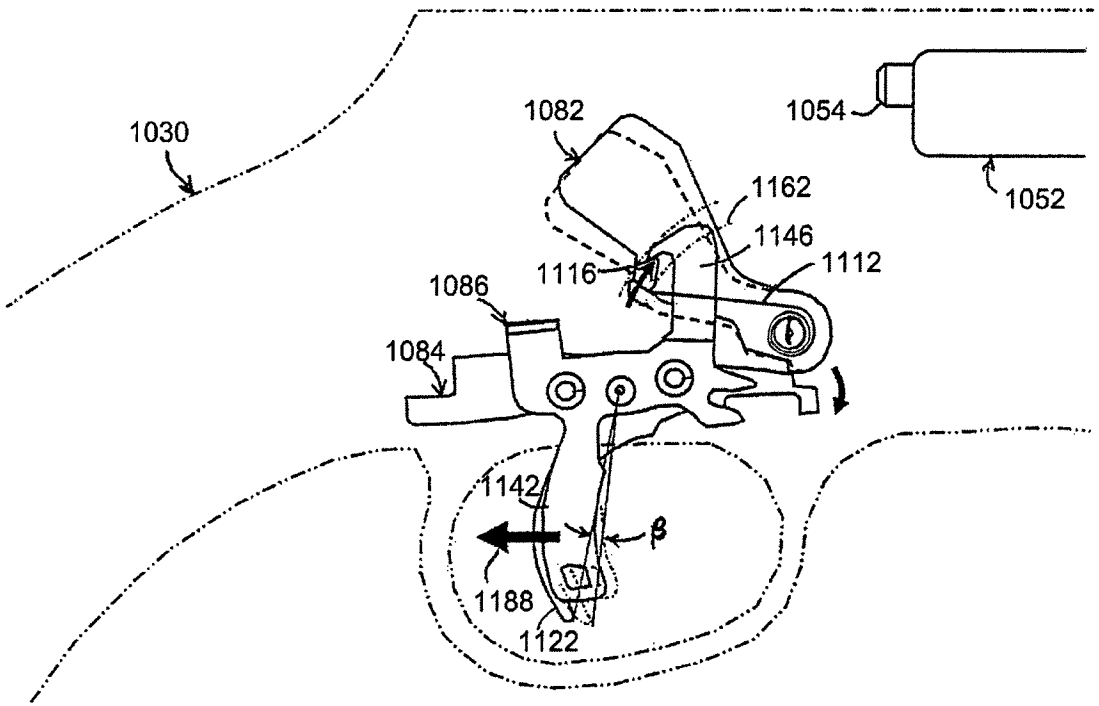
FIG. 60 is the trigger assembly components of FIG. 57 where a firing trigger and a safety trigger are in a battery position and the safety trigger catches the hammer to prevent firing in an embodiment of the disclosure.

Referring to FIG. 60, the functionality of the safety trigger component 1086 during an abnormality such as an impact event is further illustrated in an embodiment of the disclosure. Consider an impact event where inertial forces cause a dynamic load 1188 on the respective finger hook portions 1122 and 1142 of the firing trigger component 1084 and the safety trigger component 1086, such that both finger hook portions 1122 and 1142 are rotationally displaced by the angular displacement ß required to release the hammer 1082. At the angular displacement B, the catch portion 1146 is still operational within the rotational path 1162 of the capture feature 1116, and still functions to arrest the hammer 1082 and prevent discharge of the firearm 1030.

Referring again to FIGS. 48 through 54, and 56, the trigger assembly 1032 includes the manual safety mechanism 1090 conventionally positioned forward of the firing trigger. The safety mechanism 1090 includes a safety bar 1194 with exposed push buttons 1195, 1196 on each end, a shaft 1197 integral with one of the push buttons 1195, 1196 for aligning and securing the safety mechanism components together, and a rotatable blocking member 1200. A pin 1198 may extend through apertures 1199, 1201 in the shaft 1197 and end button 1196 to secure the manual safety mechanism 1090. The blocking member 1200 can include a lever portion 1202 that projects radially outward from an arcuate base portion 1204. The arcuate base portion 1204 rotates freely about a blocking member pivot 1206 defined by the shaft 1197. In one embodiment, a notch or recess 1208 is formed on the arcuate base portion 1204 to provide a non-blocking position for an engagement tab 1209 proximate the sear portion 1124 of the trigger component. The manual safety mechanism 1090 is laterally slidable within the trigger mechanism housing 1058 in apertures 1210, 1213 on opposing sides of the housing 1058.

The safety trigger component 1086 can include a fork 1211 comprising a pair of protrusions 1212*a* and 1212*b* that contact the blocking member 1200. The firing trigger component 1084 can include an underside 1214 against which the lever 1202 of the blocking member 1200 registers. In the depicted embodiment, the underside 1214 defines a recess 1215 within which the lever 1202 registers The firing trigger component 1084 can further include a projection 1216 that is proximate the arcuate base portion 1204 of the blocking member 1200.

Figure 61:
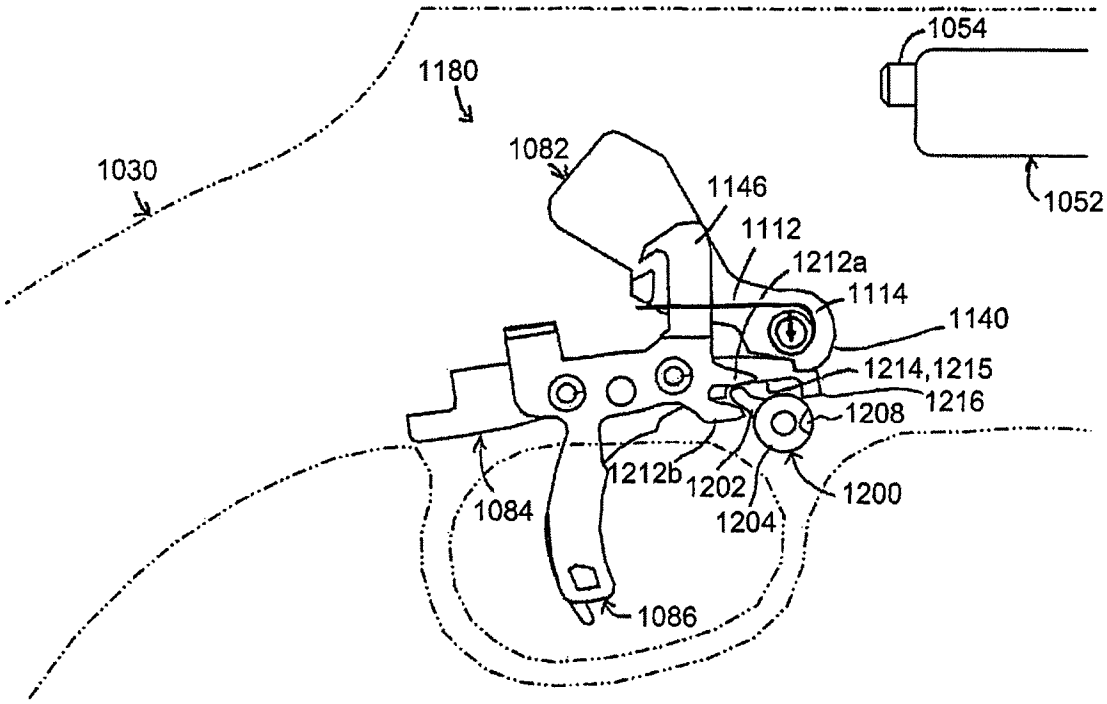
FIGS. 61-63 are a side elevation schematic views of the trigger assembly components and the operation of a blocking member during the firing sequence of FIGS. 57-59 in an embodiment of the disclosure.
Figure 62:
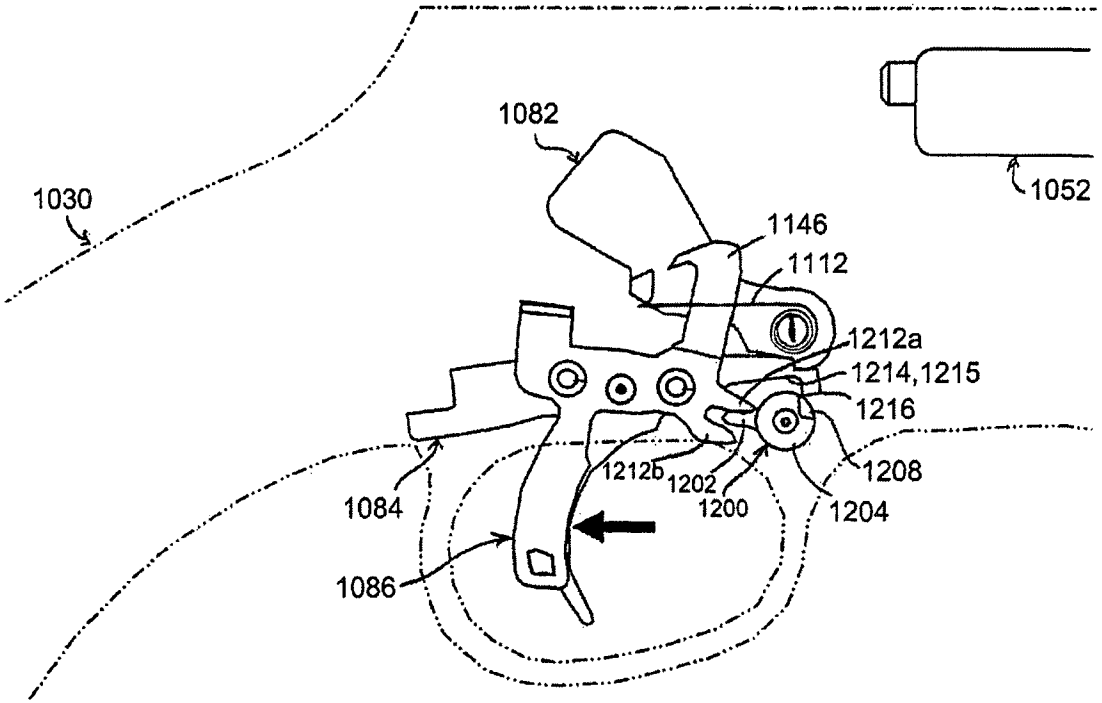
Figure 63:
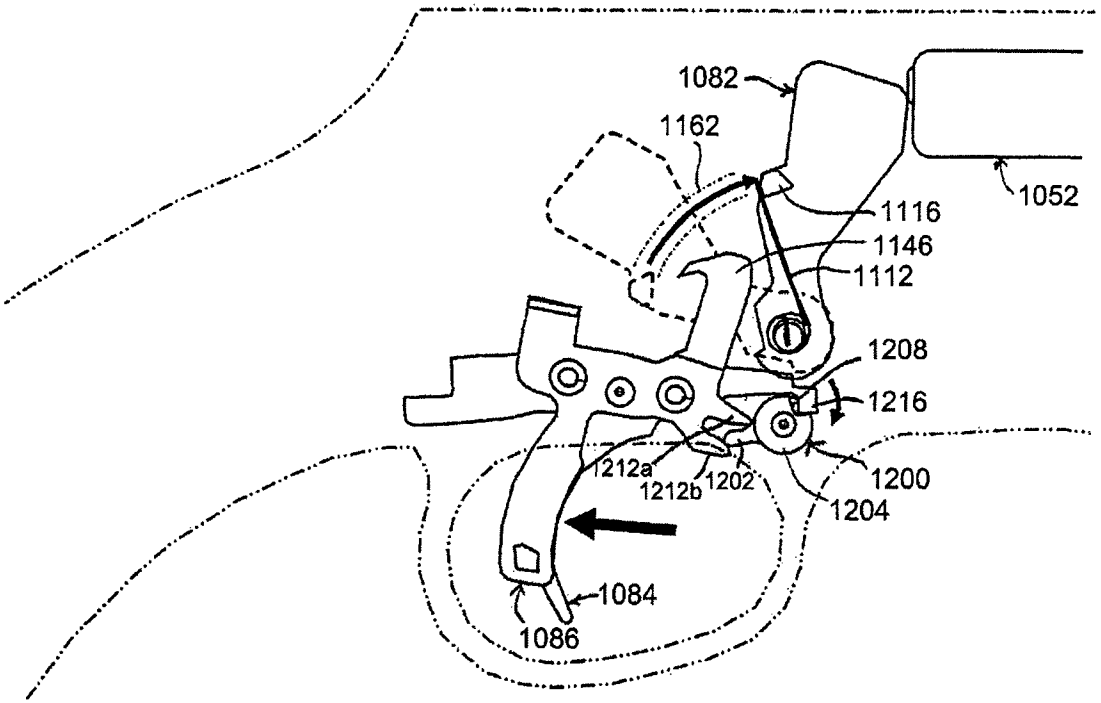

Referring to FIGS. 61 through 63, operation of the blocking member 1200 during discharge of the firearm 1030 is depicted in an embodiment of the disclosure. In the fully cocked configuration 1180 (FIG. 53), the lever portion 1202 of the blocking member 1200 extends between the protrusions 1212*a* and 1212*b* and is engaged or nearly engaged within the underside 1214 of the firing trigger component 1084. The protrusion 1212*b* of the safety trigger component 1086 maintains the blocking member 1200 in engagement/near engagement with the firing trigger component 1084, thereby preventing the firing trigger component 1084 from rotating away from the hammer 1082. Also in the fully cocked configuration 1180, the arcuate base portion 1204 of the blocking member 1200 can also interfere with the projection 1216 of the firing trigger component 1084, further preventing actuation of the firing trigger component 1084.

Figure 54:
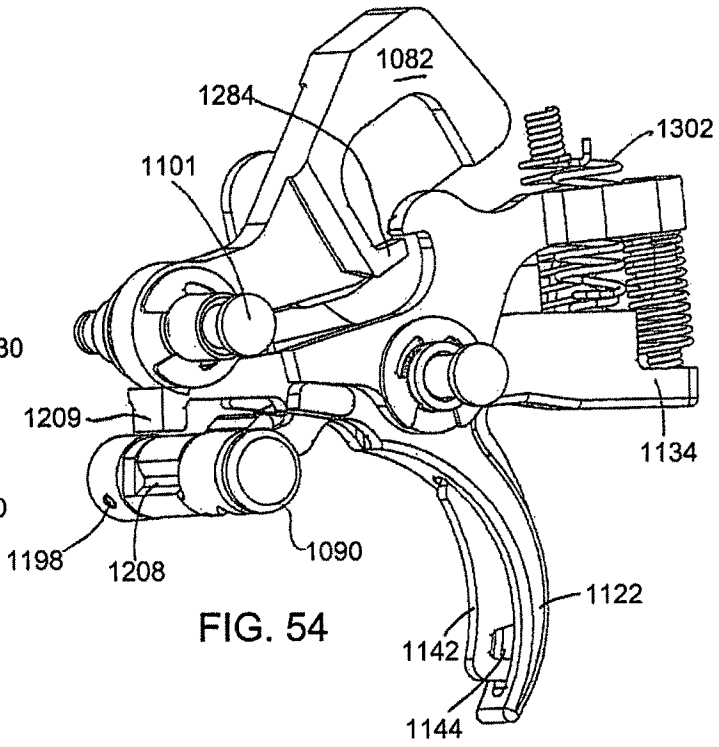
FIG. 54 is a rearwardly looking left side perspective view of the principal components of the trigger assembly of FIG. 50 in isolation.
Figure 56:
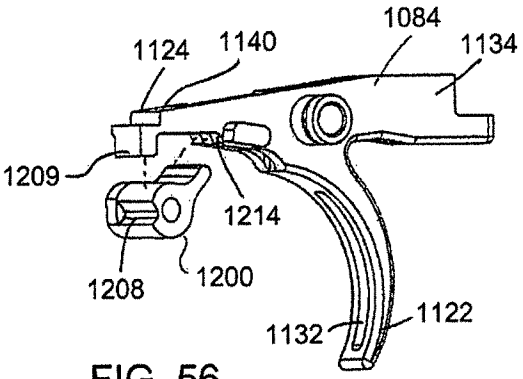
FIG. 56 is a perspective view of a hammer, a shaft, a bushing, and a rotational spring in assembly in an embodiment of the disclosure.

During actuation of the safety trigger component 1086, the protrusion 1212*a* rotates against blocking member 1200, causing the lever portion 1202 to rotate away from the underside 1214 of the firing trigger component 1084. The rotation of the blocking member 1200 also causes the recess 1208 of the arcuate base portion 1204 to rotate into alignment with the projection 1216 of the firing trigger component 1084 (FIG. 54). During continued actuation of the safety trigger component 1086 and subsequent actuation of the firing trigger component 1084, the lever portion 1202 has now been removed as an obstacle to rotation of the firing trigger component 1084 (FIG. 55), and the recess 1208 now accommodates the projection 1216 of the firing trigger component.

Accordingly, when the firearm 1030 is in the fully cocked configuration, the safety trigger component 1086 controls the orientation of the blocking member 1200. As the safety trigger component 1086 is actuated, the blocking member 1200 is oriented so as not to pose an obstruction to the firing trigger component 1084, freeing the firing trigger component 1084 for rotation away from the hammer 1082 and subsequent discharge of the firearm 1030.

Functionally, in the fully cocked configuration 1180, if an actuation force or "pull" is exerted on the firing trigger component 1084 but somehow not exerted on the safety trigger component 1086, the blocking member 1200 will maintain engagement with the firing trigger component 1084, thereby preventing rotation of the firing trigger component 1084 and subsequent discharge of the firearm 1030. Thus, in one embodiment, the blocking member 1200 can provide a redundant or additional safety mechanism against accidental discharge of the firearm 1030. Instead of relying solely on the friction between the sear portion 1124 and the sear engagement portion 1106, the blocking member 1200 provides a positive blocking force that helps prevent disengagement of the sear and the sear engagement portions 1124 and 1106 in an impact event. Moreover, the lever portion 1202 engaging the recess in the trigger component prevents the pivoting of the component about the pivot. In some embodiments, the blocking member 1200 can be the sole safety mechanism; that is, the blocking member 1200 is utilized without the catch portion 1146 instead of in addition to the catch portion 1146.

Figure 64:
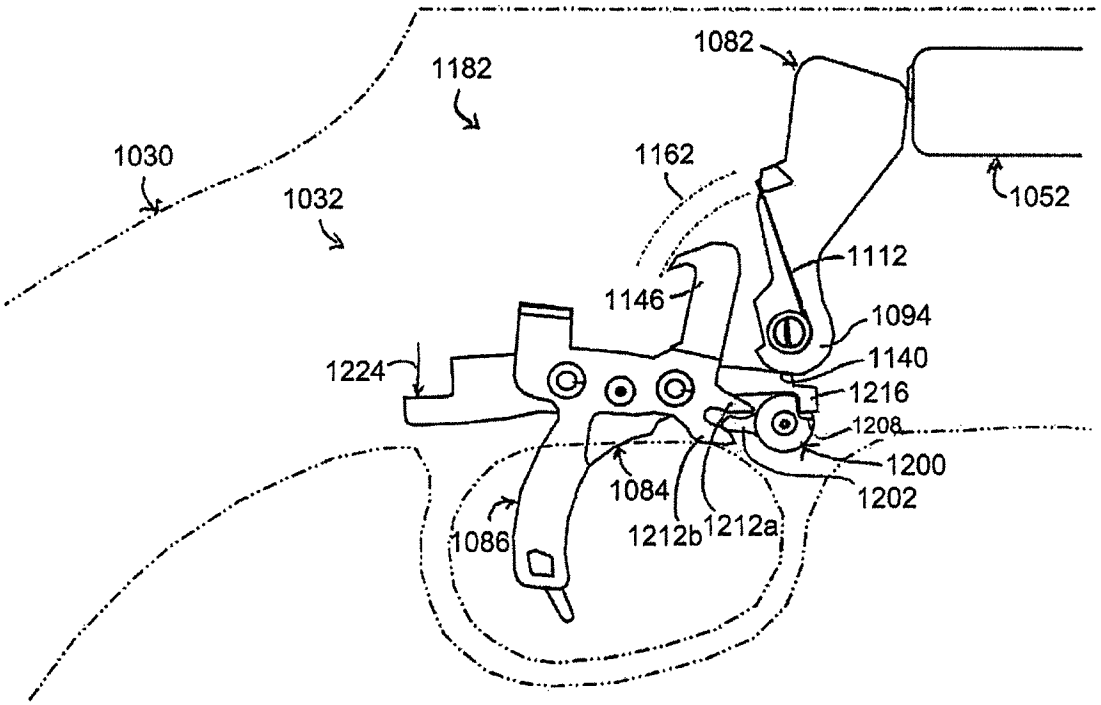
FIGS. 64-66 are side elevational schematic views of the trigger assembly components during a cocking sequence to restore the trigger assembly from the triggered configuration to the fully cocked configuration in an embodiment of the disclosure.
Figure 65:
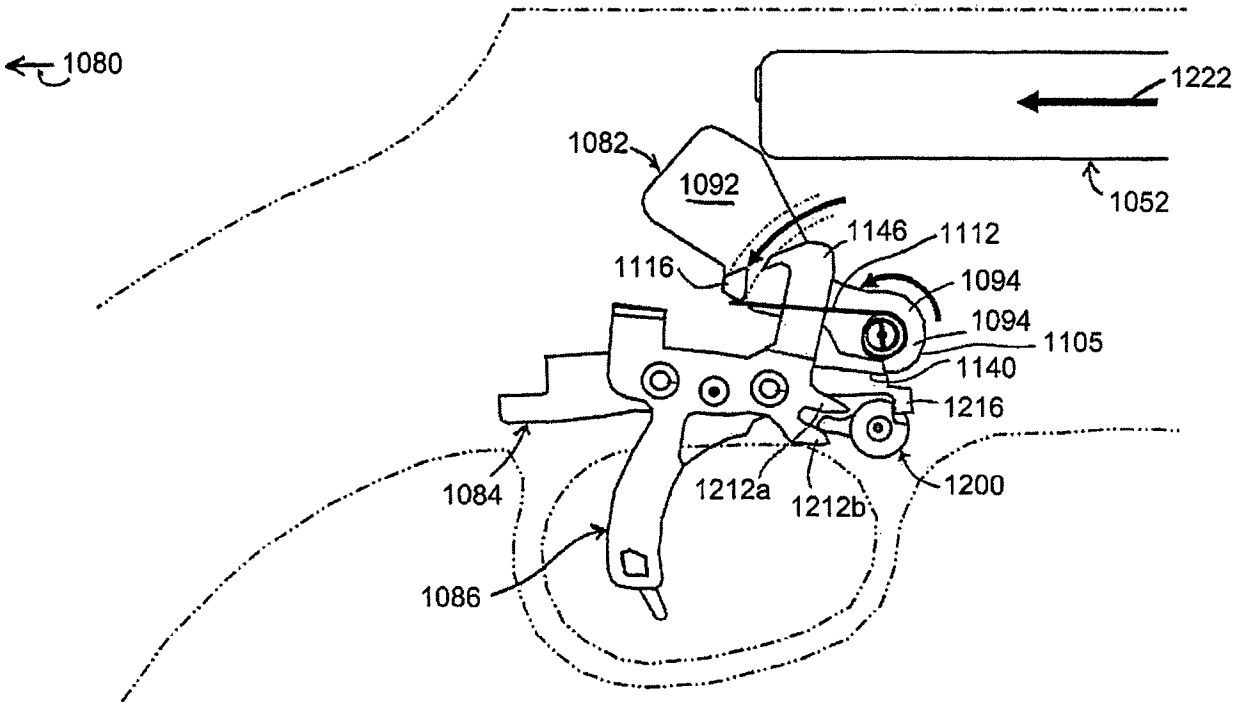
Figure 66:
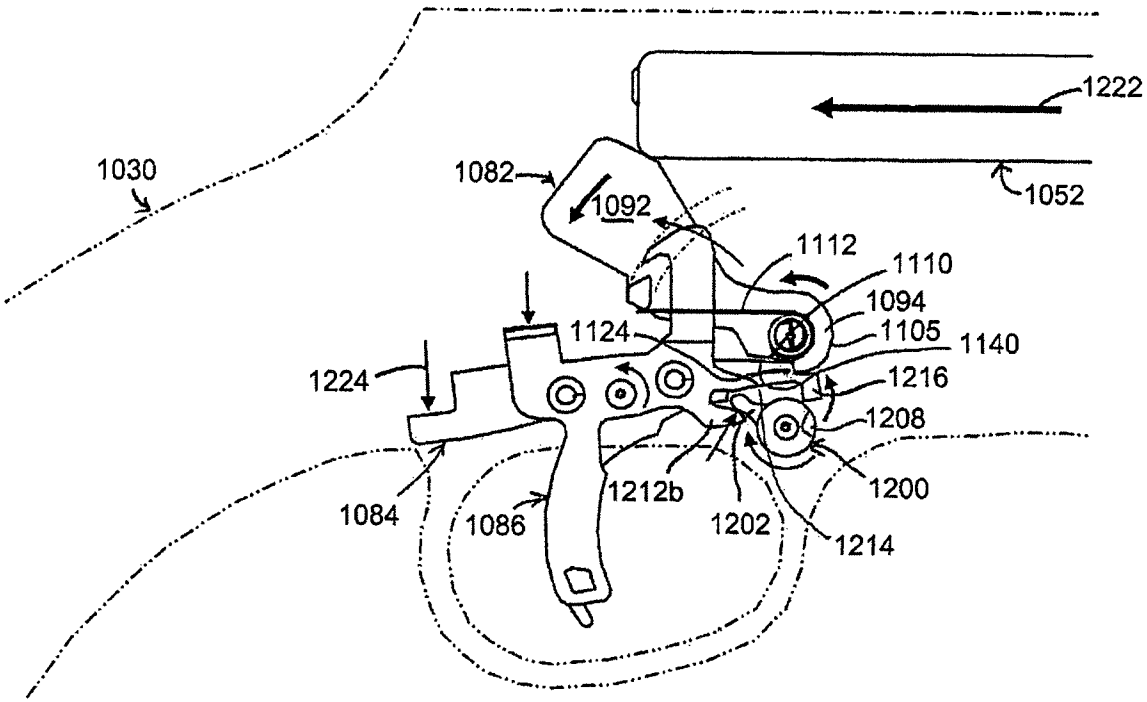

Referring to FIGS. 64 through 66, restoring the trigger assembly 1032 from the triggered configuration 1182 to the fully cocked configuration 1180 (referred to herein as "cocking") is depicted in an embodiment of the disclosure. After discharge of the firearm 1030, the projection 1216 of the firing trigger component 1084 is seated in the recess 1208, held in place by the cam portion 1094 of the hammer 1082 (FIG. 64). The seating of the projection 1216 in the recess 1208 prevents rotation of the blocking member 1200; that is, in the triggered configuration 1182, the orientation of the blocking member 1200 is not controlled by the safety trigger component 1086 (as is the case in the fully cocked configuration 1180), but instead is controlled by the firing trigger component 1084 and hammer 1082. Accordingly, the blocking member 1200 now acts against protrusion 1212*b* to hold the safety trigger component 1086 in a pitched orientation, wherein the catch portion 1146 is rotated away from the rotational path 1162 of the capture feature 1116.

The bolt assembly 1052 is motivated in the forward direction 1080 by a force 1222, imparted, for example, manually by a gunman or by a blow back mechanism. This motivation causes the bolt assembly 1052 to rotate the head portion 1092 of the hammer 1082 in the forward direction 80, which further causes the cam portion 94 to rotate on the cam engagement surface 1140. The cam engagement surface 1140 is maintained in contact with the cam portion 1094 by a return force 1224 imparted on the firing trigger component 1084 by the firing trigger return spring 1136.

As the head portion 1092 of the hammer 1082 is rotated in the forward direction 1080, the capture feature 1116 is rotated below the hook of the catch portion 1146 (FIG. 57), while the cam portion 1094 of the hammer 1082 maintains the interlock between the firing trigger component 1084 and safety bar 1200 (and therefore the pitched orientation of the safety trigger component 1086).

At some point after the capture feature 1116 of the hammer 1082 is rotated below the hook of the catch portion 1146, the arcuate cam surface 1105 of the cam portion 1094 rotates off the cam engagement surface 1140 (FIG. 58). At this point, the arcuate cam surface 1105 of the cam portion 1094 releases the firing trigger component 1084. The firing trigger component 1084, motivated by the return force 1224 generated by the firing trigger return spring 1136, then rotates (counterclockwise in FIG. 58) so that the cam engagement surface 1140 is brought into contact with the flat 1110 of the cam portion 1094; the sear portion 1124 of the firing trigger component 1084 is brought adjacent to the sear engagement portion 1106 of the hammer 1082. The release of the firing trigger component 1084 by the arcuate cam surface 1105 also causes the projection 1216 of the firing trigger component 1084 to become unseated from recess 1208 of the blocking member 1200. Control of the orientation of the blocking member 1200 is thereby transferred to the safety trigger component 1086, which, propelled by the return force 1224, rotates the blocking member 1200 (clockwise in FIG. 66) into the underside 1214 of the firing trigger component 1084.

Upon withdrawal of the bolt assembly from contact with the hammer 1082 and into the firing position, the fully cocked configuration 1180 of the firearm 1030 is restored (e.g., FIG. 61), with the blocking member 1200 preventing actuation of the firing trigger component 1084 that is independent of actuation of the safety trigger component 1086, and the catch portion 1146 poised to intercept the hammer 1082 in case of unintentional release of the hammer 1082.

In one embodiment, and again in reference to FIGS. 48 through 54 and 56, the blocking member 1200 is part of a manual safety mechanism 1230 that can be translated with the blocking member 1200 laterally within the trigger mechanism housing 1058 along a blocking member axis 1234. When part of the manual safety mechanism 1230, the lever 1202 of the blocking member 1200 can be selectively engaged with a stop 1236 (best seen in FIGS. 49B and 50) that extends from the interior surface 1044 of the trigger mechanism housing 1058 along the right side wall 1237 of the trigger mechanism housing 1058. In the embodiment illustrated, when the manual safety mechanism 1230 is pushed in one direction (e.g., to the right in the depicted embodiments), the firearm 1030 is configured in a "safety mode," wherein the blocking member lever 1202 is prevented from rotating out of the blocking position by the ramp or stop 1236.

When the manual safety mechanism 1230 is pushed in an opposite direction (e.g., to the left in the depicted embodiments), the firearm is configured in a "firing mode," wherein release of the sear portion 1084 of the firing trigger component 1084 from the sear engagement portion 1106 of the hammer 1082 is enabled. In the firing mode, the lever portion 1202 is displaced off of the stop 1236, enabling rotation by the fork 1211 of the safety trigger component 1086 and rotation the lever portion 1202 out of the blocking position with the underside 1214 of the firing trigger component 1084. The lever 1202 can be sized widthwise such that, during lateral movement of the blocking member 1200, the lever maintains engagement of the safety trigger fork 1211. Also, the lever 1202, when engaged with the underside 1214 on the lower side of the firing trigger component 84, can maintain blockage and/or engagement with the underside 1214 during lateral actuation. Engagement with the underside 1214 is lost only upon the rotation of the blocking member 1200.

It is further noted that aspects of the embodiments depicted in FIGS. 61 through 66 may be suited for automatic operation. (Herein, "automatic operation" is characterized as the continuous, round after round discharge of ammunition as long as the firing trigger component 1084 is depressed.) For the embodiments of FIGS. 61 through 66, as long as the triggers 1084 and 1086 are held in the firing position (depicted in FIG. 63), the sear portion 1124 of the firing trigger component 1084 will not be brought into engagement with the sear engagement portion 1106 of the hammer 1082, and the catch portion 1146 will not obstruct the hammer 1082 in either rotational direction. Accordingly, certain aspects of the embodiment of FIGS. 51 through 58 can be utilized in an automatic firearm.

Figure 67:
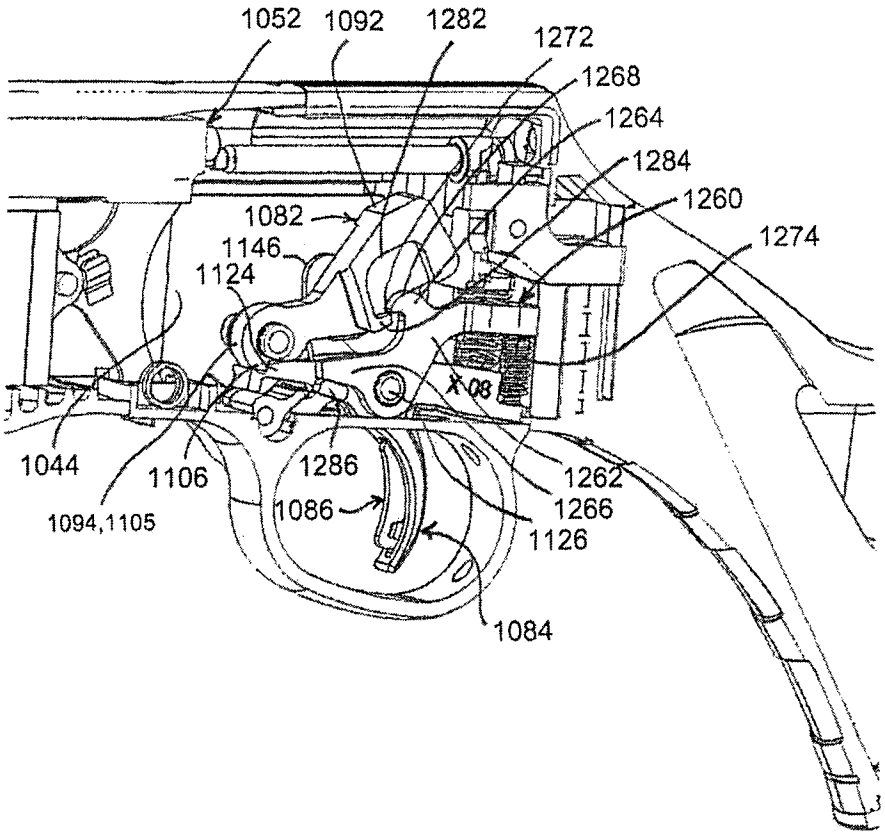
FIG. 67 is a reverse front perspective view of the trigger assembly components and illustrating the arresting mechanism that facilitates semi-automatic operation in an embodiment of the disclosure.
Figure 68:
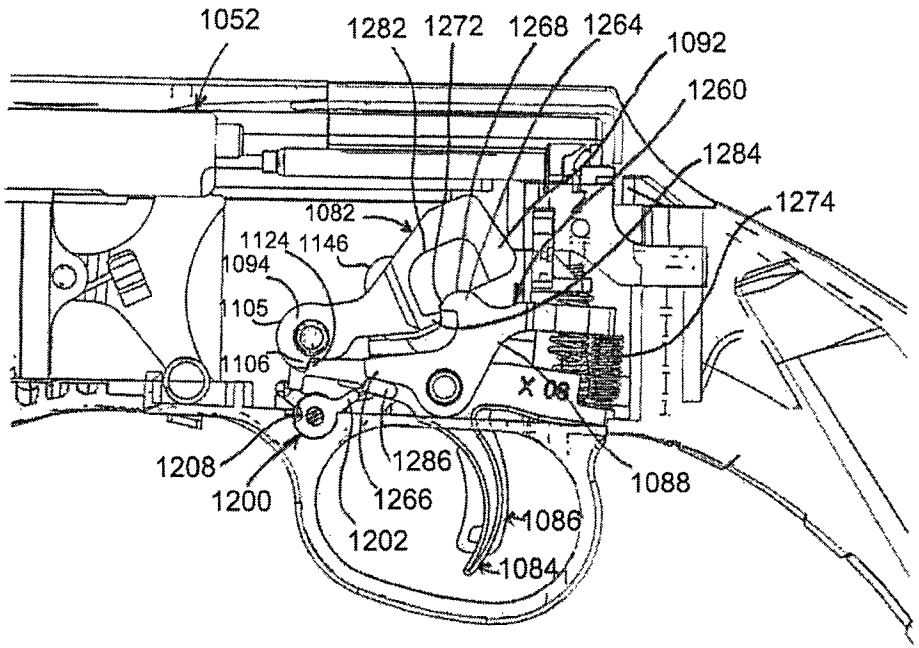
FIG. 68 is a side elevational view of the trigger assembly components and arresting mechanism of FIG. 67.
Figure 69:
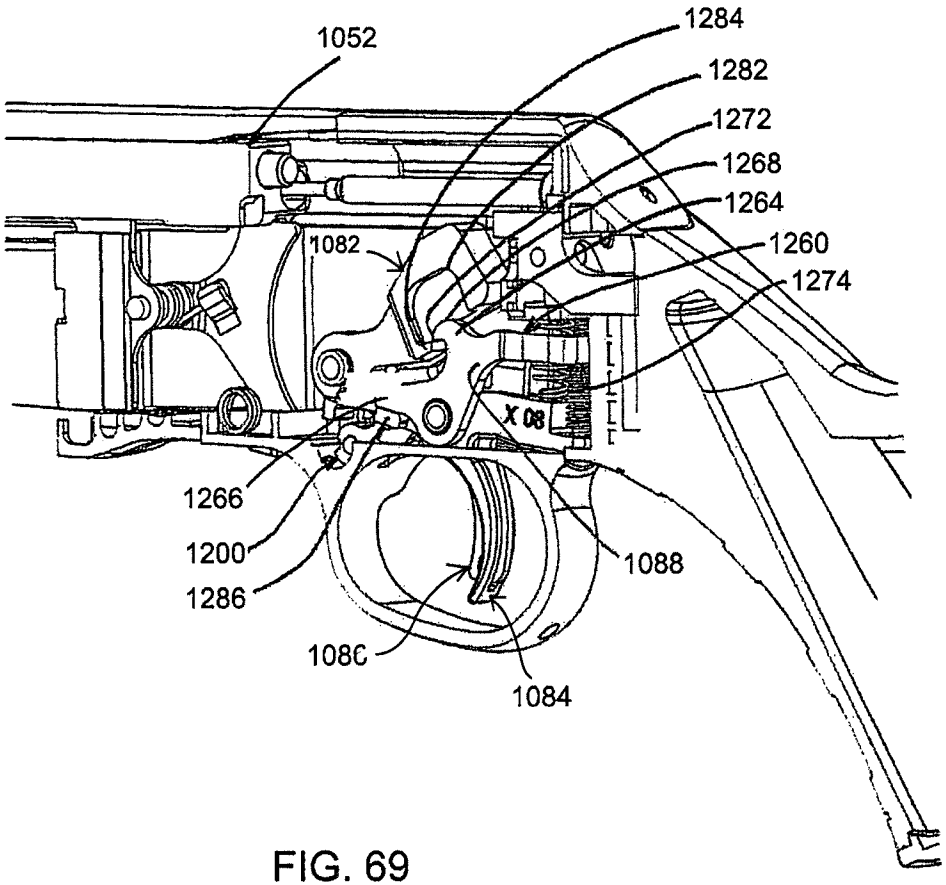
FIG. 69 is a side reverse rear perspective view of the trigger assembly components and arresting mechanism of FIG. 67.

Referring to FIGS. 67 through 69, an arresting mechanism 1260 that facilitates semi-automatic operation (as opposed to automatic operation) is depicted in an embodiment of the disclosure. (Herein, "semi-automatic operation" is characterized by the automatic reloading of the firearm 1030, but the requirement to release and re-actuate the triggers 1084 and 1086 to initiate firing.)

In one embodiment, the arresting mechanism 1260 involves interaction of at least four components: the bolt assembly 1052, the hammer 1082, the firing trigger component 1084, and an arrestor 1088. The arrestor 1088 is pivotally mounted within the housing 1038 and distal to the hammer 1082. In one embodiment, the arrestor 88 includes a claw portion 1264 and a rocker arm portion 1266. The claw portion 1264 can include a rounded head portion 1268 and a radiused nose 1272. An arrestor return spring 1274 can be operatively coupled to the arrestor 1088. In one embodiment, the arrestor 1088 is pivotally mounted to the trigger pivot 1126.

In various embodiments, the arresting mechanism 1260 can include a cavity 1282 formed in the head portion 1092 of the hammer 1082, the cavity 1282 and head portion 1092 further defining a lip portion 1284. In one embodiment, the firing trigger component 1084 includes a lateral protrusion 1286 that is part of the arresting mechanism, the lateral protrusion 1286 being positioned to engage the rocker arm portion 1266 of the arrestor 1088.

In one embodiment, the arrestor 1088 is configured and positioned so that the claw portion 1264 is engageable with the lip portion 1284 of the cavity 1282 when the hammer 1082 is hyperextended in the forward direction 1080. Herein, the hammer 1082 is considered "hyperextended" when the head portion 1092 of the hammer 1082 is displaced to be forward to where the head portion 1092 is located when in the fully cocked configuration 1180.

Figure 70:
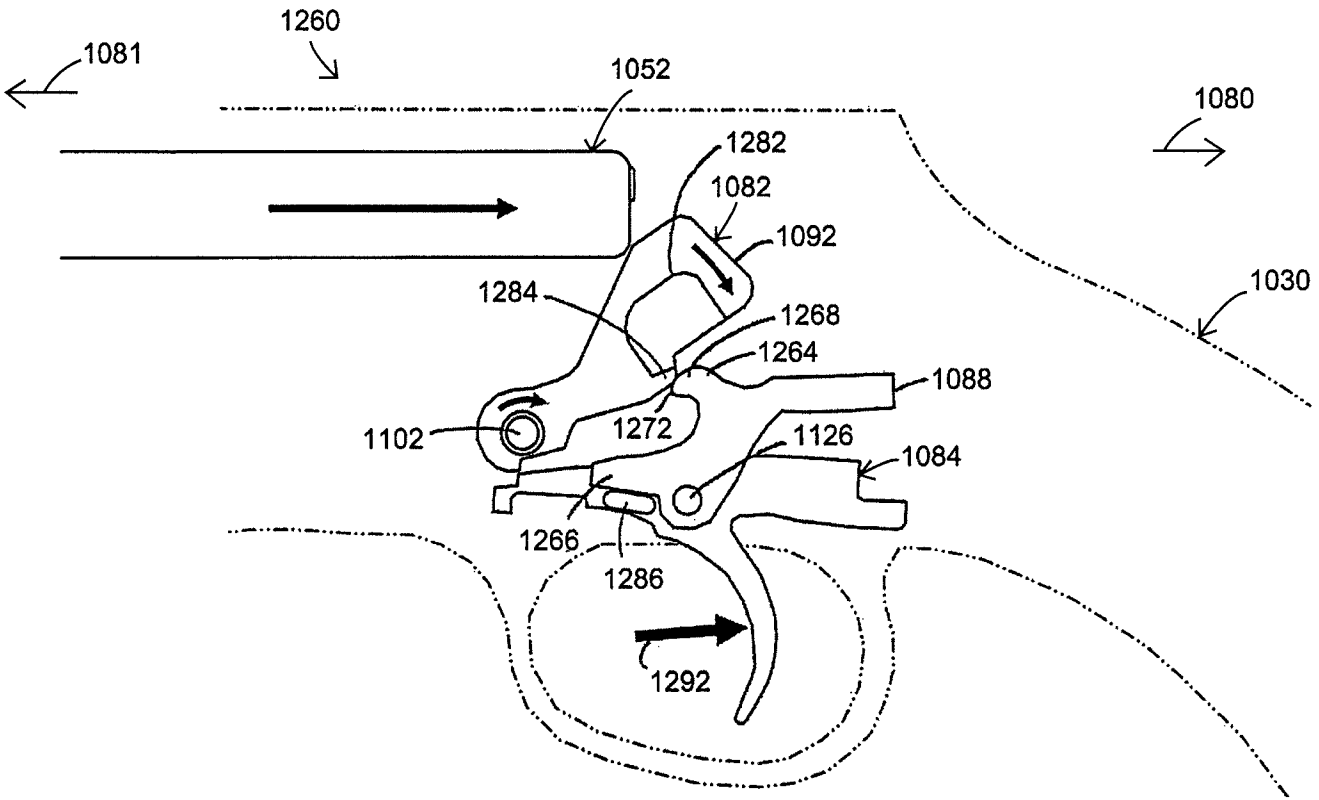
FIG. 70 is a schematic elevational view of operation of the arresting mechanism where the triggers become or remain actuated during the cocking of the firearm.
Figure 71:
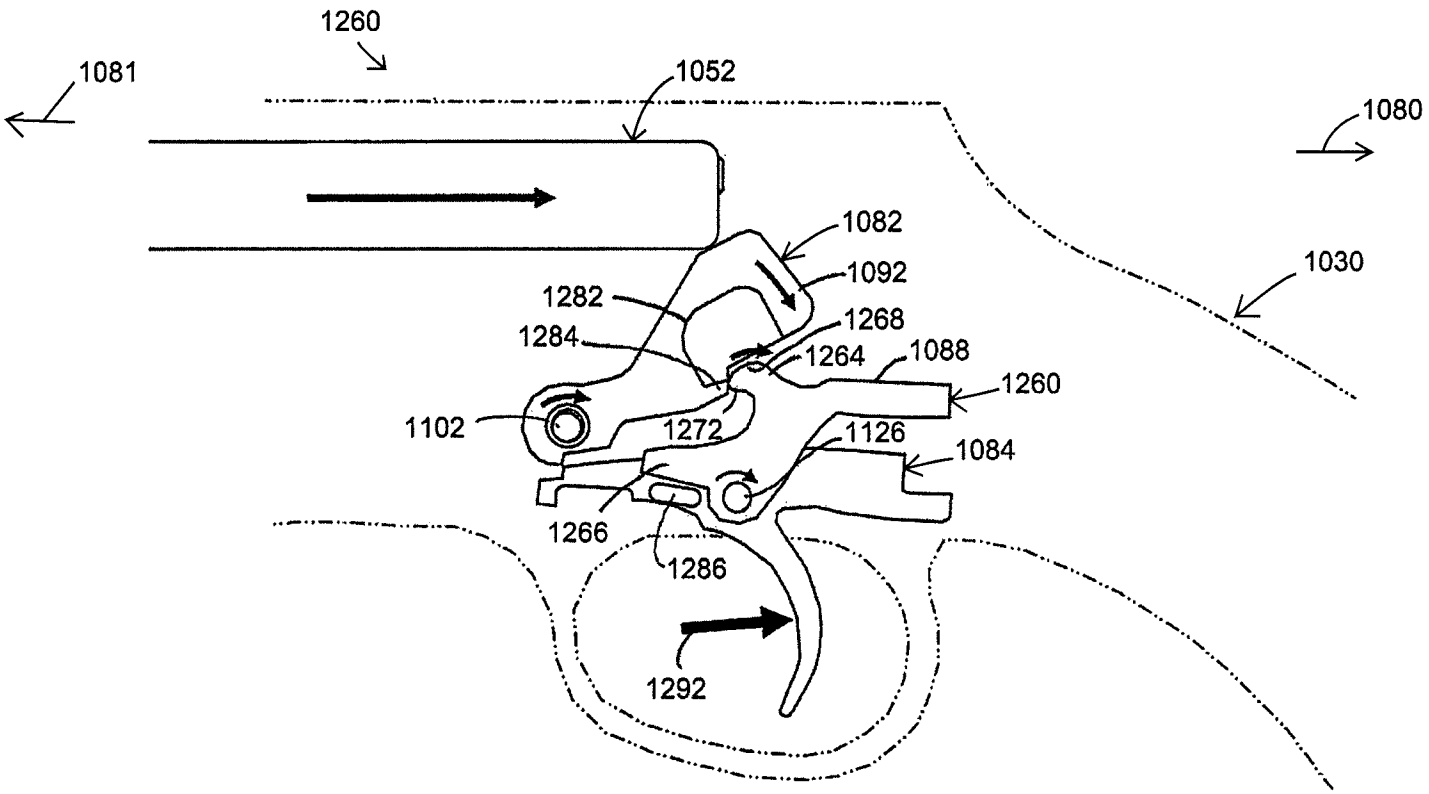
FIGS. 71-75 are side elevational schematic views of the trigger assembly components during the cocking sequence of FIGS. 64-66, illustrating operation of the arresting mechanism in an embodiment of the disclosure.
Figure 72:
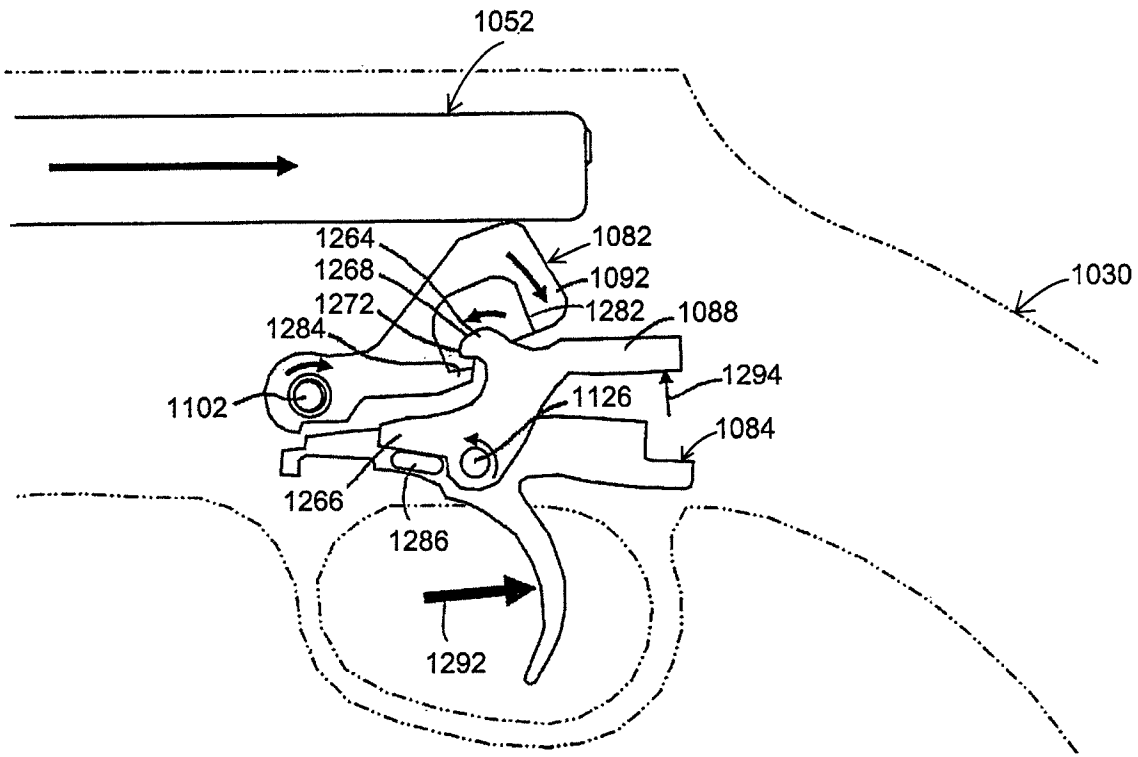

Referring to FIGS. 70 through 75, operation and function of the arresting mechanism 1280 in a scenario where the triggers 1084 and 1086 become or remain actuated during the cocking of the firearm 1030 is depicted in an embodiment of the disclosure. Functionally, the arresting mechanism 1260 captures the hammer 1082 and prevents the hammer 1082 from automatically re-firing. To more closely resemble the views presented in FIGS. 67 through 69, the FIGS. 70 through 75 are presented in an opposing side view relative to the views of FIGS. 61 through 66. Also, for illustrative clarity, the biasing element 1112, as well as the various return springs 1136, 1152 and 1274, are not presented in FIGS. 70 through 75, though they may be present in certain embodiments. Also for illustrative clarity, only the components of the arresting mechanism 1260 (i.e., the bolt assembly 1052, the hammer 1082, the firing trigger component 1084, and an arrestor 1088) are depicted in FIGS. 70 through 72.

When an actuation force 1292 is applied to the triggers 1084 and 1086, the lateral protrusion 1286 of the firing trigger component 1084 is pitched in the distal direction 1081. The arrestor 1088, being biased by the arrestor return spring 1274, follows the firing trigger component 1084, being stopped by the lateral protrusion 1286. When the firing trigger component 1084 is depressed, the lip portion 1284 of the cavity 1282 encounters the rounded head portion 1268 and/or radiused nose 1272 of the claw portion 1264 as the head portion 1092 of the hammer 1082 is rotated in the forward direction 1080 during cocking of the firearm 1030 (FIG. 70). The interaction between the lip portion 1284 and the rounded head portion 1268, radiused nose 1272 of the claw portion 1264 to rotate slightly in the forward direction 1080, such that the rocker arm portion 1266 rotates off the lateral protrusion 1286 of the firing trigger component 1084 (FIG. 71). As the head portion 1092 of the hammer 1082 becomes hyperextended, the lip portion 1284 slips past the radiused nose 1272 of the claw portion 1264, the arrestor 1088 is rotated so that the rocker arm 1266 is again in engagement with the lateral protrusion 1286 of the firing trigger component 1084, motivated by a return force 1294 (FIG. 72) generated by the arrestor return spring 1274. The rotation causes the claw portion 1264 to rotate at least partially into the cavity 1282.

Figure 73:
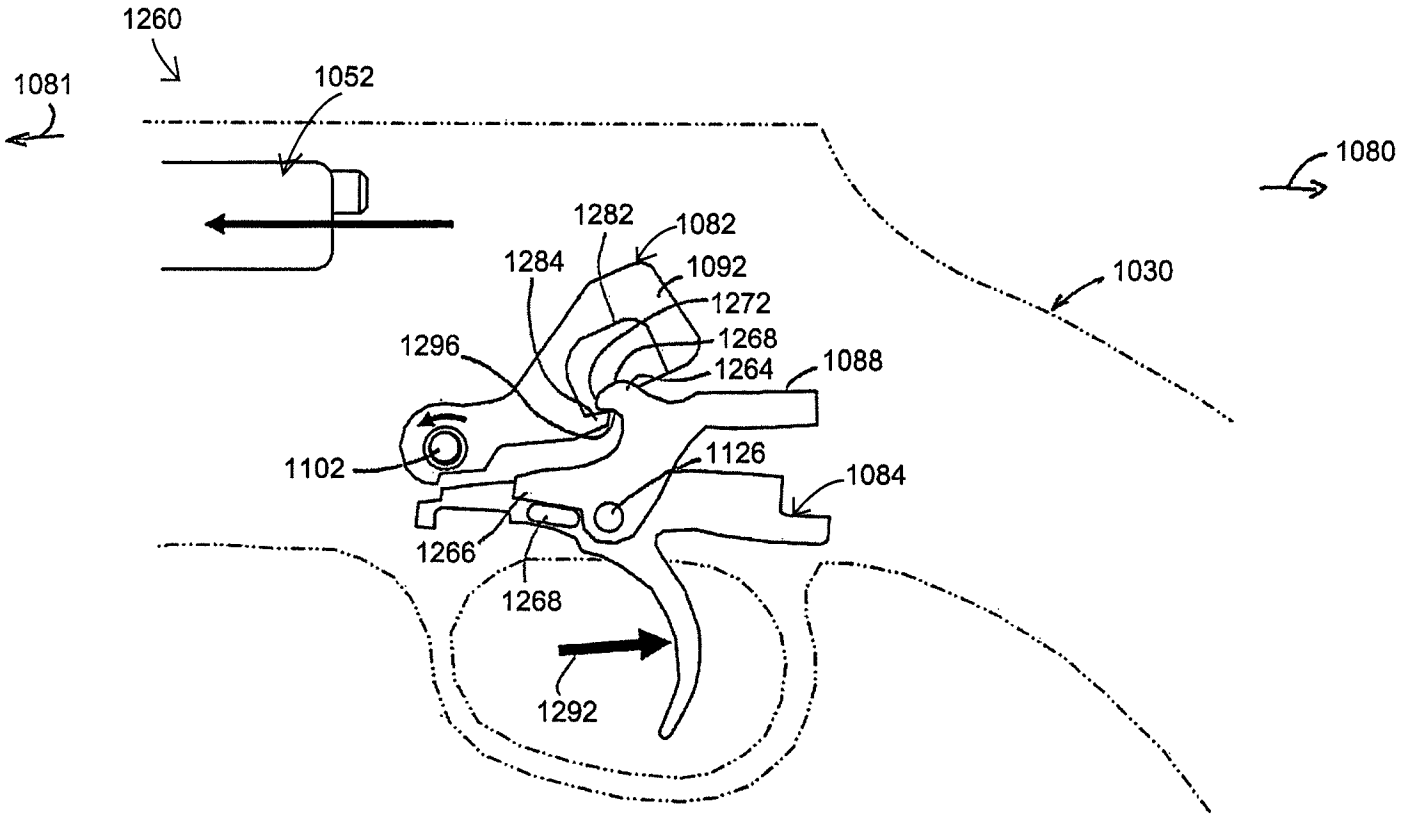

The bolt assembly 1052 then retracts back into the firing position, becoming disengaged from the hammer 1082 (FIG. 73). The disengagement causes the head portion 1092 of the hammer 1082 to rotate in the distal direction 1081 until the lip portion 1284 of the cavity 1282 is hooked by an underside 1296 of the claw portion 1264. The arresting mechanism 11260 remains in equipoise as long as the firing trigger component 1084 remains in the actuated position. In this way, the arresting mechanism 1260 captures the hammer 1082 and prevents the hammer 1082 from automatically re-firing.

Figure 74:
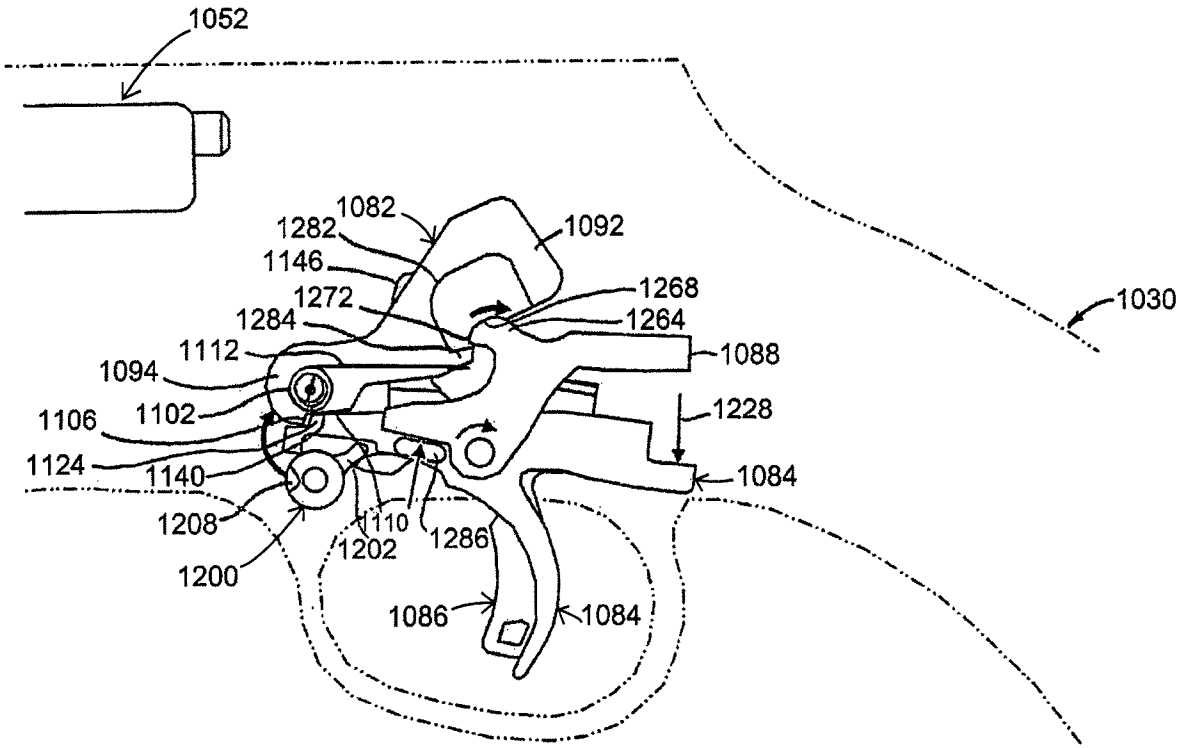

In one embodiment, upon removal of the actuation force 1292 (e.g., when the gunman removes his finger from the firing trigger component 1084), the return force 1228 of the firing trigger return spring 1136 causes rotation of the firing trigger component 1084 so that the lateral protrusion 1286 of the firing trigger component 1084 is rotated upwards (clockwise in FIG. 74). The lateral protrusion 1286 causes the rocker arm 1266 of the arrestor 1088 to also rotate upward, thereby decoupling the lip portion 1284 of the cavity 1282 from the underside 1296 of the claw portion 1264. The lip portion 1284 of the hammer 1082 then slips past the radiused nose 1272 of the claw portion 1264, being motivated by the biasing element 1112, thereby releasing the hammer 1082 from the arrestor 1088.

Figure 75:
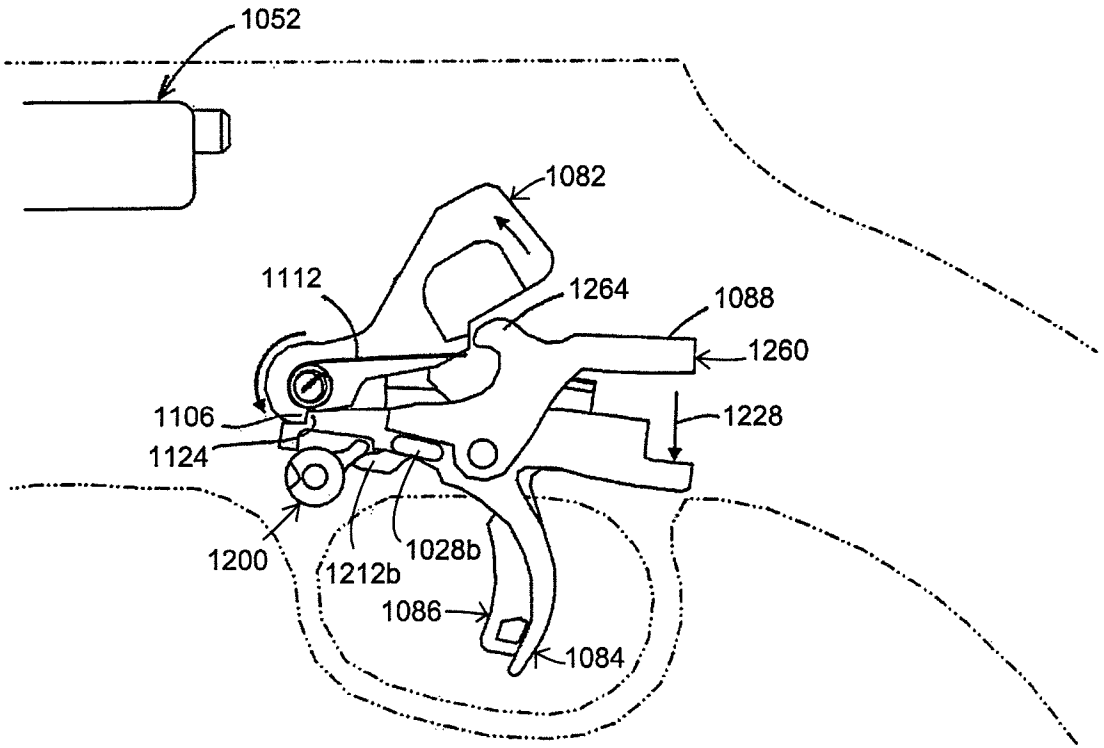

The rotation of the firing trigger component 1084 upon removal of the actuation force 1292 also causes the cam engagement surface 1140 to come into contact with the flat 1110 of the cam portion 1094, which brings the sear portion 1124 of the firing trigger component 1084 proximate and adjacent to, but not in contact with, the sear engagement portion 1106 of the hammer 1082 (FIG. 74). Upon release of the hammer 1082 from the arrestor 1088, the head portion 1092 of the hammer 1082 further rotates in the distal direction 1081, until the bearing face 1108 of the sear engagement portion 1106 is fully registered against the sear portion 1124 of the firing trigger component 1124 (FIG. 75). The trigger assembly 1032 is then in the fully cocked configuration 1180.

It is further noted that, in various embodiments, if the firing trigger component 1084 is not actuated when the hammer 1082 reaches the hyperextended position, the arrestor 1088 is not in a position to engage and/or secure the lip portion 1284 of the hammer 1082. Accordingly, the arrestor 1088 does not substantially interfere with the cocking operation if the firing trigger component 1084 is not actuated.

The barrel and receiver may be conventionally manufactured from steel. In various embodiments, other metals may be used. The components of the trigger assembly cluster are generally conventionally formed from steel or other metals. In some instances, polymers may replace some components. For example the trigger mechanism housing may be made from polymers and composite materials. Metal inserts may be used for particular areas requiring high strength such as attachment locations. See projection 1060 and the trigger guard 1056 (see FIGS. 49A and 49B). Also, see FIG. 47 the polymer access cover 1290 has a metal insert 1291 for strength and providing the catch surfaces. The polymer may be overmolded over the insert capturing the insert. The stock can be formed from polymers or wood or composite materials.

Figure 76:
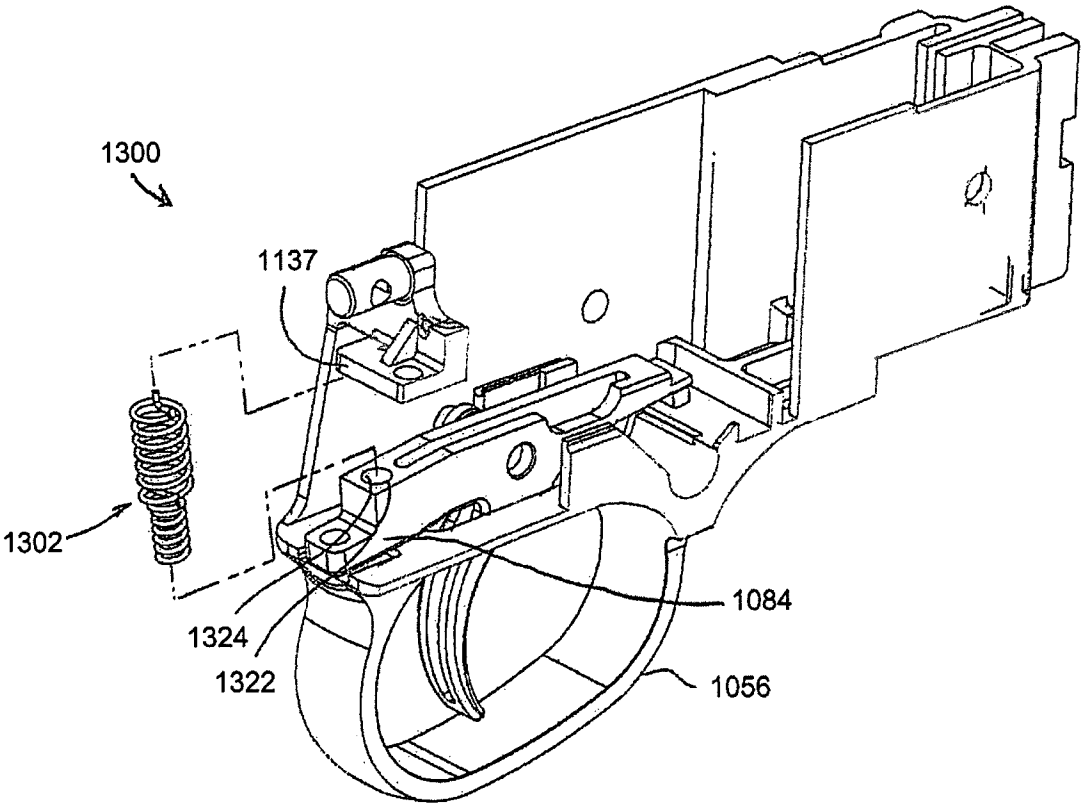
FIG. 76 is a partially exploded cutaway view of a trigger pull adjustment mechanism in an embodiment of the disclosure.
Figure 77:
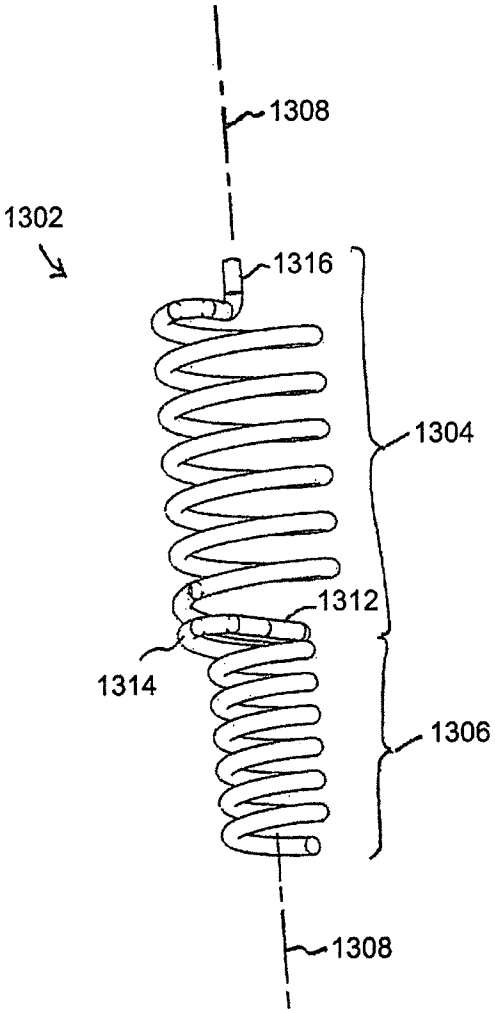
FIG. 77 is an enlarged perspective view of a firing trigger return spring for the trigger pull adjustment mechanism of FIG. 76 in an embodiment of the disclosure.

Referring to FIGS. 76 and 77, a trigger pull adjustment mechanism 1300 is depicted in an embodiment of the disclosure. The trigger pull adjustment mechanism 1300 comprises an adjustable firing trigger return spring 1302 disposed in place of the firing trigger return spring 1136 (as depicted, for example, in FIG. 54) and operatively coupled to the ledge portion 1137 and the firing trigger component 1084 to exert a separating force therebetween. This separating force constitutes a component of the pull or actuation force required to actuate the firing trigger component 1084 for releasing the hammer 1082.

In the depicted embodiment, the adjustable firing trigger return spring 1302 includes an upper portion 1304 and a lower portion 1306 spiral wound about a spring axis 1308. A transition segment 1312 can be formed in the lower-most spiral 1314 of the upper portion 1304, the transition segment 1312 passing through the adjustable firing trigger return spring 1302 proximate the spring axis 1308. In one embodiment, the transition segment 1312 is substantially linear over a portion thereof. In the way, the transition segment 1312 obstructs what would otherwise be a clear passage through the adjustable firing trigger return spring 1302. The upper and lower portions 1304 and 1306 can be of different diameter, as depicted. Also in the depicted embodiment, the upper portion 1304 terminates with a tail portion 1316 that is substantially concentric with the spring axis 1308. The ledge portion 1137 can define a mounting hole 1318 within which the tail portion 1316 is mounted in assembly.

In assembly, the lower portion 1306 of the adjustable firing trigger return spring 1302 is firmly seated within a through-hole 1322 defined on the firing trigger component 1084. The firm seating of the lower portion 1306 within the through-hole 1322 can be accomplished by an interference fit between an inner wall 1324 of the through-hole 1322 and the lower portion 1306 of the spring 1302 as wound. The interference fit provides a high degree of friction between the inner wall 1324 of the through-hole 1322 and the lower portion 1306 of the spring 1302, thereby fixing the compressed length of the spring 1302. In this embodiment, while the friction is sufficient to maintain the compressed length 1302 of the spring when the firearm 1030 is in the fully cocked configuration 1180 (i.e., prior to actuation of the firing trigger component 1084), the spring 1302 In one embodiment, the through-hole 1322 is tapered to augment the seating operation during assembly and rotation of the spring 1302 during an adjustment.

Figure 78:
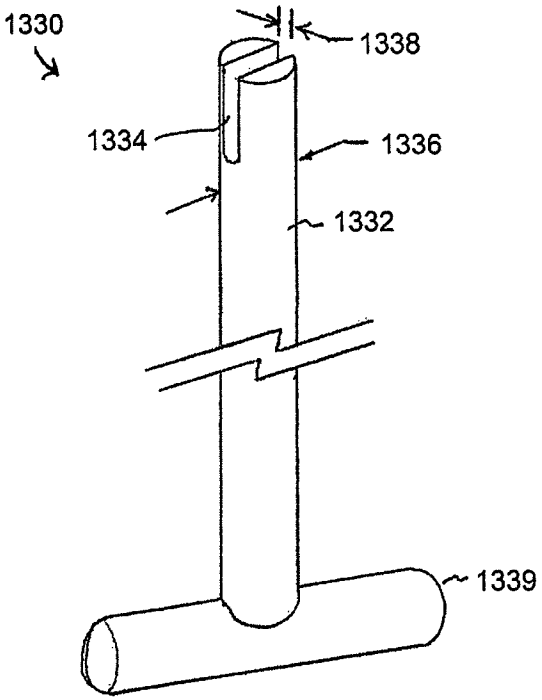
FIG. 78 is a perspective view of an adjustment tool for use with the trigger pull adjustment mechanism of FIG. 76 in an embodiment of the disclosure.

Referring to FIG. 78, an adjustment tool 1330 for rotating the adjustable firing trigger return spring 1302 is depicted in an embodiment of the disclosure. The adjustment tool 1330 includes a shaft portion 1332 with a slot 1334 defined on one end thereof. A diameter 1336 of the shaft portion 1332 is dimensioned to readily pass through the interior of the lower portion 1306 of the spring 1302. A width 1338 of the slot 1334 is dimensioned to receive the transition segment 1312 of the spring 1302. Optionally, the adjustment tool 1330 includes a handle portion 1339 disposed proximate the end of the adjustment tool 1330 that is opposite the slot 1334.

Figure 79:
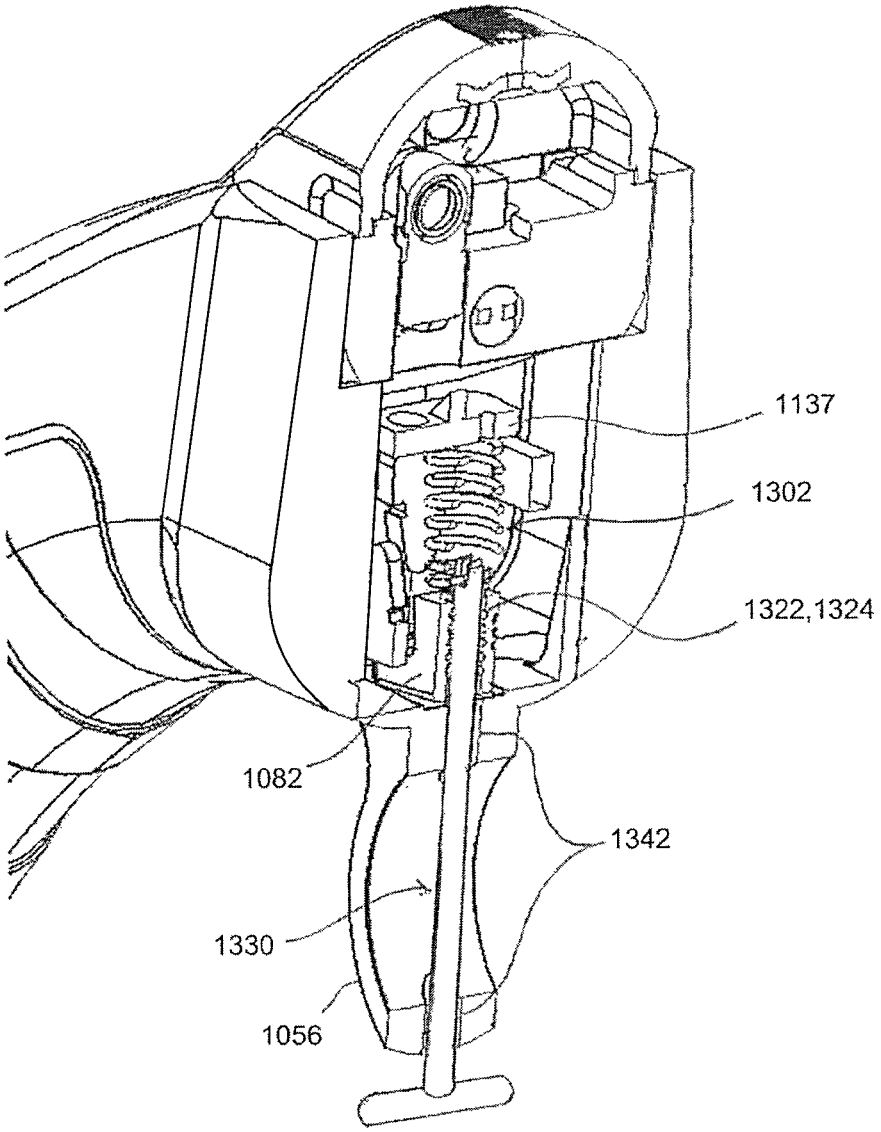
FIG. 79 is a sectional view of the trigger pull adjustment mechanism of FIG. 76 in assembly and operation of the adjustment tool of FIG. 78 in an embodiment of the disclosure.

Referring to FIG. 79, adjustment of the trigger pull adjustment mechanism 1300 is depicted in an embodiment of the disclosure. In the depicted embodiment, access passages 1342 are formed in the trigger guard 1056, sized to allow passage of the shaft 1332 of the adjustment tool 1330. The adjustment tool 1330 is inserted through the access passages 1342 and the lower portion 1306 of the adjustable firing trigger return spring 1302 and brought into contact with the transition segment 1312. The adjustment tool is rotated and pushed against the transition segment so that the slot 1334 is aligned with and accepts the transition segment 1312. With the transition segment 1312 seated within the slot 1334, the adjustment tool 1330 is rotated to overcome the friction between the lower portion 1306 and the inner wall 1324 of the through-hole 1322, thereby changing the compressive force of the spring 1302 when in the battery position. By increasing the compression of the spring 1302, the restorative force generated by the spring 1302 is increased, thereby increasing the pull required to actuate the firing trigger component 1084; by decreasing the compression of the spring 1302, the restorative force generated by the spring 1302 is decreased, thereby decreasing the pull required to actuate the firing trigger component 1084. The friction between the lower portion 1306 and the inner wall 1324 of the through-hole 1322 is sufficient to maintain the adjusted compression of the spring 1302 during operation of the firearm 1030.

Accordingly, the disclosed trigger pull adjustment mechanism 1300 accomplishes adjustment of the trigger pull with fewer components and with reduced machining complexity. For example, conventional trigger pull adjustments utilize an additional set screw that requires a threaded hole for the compression adjustment. The trigger pull adjustment mechanism 1300 eliminates the need for these components and attendant complexity.

Other adjustable trigger mechanisms can be implemented instead. Such mechanisms are illustrated, for example, in U.S. Pat. No. 6,553,706, owned by the owner of this application, the disclosure of which is hereby incorporated reference herein in its entirety except for express definitions and patent claims contained therein. See also U.S. Pat. Nos. 8,220,193 and 8,250,799, the disclosures of which are hereby incorporated reference herein in their entirety except for express definitions and patent claims contained therein.

Figure 80:
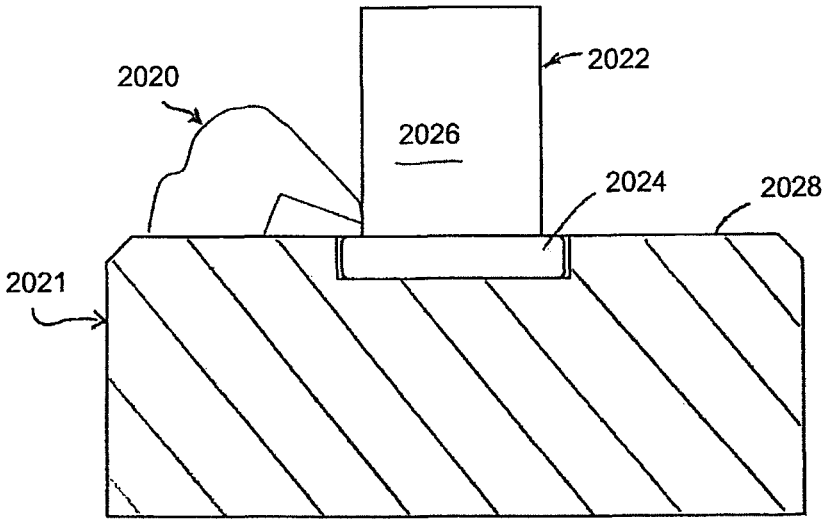
FIG. 80 PRIOR ART
FIGS. 80 and 81 are sectional views of a conventional rotating claw extractor in operation.
Figure 81:
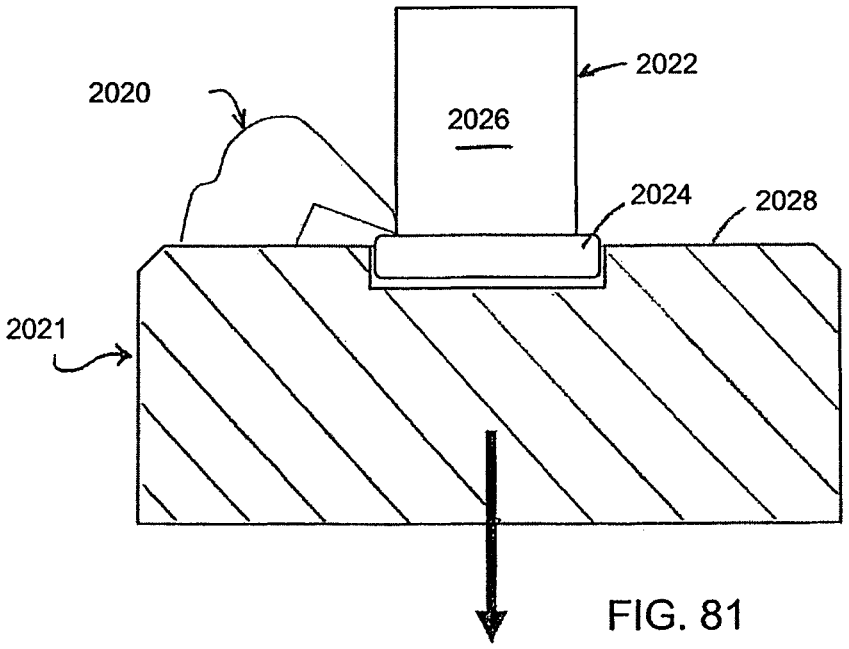
FIG. 81 PRIOR ART
Figure 82:
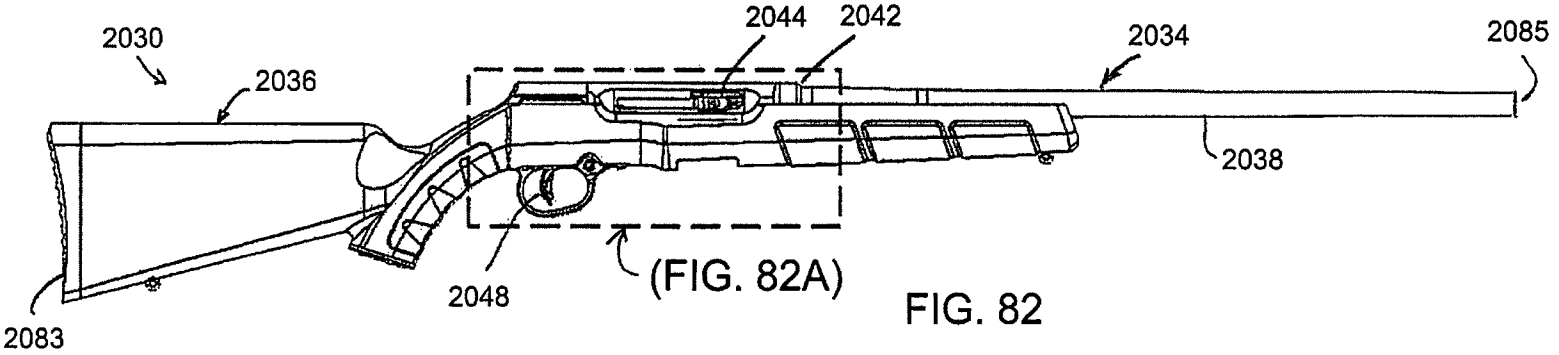
FIG. 82 is a side view of a firearm utilizing an extraction mechanism in an embodiment of the disclosure.
Figure 82A:
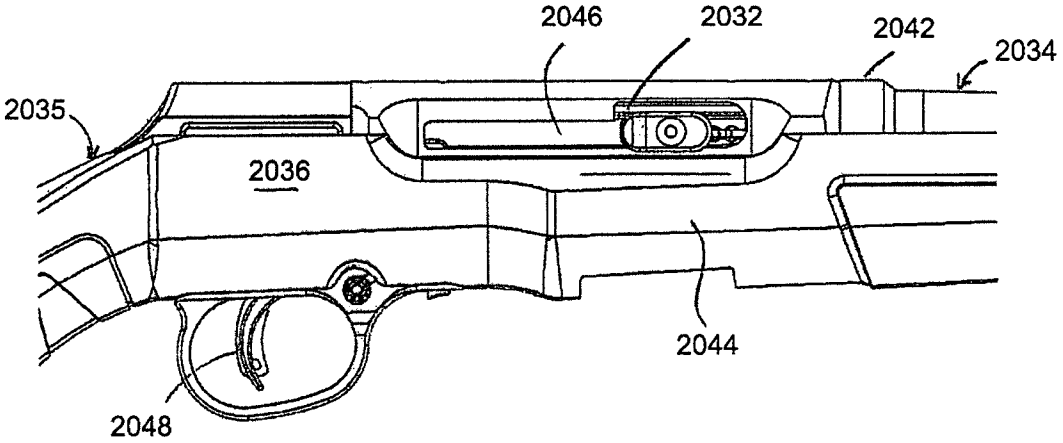
FIG. 82A is an enlarged partial view of the firearm of FIG. 82.
Figure 83:
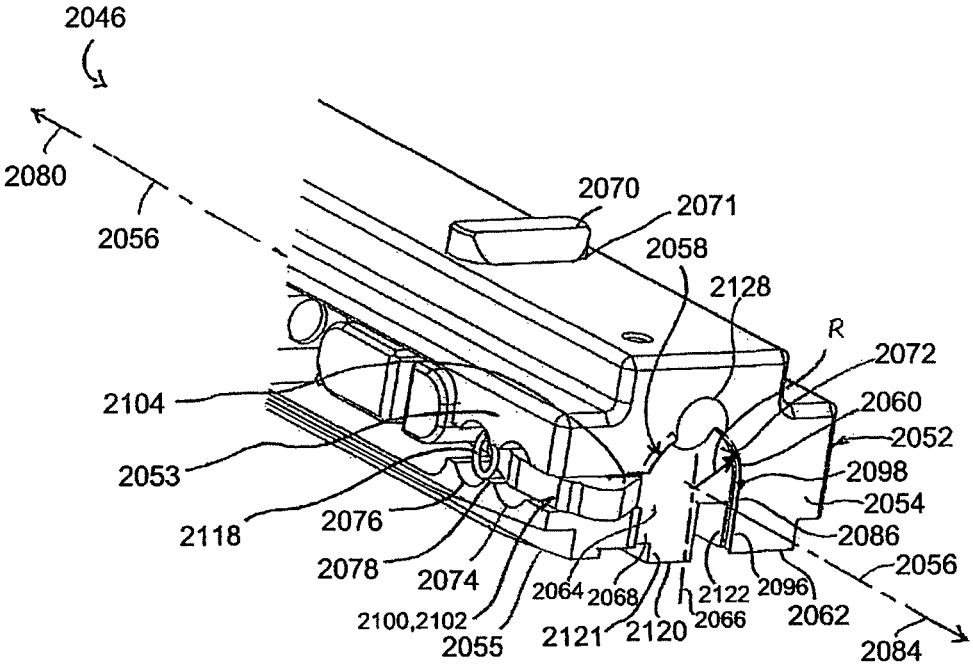
FIG. 83 is a bolt assembly in an embodiment of the disclosure.
Figure 84:
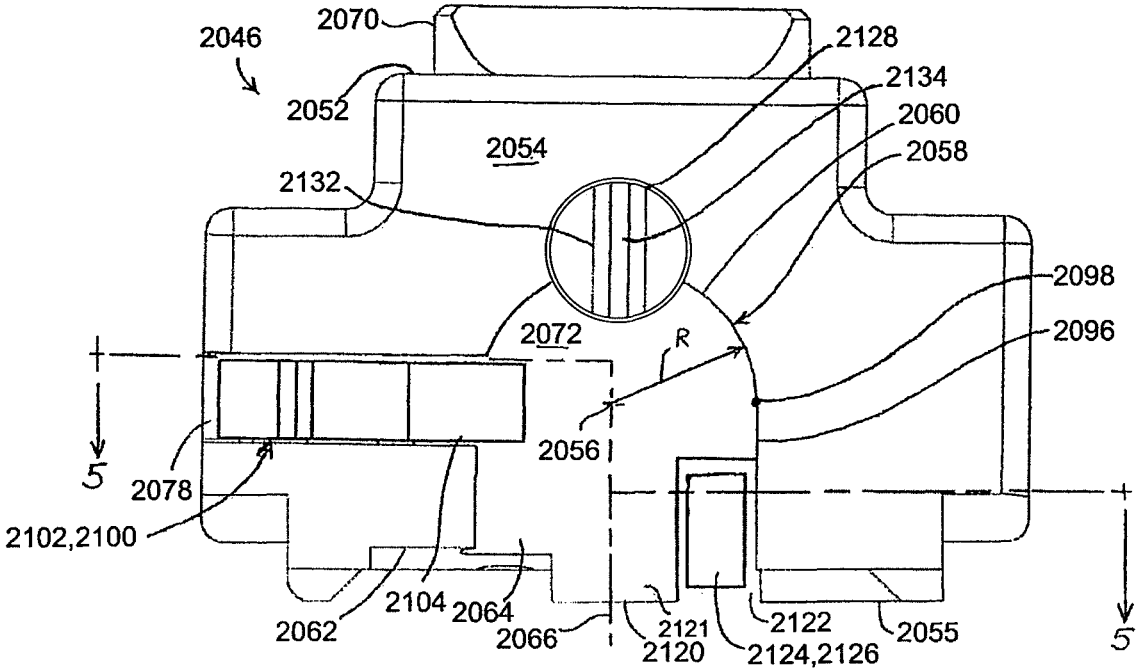
FIG. 84 is an elevation view of a distal end of the bolt assembly of FIG. 83.

Referring to FIGS. 80 and 81, a conventional rotating claw extractor 2020 operatively coupled to a bolt 2021 is depicted. The extractor 2020 rotates into contact with a shell casing 2022 having a case rim 2024 and a case wall 2026, often making contact the case wall 2026 (FIG. 80). In this position, the extractor 2020 exerts no force directly against the case rim 2024. During extraction, a face 2028 of the bolt 2021 moves away from the shell casing 2022 until the extractor 2020 contacts the rim 2024. Positive extraction is realized because the extractor 2020 exhibits a force on the case rim 2024.

However, due to the size and shape of cartridges such as rim fire cartridges and in particular high powered rim fire cartridges, ejection can be problematic, for example in semi-automatic firearms. Ejection can become compromised because once the shell casing 2022 is extracted from the firing chamber it is not in static equilibrium and is no longer stable (FIG. 81). That is, positive axial force is exerted asymmetrically, on only one portion of the case rim 2024. The natures of the forces exerted on the shell casing 2022 are further complicated by dimensional uncertainties due to the manufacturing tolerances of the shell casing as well as the generally small dimensions. If these manufacturing tolerances cause the contact edge of the extractor 2020 to rotate into the headspace of the bolt face 2028, the clearance can be inadequate for the extractor 2020 to secure the case rim 2024. Additionally, if the contact edge of the extractor 2020 is near the headspace, feeding problems can occur as the case rim 2024 may get bound on the extractor 2020. If dimensional uncertainties of the shell casing 2022 due to manufacturing tolerances cause the extractor to be displaced away from the headspace, the cartridge will again become unstable, as depicted in FIG. 81.

It is further noted while other portions of the case rim 2024, particularly portions that are diametrically opposed to the contact region of the rotating claw 2020, can also be subject to an axial force, these axial forces rely on friction that results from radial counter forces exerted on the case rim 2024. The frictional forces can be inconsistent, particularly when the surfaces involved are oiled, as is common practice with well-maintained firearms, or there is a buildup of discharge residue.

Referring to FIGS. 82 through 86G, a firearm 30 utilizing an extraction mechanism 2032 for extraction of spent cartridge casings therefrom is depicted in an embodiment of the disclosure. The firearm 2030 is a hand-held device that includes a barrel assembly 2034 mounted in a stock 2035 and operatively coupled to a receiver 2036. The barrel assembly 2034 includes a barrel 2038 with a firing chamber 2042, a breech 2044, and a bolt assembly 2046 slidingly engaged within the breech 2044. A trigger assembly 2048 is operatively coupled with the bolt assembly 2046.

Various components of the bolt assembly 2046 are part of the extraction mechanism 2032. The extraction mechanism 2032 includes a bolt 2052 having a bolt face 2054 at a distal end 2053 and a lower face 2055. A recess 2058 is defined on the bolt face 2054. In various embodiments, the structure defining the recess 2058 includes an undercut portion 2087 that extends distally to a ledge portion 2086, the ledge portion 2086 having an arcuate segment 2060 that arcs tangentially about a central axis 2056 that is normal to the base surface 2072. (Herein, an "axis" extends indefinitely in two opposing directions, and is not bound lengthwise by the object or feature that defines the axis.)

In one embodiment, the arcuate segment 2060 defines the location of the central axis 2056 on the base surface 2072, the arcuate segment 2060 of the ledge portion 2086 being at a constant radius R from the central axis 2056. The bolt 2052 being translatable parallel to the central axis 2056. The recess 2058 can extend through a lateral periphery 2062 of the bolt 2052, effectively defining a channel 2064 that extends along a channel axis 2066 and defining a channel opening 2068 at the lateral periphery 2062. The recess 2058 can be bounded proximally by a base surface 2072 on the bolt face 2054. The base surface 2072 is substantially normal to the central axis 2056. The bolt assembly 2046 can further include a retractable anchoring bar 2070 that extends away from the central axis 2056 through an aperture 2071 formed in the bolt 2052.

The bolt 2052 can also include structure defining a first lateral bore 2074 and a second lateral bore 2076 proximate the bolt face 2054, the second lateral bore 2076 being proximal (rearward) to the first lateral bore 2074. An extractor channel 2078 can be formed on the distal (forward) end portion 2053 of the bolt 2052, the extractor channel 2078 extending parallel to the central axis 2056 and passing through both the first and second lateral bores 2074 and 2076. (Herein, "proximal" and "forward" refer to a direction 2080 that is towards a butt end 2083 of the stock, and "distal" and "rearward" refer to a direction 2084 that is towards a discharge end 2085 of the barrel 2038.)

Figure 85A:
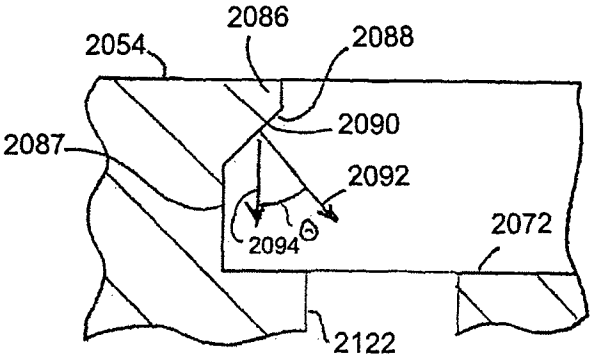
FIG. 85A is an enlarged, partial sectional view of the bolt assembly of FIG. 85.

The ledge portion 2086 and undercut portion 2087 partially surrounds the base surface 2072 of the bolt face 2054. The ledge portion 2086 includes an inclined face 88 that faces the base surface 2072 defines a normal vector 2092 (FIG. 85A) that, during contact with a rim 2148 of a casing 2144 disposed in the recess 2058, correlates with a retention force exerted thereon. The normal vector 2092 includes an axial component 2094 that is parallel to the central axis 2056 and is directed toward the base surface 2072. The axial component 2094 of the normal vector 2092 can define an angle θ relative to the normal vector 2092. In various embodiments, the angle θ is in the range of 25° to 85° inclusive. (Herein, a range that is said to be "inclusive" includes the end point values of the stated range, as well as the values between the end point values.) In one embodiment, the ledge portion 2086 and undercut portion 2087 include a substantially straight portion 2096 that is tangential to the arcuate segment 2060 at a junction point 98. In one embodiment, the inclined face 2088 of the arcuate segment 2060 is substantially linear in cross-section, to define a frustum shaped profile 2090 (FIG. 85A).

Figure 85B:
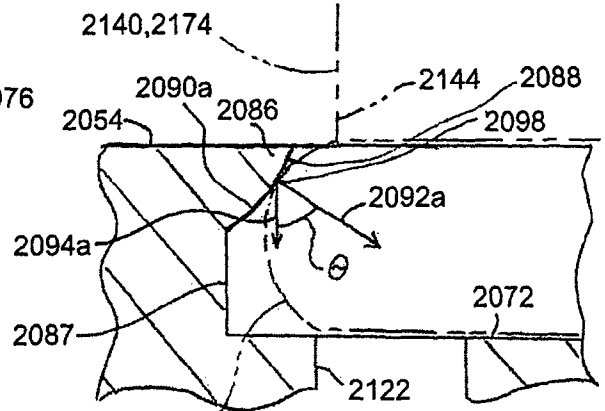
FIG. 85B is an enlarged, partial sectional view of the bolt assembly in an alternative embodiment of the disclosure.
Figure 85:
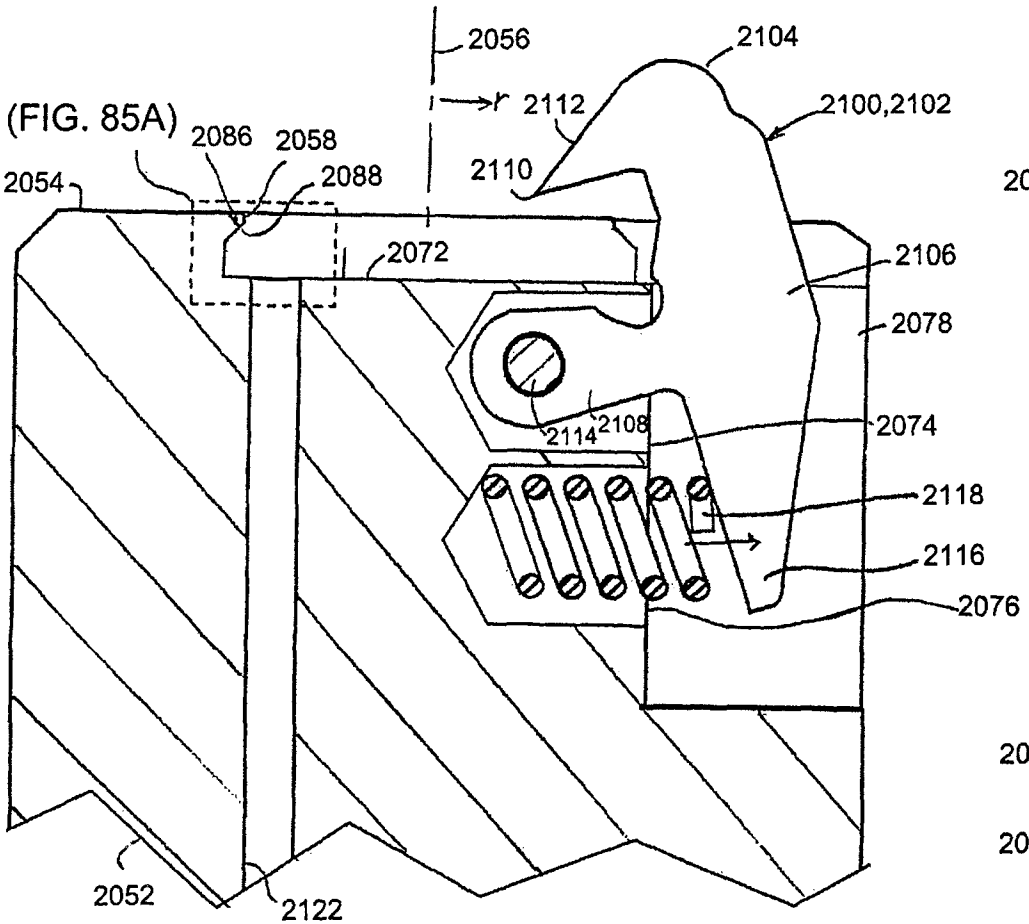
FIG. 85 is a sectional view of the bolt assembly of FIG. 84.

Alternatively, the ledge portion 2086 can be configured to define other profile shapes. In one embodiment, the ledge portion 2086 includes an arcuate, convex-shaped profile 2090*a* (FIG. 85B). In this embodiment, a normal vector 2092*a* is defined by the contact line between the rim 2148 of the spent cartridge casing 2174 or cartridge 2140 and the convex-shaped profile 2090*a*. (The rim 2148 and casing 2144 of the spent cartridge casing 2174 or cartridge 2140 is depicted in phantom in FIG. 85B.) An axial component 2094*a* of the normal vector 2092*a* extends parallel to the central axis 2056.

The extraction mechanism 2032 also includes a retractable extractor 2100. In some embodiment, the retractable extractor 2100 is diametrically opposed to the junction point 2098 about the central axis 2056. In one embodiment, the retractable extractor 2100 is centered at this location. In one embodiment, the retractable extractor 2100 is a claw-type extractor 2102 having a claw portion 2104, a stem portion 2106, and a pivot arm portion 2108. The claw-type extractor 2102 is disposed in the extractor channel 2078 proximate the recess 2058, with the claw portion 2104 is extendable over the recess 2058 and/or base surface 2072. The claw portion 2104 can define an apex 2110 at a radially innermost extremity, and a tapered distal face 2112 that slopes distally and away from the apex 2110 with increasing radial distance r from the central axis 2056.

The apex 2110 may be in axial alignment (with respect to the firearm) with pin 2114. This minimizes rotation or disengagement of the cartridge rim from the force of the cartridge rim during extraction, enabling the extractor spring to be of minimal force.

The pivot arm portion 2108 of the claw-type extractor 2102 can extend into the first lateral bore 2074 and can be pivotally coupled to a pivot pin 2114 that extends laterally into or through the first lateral bore 2074. A proximal end 2116 of the of the stem portion 2106 of the claw-type extractor 2102 can extend proximal to the pivot arm portion 2108 and be disposed within the second lateral bore 2076, with a biasing element 2118 (e.g., a spring) disposed within the second lateral bore 2076. In one embodiment, the biasing element 2118 exerts a force FB radially outward on the proximal end 2116 of the of the stem portion 2106 of the claw-type extractor 2102, such that, in a default configuration, the proximal end 2116 of the claw-type retractable extractor 2102 is biased in a rotational position about the pivot pin 2114 that extends the claw portion 2104 of the claw-type retractable extractor 2102 over the recess 2058.

In one embodiment, the bolt 2052 includes a magazine rail 2120 that is defined on the lower face 2055 of the bolt 2052 and extends substantially parallel to the central axis 2056 along the lower face 2055. The magazine rail 2120 includes a distal face 2121 that protrudes downward and can be substantially centered about the channel axis 2066.

The lower face 2055 of the bolt 2052 can further define an ejector channel 20122 within which a stationary ejector 2124 is mounted, the stationary ejector 2124 being stationary relative to the firearm 2030 and including a distal end 2126. The ejector channel 2122 extends substantially parallel to the central axis 2056 and through the base surface 2072 of the bolt face 2054. The bolt 2052 can also include a firing pin channel or passage 2128, within which a firing pin 2132 can be slidingly engaged. The firing pin 2132 includes a distal end 2134 that is selectively extensible into the recess 2058 in a direction normal to the base surface 2072. In one embodiment, the firing pin 2132 is a rim-type firing pin.

Figure 85C:
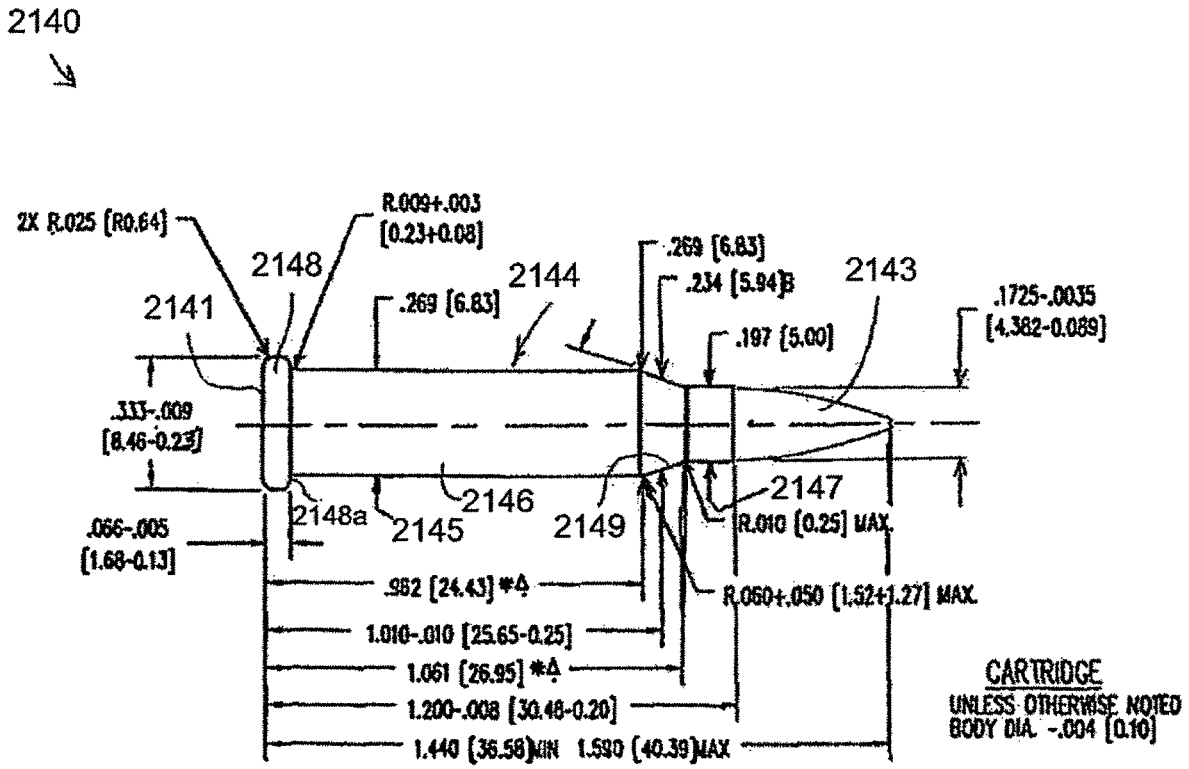
FIG. 85C PRIOR ART
FIG. 85C is an elevation view of a cartridge, including dimensions for a 0.17 WSM cartridge.

The firing chamber 2042 includes chamber wall 2136 that defines a cylindrical interior chamber 2138 centered about a barrel axis 2139 and having a circular access opening 2142 that faces the breech 2044, and within which a cartridge 2140 can be mounted and discharged. When mounted in the chamber, the rim 2148 is proximal to the bullet 2143. The cartridge 2140 is characterized as having the casing 2144 that includes a body or case wall 2146, a head 2141 having the rim 2148, and a bullet 2143. The rim 2148 is further characterized as defining a forward side 2148*a*. The rim 2148 is depicted as being of greater diameter than the case wall 2146. Standard cartridges of this variety, which are often rimfire cartridges, include the 0.22 short, the 0.22 long rifle, and the 0.22 Winchester Magnum Rimfire (0.22 WMR). In certain embodiments, the casing 2144 is of the shouldered variety, having a major diameter 2145 and a minor diameter or neck 2147 joined by a tapered shoulder 2149 (FIG. 85C). Non-limiting examples of shouldered standard cartridges include the 0.17 Hornady Magnum Rimfire (0.17 HMR) and 0.17 Winchester Super Magnums (0.17 WSM) cartridges. The dimensional specifications for the 0.17 WSM are also depicted in FIG. 85C, and presented only as example dimensions of the cartridge 2140.

Alternatively, the extraction mechanism 2032 can be tailored to extract standard "rimless bottleneck" cartridges with heads that are of approximately the same or smaller diameter as the body for casings where the head projects outward relative to a reduced diameter of the body at the body/rim junction. That is, the head of a rimless bottleneck cartridge does not extend radially beyond the radius of the case wall. Standard cartridges of this variety include, but are not limited to, the 0.22 Remington and the 0.17 Remington, which are both centerfire cartridges.

In one embodiment, a ridge 2152 can be formed at a proximal end 2154 of the firing chamber 2042. The ridge 2152 defines an edge 2156 that is immediately adjacent the circular access opening 2142, such that when the cartridge 2140 is mounted in the firing chamber 2042, an exposed portion 2158 of the rim 2148 extends radially outward relative to the edge 2156 of the ridge 2152. In some embodiments, the edge 2156 of the ridge 2152 is tangential to the circular access opening 2142.

Referring again to FIGS. 86A through 86H, operation of the extraction mechanism 2032 is described in the context of a semi-automatic firearm in an embodiment of the disclosure. In a firing position 2172 (FIGS. 86A through 86C), the cartridge 2140 is disposed in the firing chamber 2042 of the firearm 2030. In the firing position 2172, in one embodiment, the tapered distal face 2112 of the claw-type extractor 2102 is engaged with the ridge 2152 of the firing chamber 2042, such that the claw portion 2104 of the claw-type extractor 2102 is pushed radially outward.

The radial outward displacement of the claw portion 2104 causes the claw-type extractor 2102 to rotate about the pivot pin 2114, such that the proximal end 2116 of the stem 2106 is rotated radially inward against the biasing element 2118. In this way, the claw-type extractor 2102 retracted, so that the claw portion 2104 is clear of the cartridge 2140 and enabling the rim 2148 of the casing 2144 to be registered against the circular access opening 2142 of the firing chamber 2042.

Figure 86A:
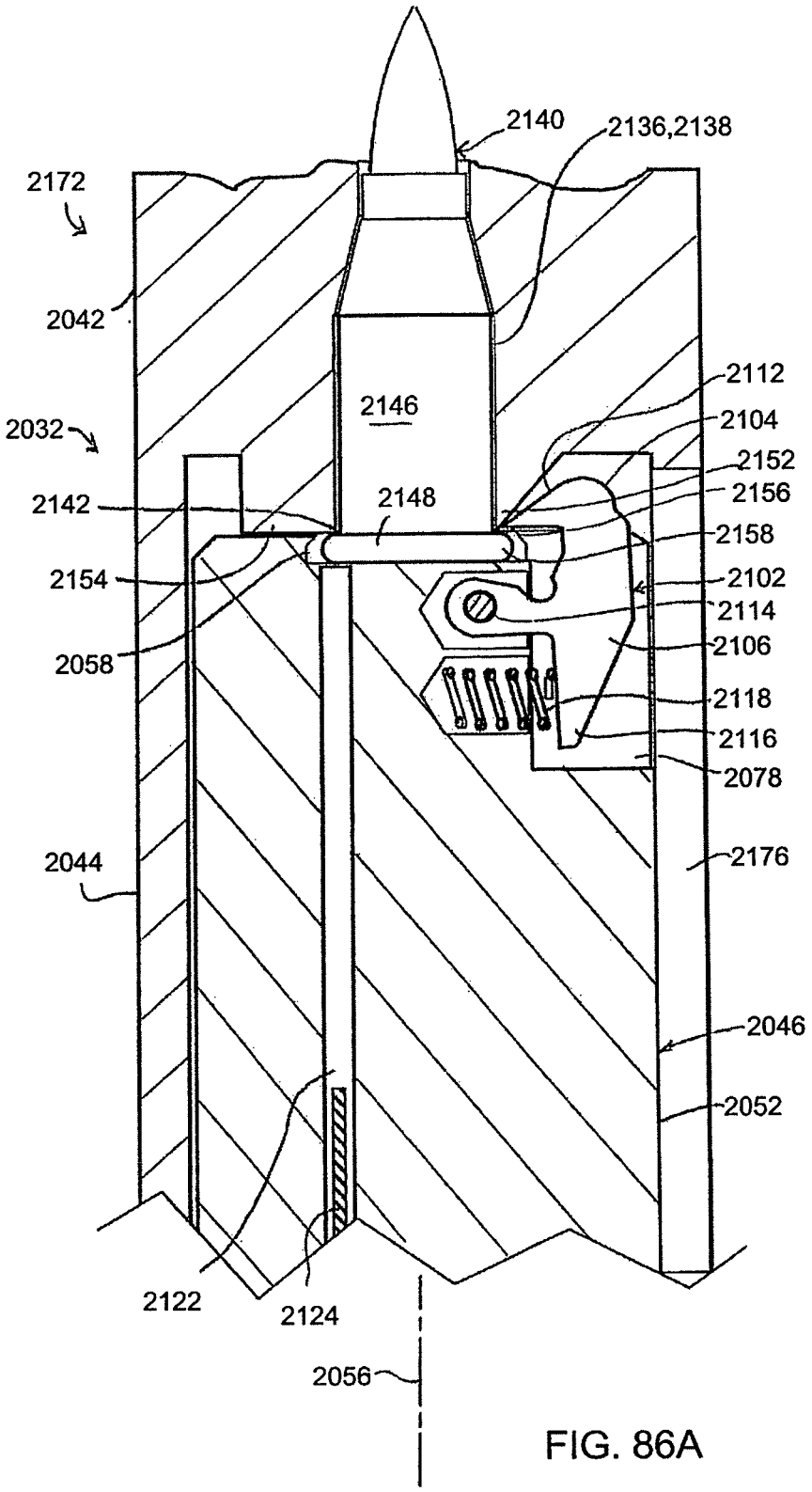
FIGS. 86A and 86B are plan sectional and elevation sectional views, respectively, of the bolt assembly, breech, and firing chamber in a firing position in an embodiment of the disclosure
Figure 86B:
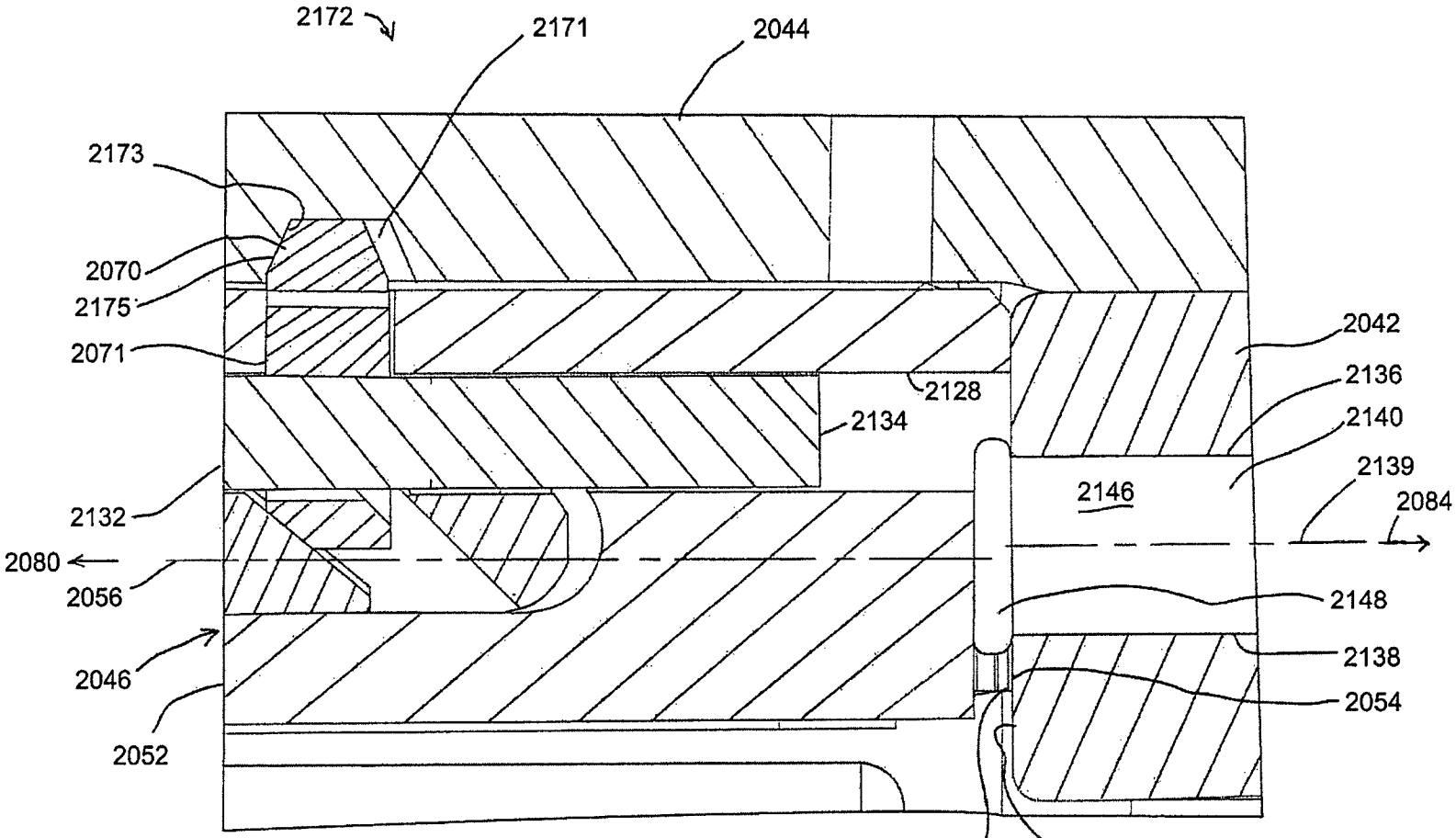

In various embodiments, the central axis 2056 of the recess 2058 is parallel to, but not concentric with, the barrel axis 2139, as best seen in FIG. 86B. In these embodiments, an outer radius Rr of the rim 2148 at least partially overlaps with the radius R of the arcuate segment 2060 of the ledge portion 2086, such that when the cartridge 2140 is chambered in the firing position 2172, the rim 2148 is partially captured by the ledge portion 2086.

In one embodiment, when in the firing position 2172, the retractable anchoring bar 2070 extends into an anchoring slot 2171 formed in the breech 2044, such that a proximal face 2173 of the anchoring bar 2070 registers against a distal face 2175 of the anchoring slot 2171. In one embodiment, the location and configuration of the anchoring slot 2171 is such that, when the anchoring bar 2070 is registered therein in the firing position 2172, the bolt face 2054 is in pressing contact with the proximal end 2154 of the firing chamber 2042.

Upon discharge, a spent cartridge casing 2174 is present in the firing chamber 2042. For a semi-automatic firearm, the bolt assembly 2046 is disengaged from the firing chamber 2042 by a blowback force FB that also exerts a pressure on the spent cartridge casing 2174 that forces the head 2141 of the casing 2144 against the base surface 2072 of the bolt face 2054. The blowback force FB causes the bolt assembly 2046 to translate parallel to the central axis 2056 away from the firing chamber 2042. As the bolt assembly 2046 is translated away from the firing chamber 2042, the claw portion 2104 of the claw-like extractor 2102 is rotated radially inward, motivated by the biasing element 2118 acting on the proximal end 2116 of the claw-like extractor 2102 (FIG. 86B). The tapered distal face 2112 of the claw portion 2104 slides on the edge 2156 of the ridge 2152 of the firing chamber 2042, until the apex 2110 of the claw portion 2104 engages the exposed portion of the rim 2148 of the spent cartridge casing 2174, thereby hooking the spent cartridge casing 2174.

Figure 86C:
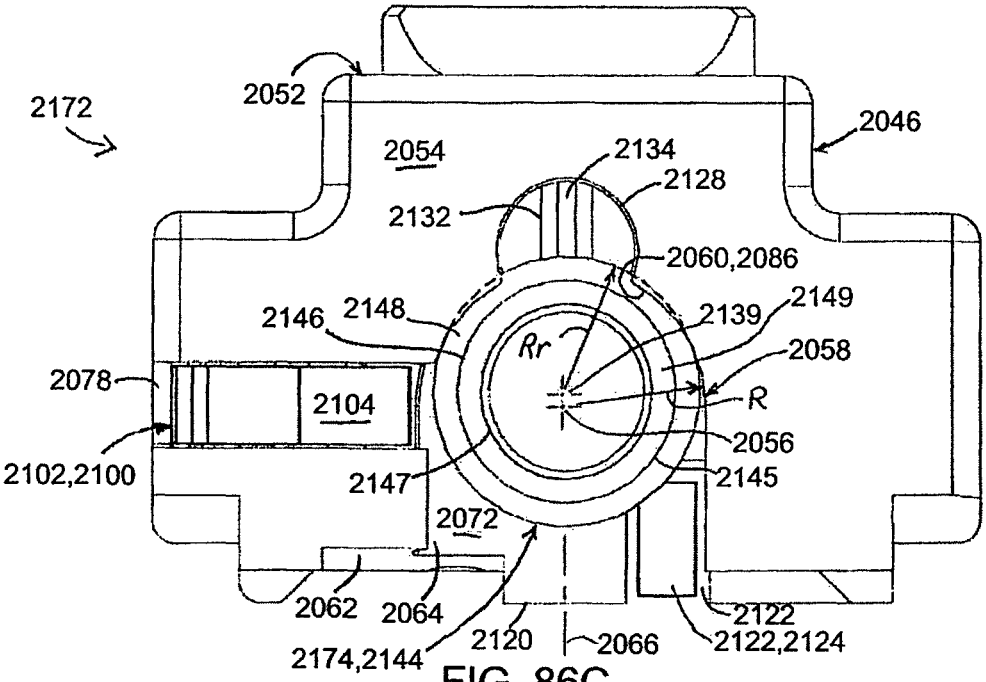
FIG. 86C is a front view of the bolt assembly with a cartridge in the firing position in an embodiment of the disclosure.
Figure 86G:
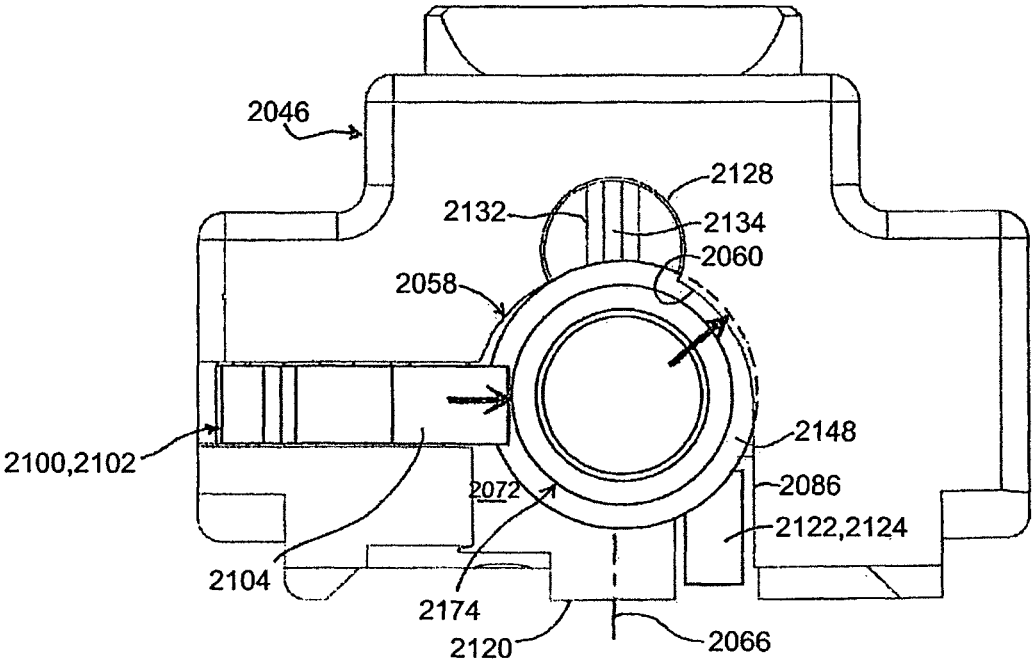
FIG. 86G is a front view of the bolt assembly with a spent cartridge casing secured thereto and corresponding to FIGS. 86F and 87B in an embodiment of the disclosure.

As the bolt assembly 2046 is translated in the proximal direction 2080, the apex 2110 of the claw portion 2104 exerts an axial force FCa against the exposed portion of the rim 2148, thereby extracting the spent cartridge casing 2174 from the firing chamber 2042 (FIG. 86C). Initially, the blowback force can continue to exert the blowback force FB and assist in keeping the spent cartridge casing 2174 seated against the base surface 2072 of the bolt face 2054, as pressure can remain in the firing chamber 2042 during the initial stages of the extraction. The claw portion 2104 also exerts a radial inward force FCr on the spent cartridge casing 2174. As the spent cartridge casing 2174 is translated out of the firing chamber 2042, the radial inward force FCr exerted by the apex 2110 of the claw portion 2104 of the extractor can cause the spent cartridge casing 2174 to shift laterally toward the ledge portion 2086, so that the rim 2148 of the spent cartridge casing 2174 registers against the inclined face 2088 of the ledge portion 2086. The lateral shifting of the spent cartridge casing 2174 can cause the claw-like extractor 2102 to further rotate about the pivot pin 2114, which in turn can cause the apex 2110 of the claw portion 2104 to move both radially inward and axially away from the bolt face 2054.

Figure 86D:
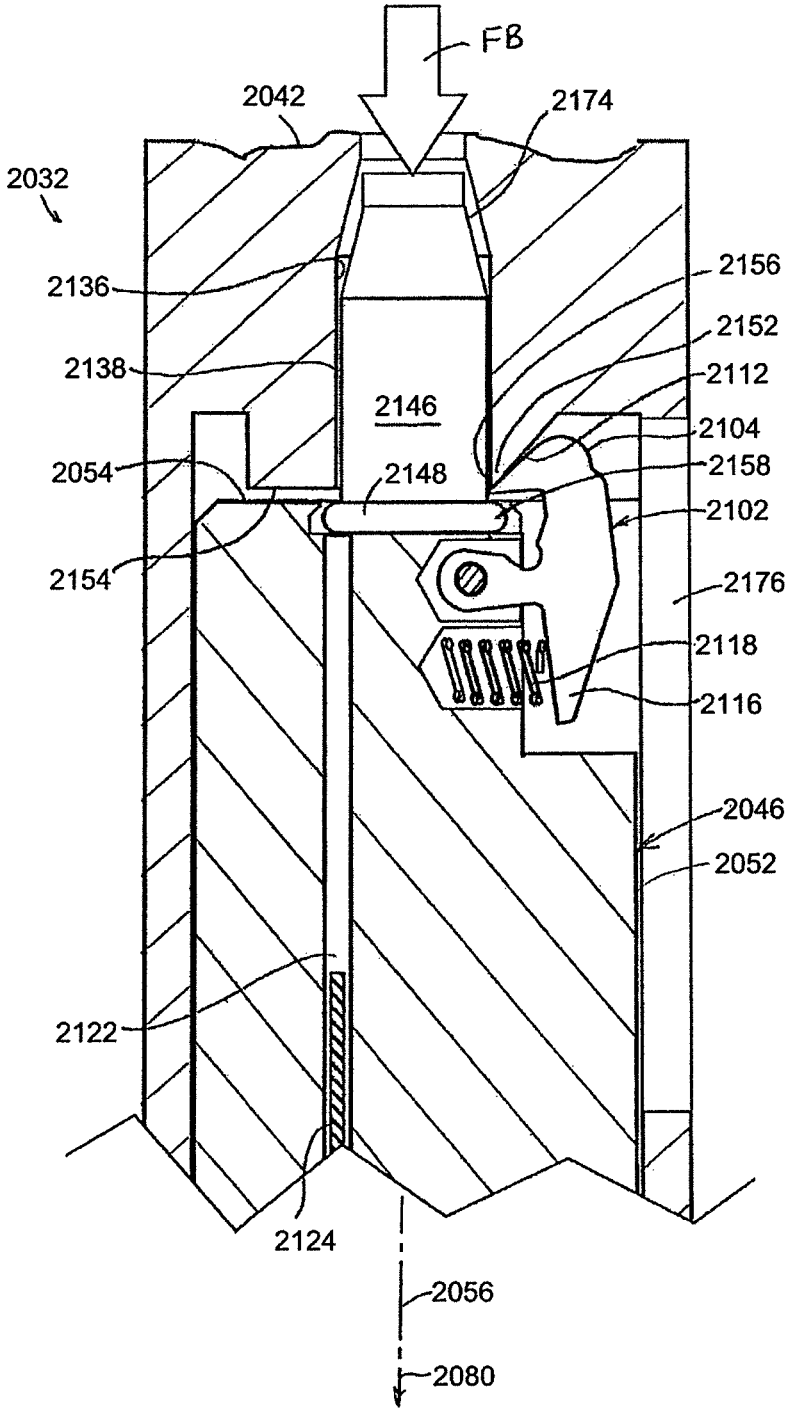
FIGS. 86D through 86F are sectional views of the bolt assembly, breech, and firing chamber for an extraction utilizing a blowback force at various stages of extraction in an embodiment of the disclosure.

As the major diameter 2145 of the spent cartridge casing 2174 is extracted in the proximal direction 2080, the firing chamber 2042, the interior chamber 2138 of the firing chamber is vented, eliminating the blowback force FB (FIG. 86D). At this stage of the extraction, the forces exerted on the spent cartridge casing 2174 include the radial inward force FCr exerted at the claw portion 2104, and a ledge force FL, the ledge force FL having a radial inward component FLr and an axial component FLa, the axial component FLa acting in the proximal direction 2080. The axial component FLa secures the spent cartridge casing 2174 against the base surface 2072 of the bolt face 2054 as the bolt assembly 2046 is translated within the breech 2044.

Figure 86E:
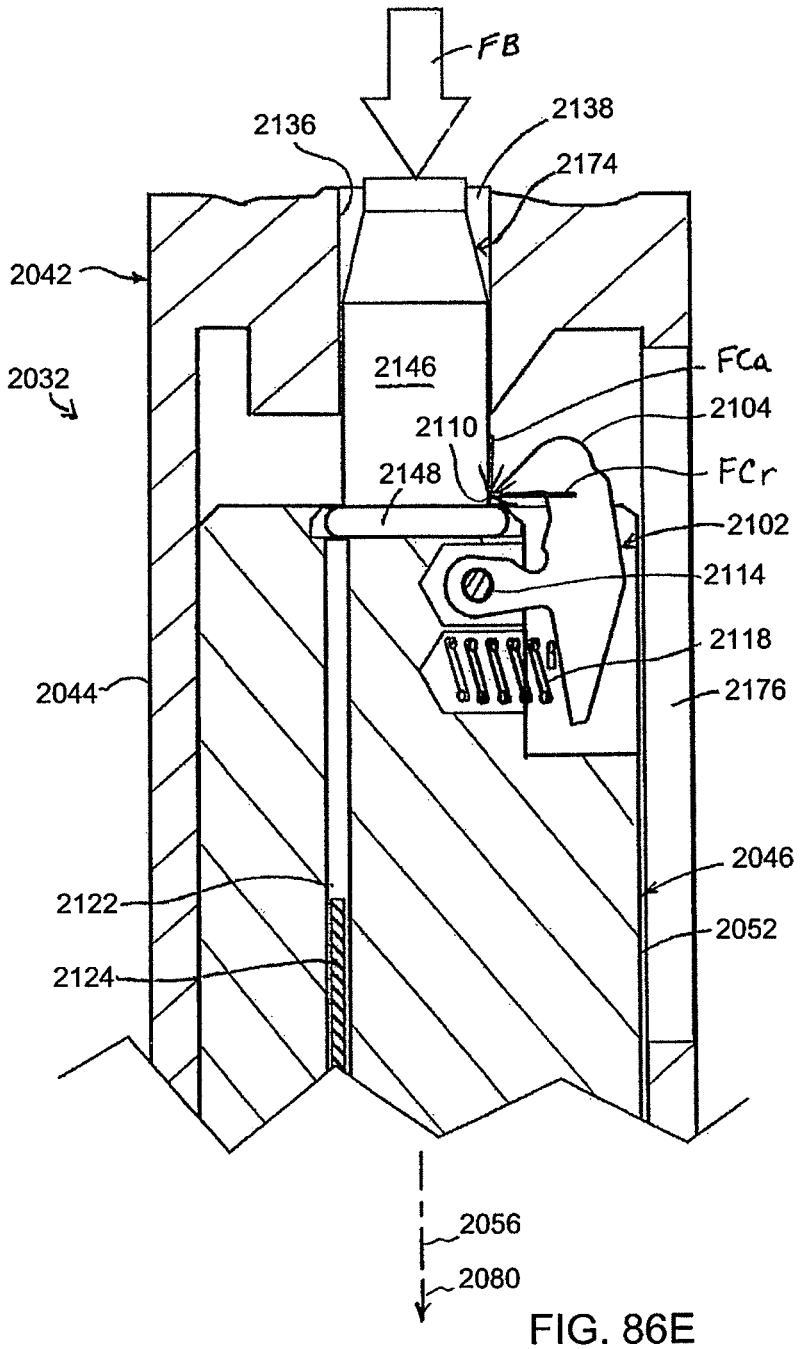
Figure 86F:
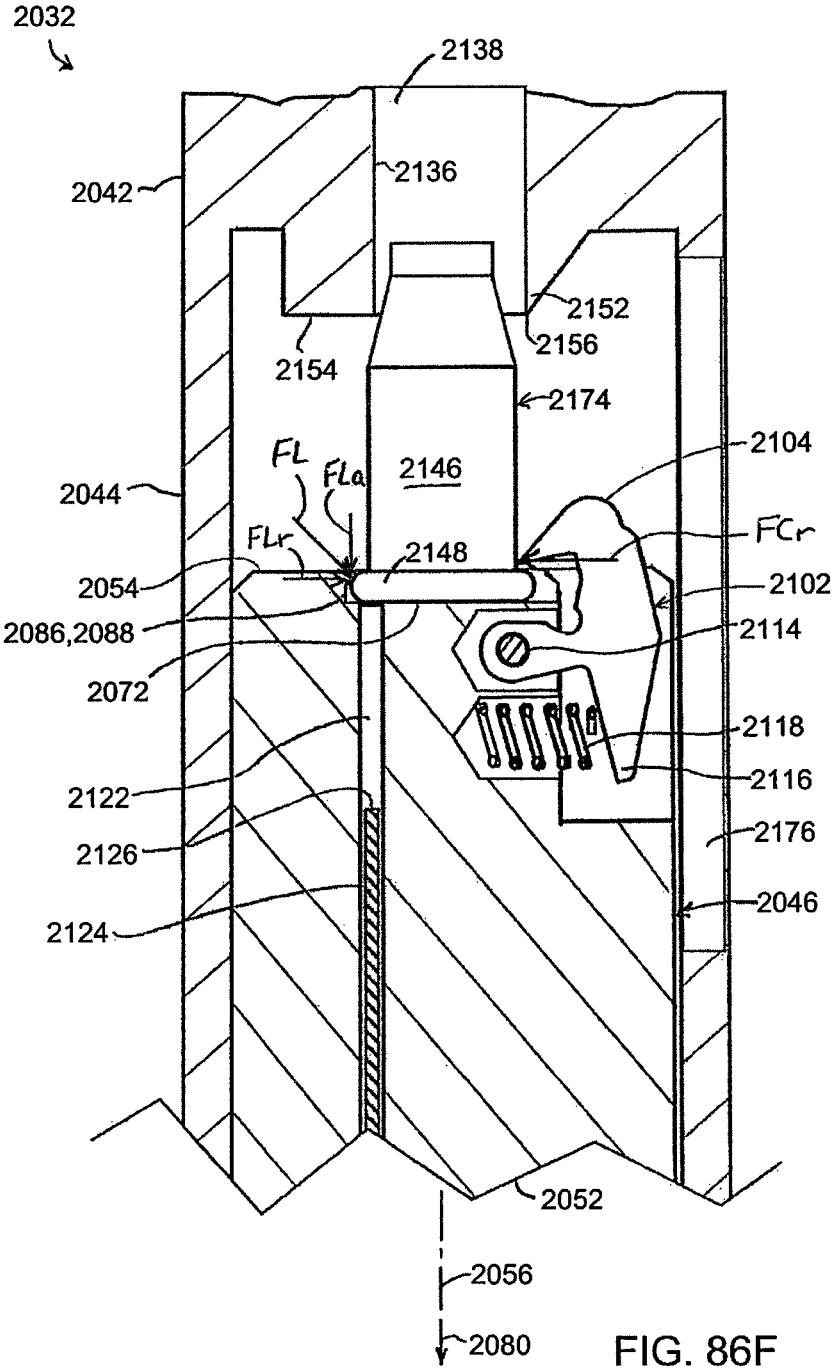
Figure 86H:
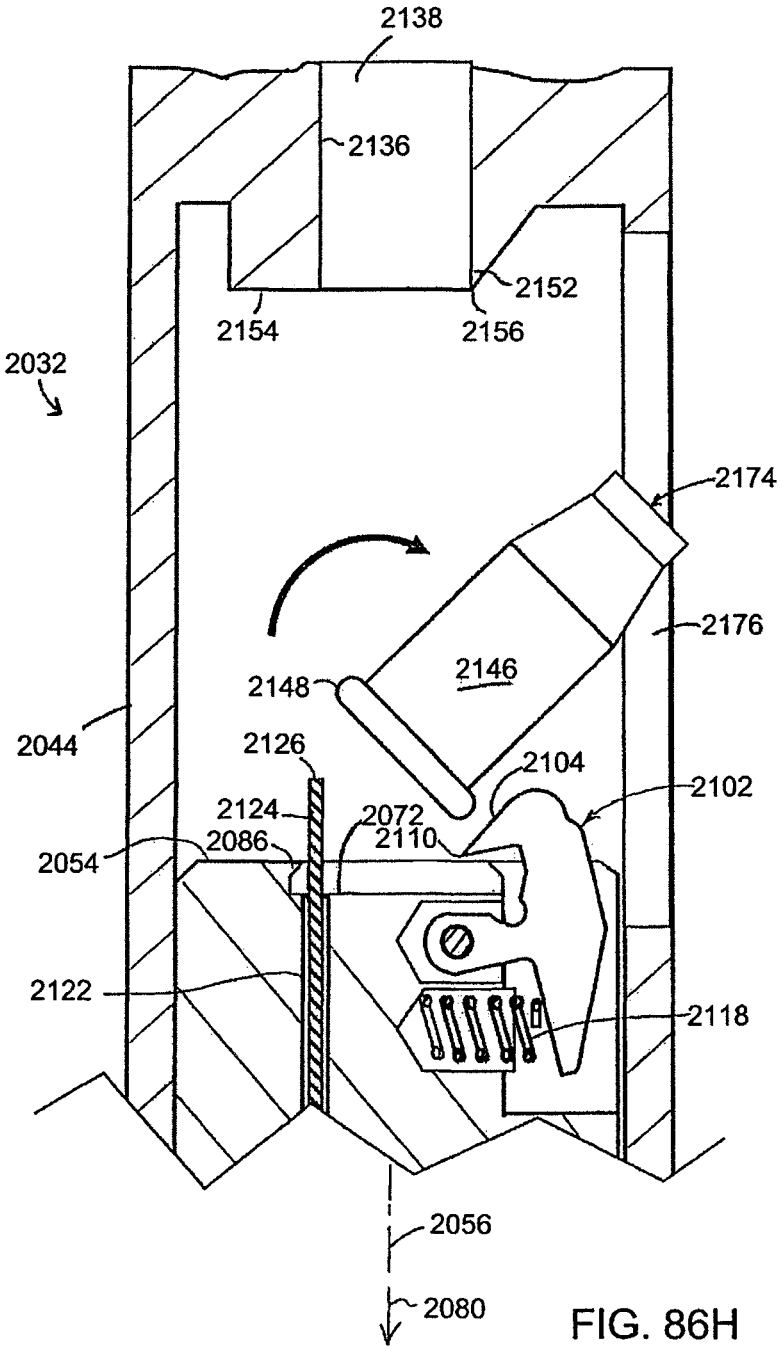
FIG. 86H is a sectional view of the bolt assembly, breech, and firing chamber during ejection of the spent cartridge casing in an embodiment of the disclosure.

Momentum from the blowback of the discharge continues to translate bolt assembly 2046 parallel to the central axis 2056 in the proximal direction 2080, with the base surface 2072 of the bolt face 2054 eventually reaching the distal end 2126 of the stationary ejector 2124 (FIG. 86E) so that the distal end 2126 of the stationary ejector 2124 extends into and/or through the recess 2058. The protrusion of the stationary ejector 2124 into the recess 2058 projects the spent cartridge casing 2174 distally away from the base surface 2072. This distal motion causes the rim 2148 of the spent cartridge casing 2174 to slide along the inclined face 2088 of the ledge portion 2086 in the distal direction 2084, which causes the spent cartridge casing 2174 to move laterally against the claw portion 2104 of the claw-type extractor 2102. The claw-type extractor 2102 accommodates this lateral movement by rotating radially outward, but maintains contact with the spent cartridge casing because of the bias force exerted on the claw-type extractor 2102 by the biasing element 2118. As the rim 2148 of the spent cartridge casing 2074 clears the ledge portion 2086, the rim 2148 initially remains engaged with the apex 2110 of the claw portion 2104, causing the spent cartridge casing 2174 to pivot about the apex 2110. The spent cartridge casing then rotates laterally away from the apex 2110 and out of the breach 2044 via an ejection window 2176 (FIG. 86E).

Figure 87A:
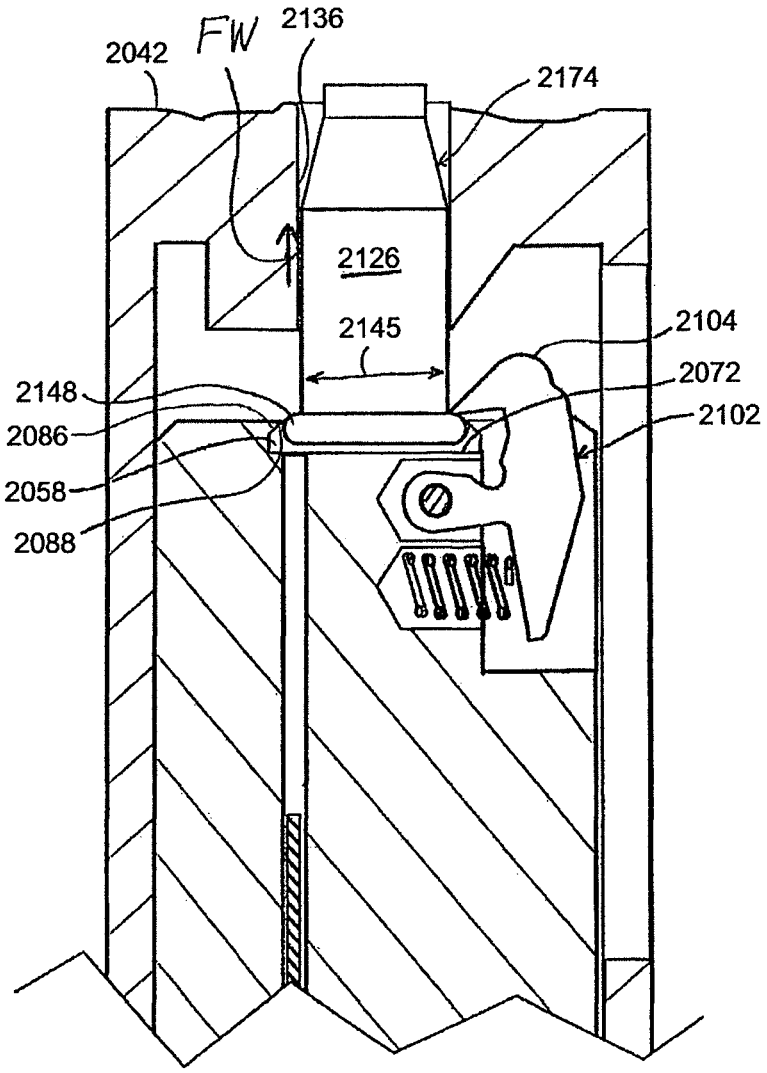
FIGS. 87A and 87B are sectional views of the bolt assembly, breech, and firing chamber for an extraction that could be associated with a non-blowback extraction at various stages of extraction in an embodiment of the disclosure.
Figure 87B:
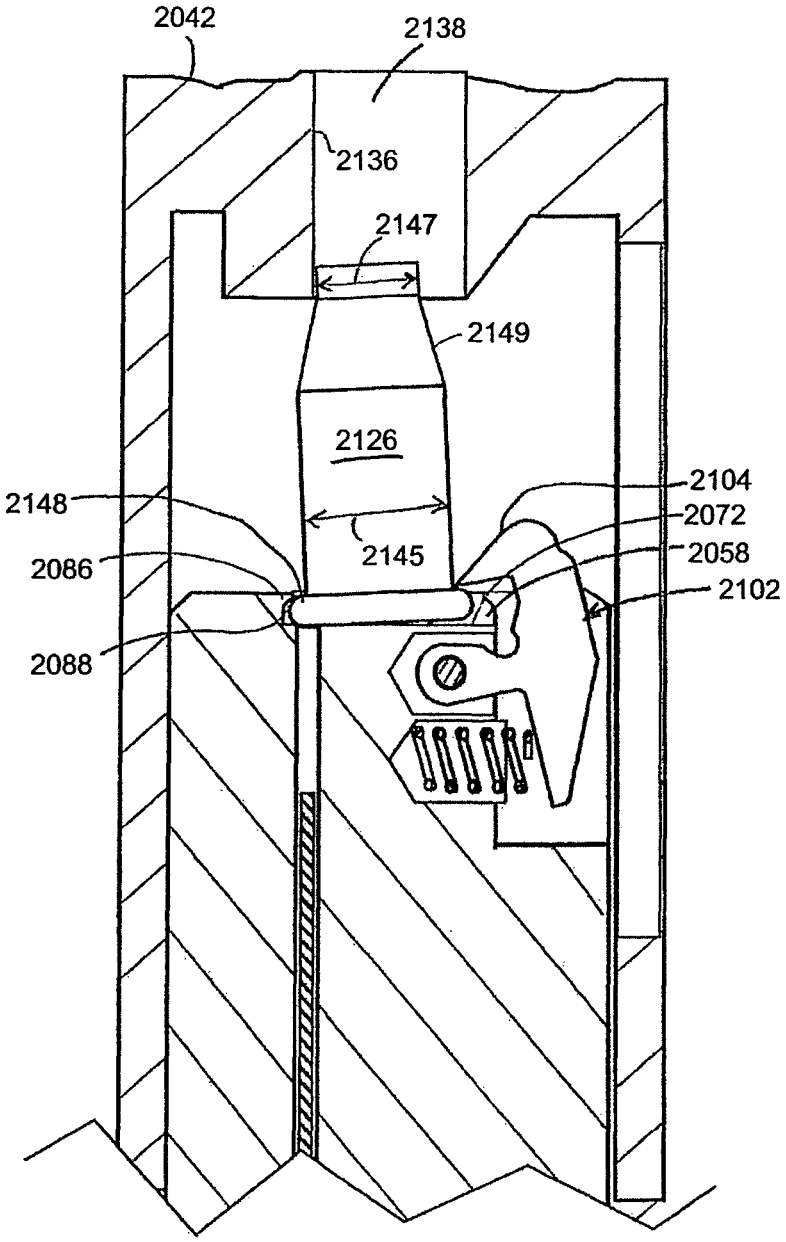

Referring to FIGS. 87A and 87B, certain stages of the extraction are depicted without the aid of a blowback force in an embodiment of the disclosure. Some firearms, such as bolt action or lever action firearms, do not benefit from blowback forces during extraction. Extraction for these devices is provided manually by the user, generally after the firing chamber as fully vented after discharge. The disclosed embodiments are operable without benefit of the blowback force, as depicted in FIGS. 87A and 87B.

Additionally, in semiautomatic firearms that do use blowback, at some point the inertia of the bolt assembly moving rearward and the frictional engagement of the casing with the firing chamber wall can overtake the rearward seating force of the cartridge casing, particularly after the pressurization of the firing chamber has dissipated, allowing separation to occur as shown in FIGS. 87A and 87B.

For a non-blowback extraction and potentially at a certain point in blowback extraction, the spent cartridge casing 2174 can drag against the chamber wall 2136 of the firing chamber 2042 providing a frictional force FW. The drag FW can cause the spent cartridge casing 2174 to rise off of the base surface 2072 of the bolt face 2054. The spent cartridge casing 2174 is nevertheless retained within the recess 2058 by the claw portion 2104 of the claw extractor 2102 during the initial stages of the extraction (FIG. 87A). As the major diameter 2145 proceeds in the proximal direction 2080, the radial inward force FCr exerted at the claw portion 2104 pushes the rim 2148 towards the ledge portion 86 opposite the claw portion 2104, and the rim 2148 is captured between the inclined face 2088 and the base surface 2072 (FIG. 87B). Thus, as the spent cartridge casing 2174 clears the firing chamber 2042, the spent cartridge casing 2174 is held in equilibrium by the claw portion 2104 and the ledge portion 2086. The ejection of the spent cartridge casing 2074 then proceeds as described and depicted attendant to FIG. 86E.

In some instances, the rim 2148 can be canted within the recess 2058 during the extraction, as depicted at FIG. 87B. The degree to which the rim 2148 is canted depends on several factors, including the uncertainties in the size of the rim 2148 and in the major diameter 2145 introduced by machining tolerances, as well as variability in the frictional drag between the spent cartridge casing 2174 and the firing chamber 2042. While the precise orientation of spent cartridge casings may vary somewhat during the extraction process, the variability is within a small enough envelope so that the repeatability of the ejection is satisfactory.

Figure 88A:
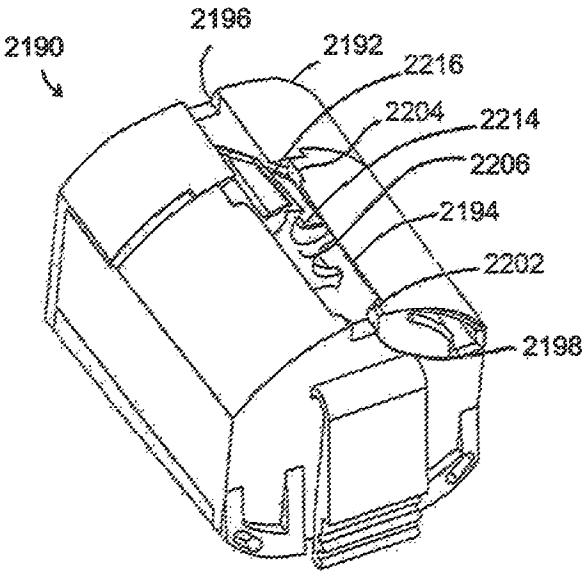
FIG. 88A is perspective views of a magazine for use in embodiments of the disclosure.
Figure 88B:
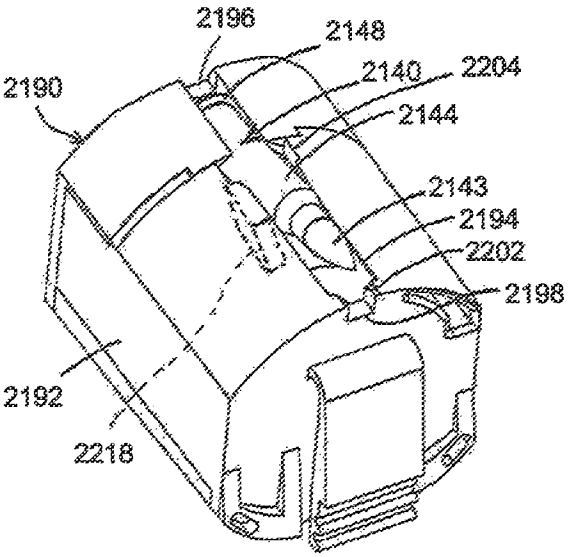
FIG. 88B is a perspective view of the magazine of FIG. 88A with a cartridge extending therefrom.

Referring to FIGS. 88A and 88B, a magazine 2190 is depicted in an embodiment of the disclosure. The magazine 2190 includes a housing 2192 having an upper through-slot 2194 formed thereon. The upper through-slot includes a proximal notch 2196 and a distal notch 2198. The distal notch 2198 can further define shoulder portions 2202 that lead into the upper slot 2194. The upper slot 2194 can also define a widened portion 2204 disposed between the proximal and distal notches 2196 and 2198. A spool 2206 is disposed within the housing 2192, the spool 2206 rotating about a spindle 2208 (FIG. 89A) that is supported by the housing 2192. In one embodiment, the spool is rotationally biased by a spring 2212 (FIG. 89A) that is substantially concentric with the spindle 2208. The spool 2206 includes a plurality of pockets 2214 formed in an outer-most radial surface 2216 of the spool 2206, each shaped to conform to the casing 2144 of the cartridge 2140.

In operation, as the spool 2206 rotates about the spindle 2208, the cartridge 2140 encounters a ramp structure 2218 (depicted in hidden lines) within the housing 2192 that causes the bullet 2143 of the cartridge 2140 to protrude above the housing 2192, while the rim 2148 remains captured within the housing 2192 in alignment with the proximal notch 2196 of the upper slot 2194 of the magazine 2190 (FIG. 88B).

Figure 89A:
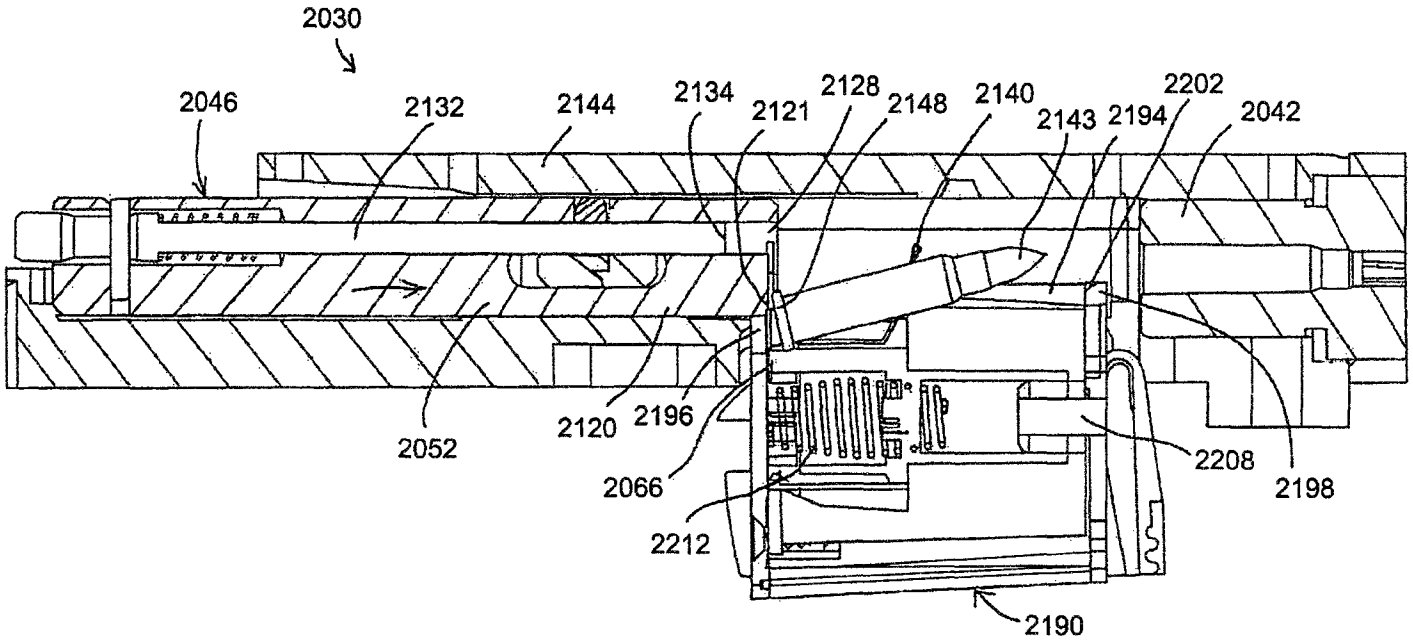
FIGS. 89A, 89B, 89E, and 89F are elevation sectional views of the firearm during a reloading sequence in an embodiment of the disclosure.
Figure 89B:
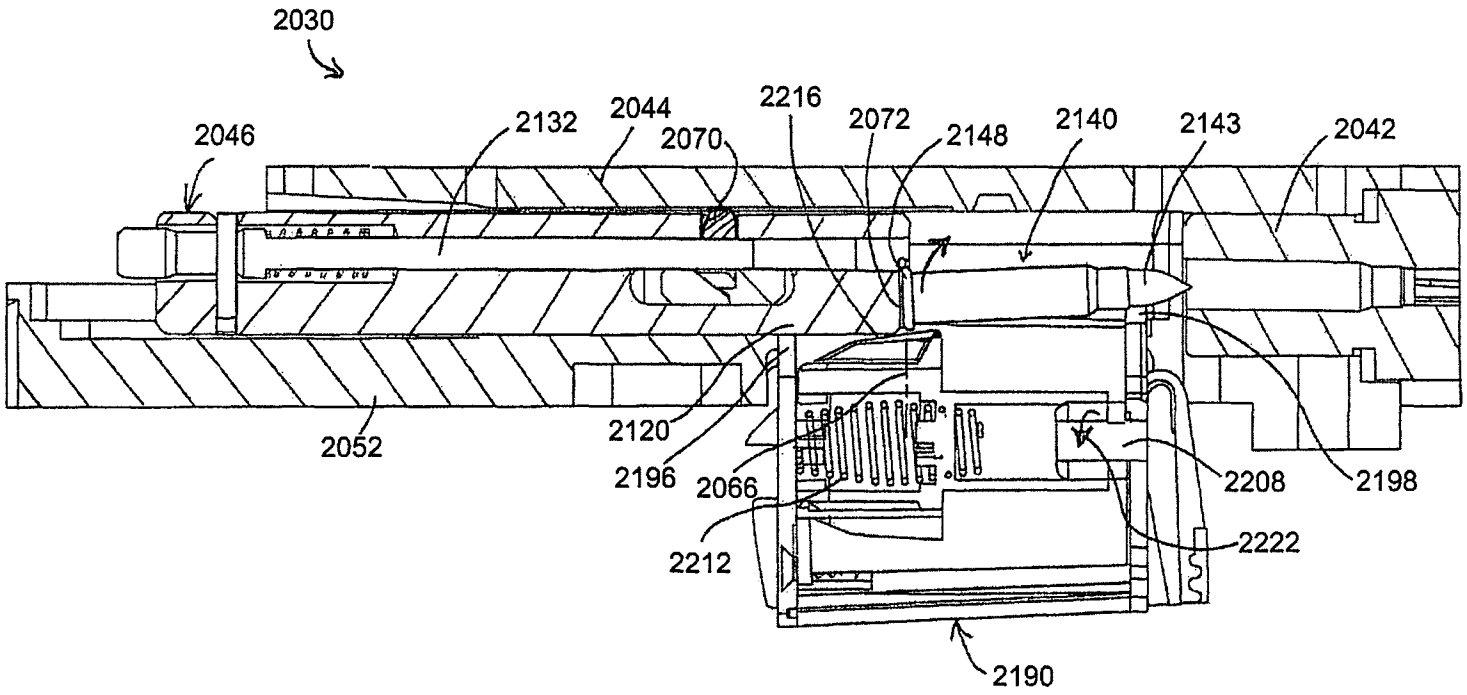

Referring to FIGS. 89A through 89F, operation of the bolt assembly 2046 and magazine 2190 during resupply the firing chamber 2042 of the firearm 2030 with another cartridge 2140 are depicted in an embodiment of the disclosure. As the bolt 2052 moves forward, the magazine rail 2120 enters the proximal notch 2196 of the upper slot 2194 of the magazine 2190, so that the distal face 2121 of the magazine rail 2120 makes contact with the rim 2148 of the cartridge 2140 (FIG. 89A).

The biasing spring 2212 causes the spool 2206 to exert an upward force on the rim 2148, biasing the rim into the upper slot 2194, as depicted in FIG. 88B. As the cartridge 2140 moves in the distal direction 2084, the rim 2148 becomes aligned with the widened portion 2204, and pops through the widened portion 2204 due to the force exerted by the biasing spring 2212. The biasing spring 2212 further causes outermost radial surface 2216 of the spool 2206 to rotate under the rim 2148 of the cartridge 2140, denoted by rotational arrow 2222 in FIG. 89B. By this mechanism, the cartridge 2140 is effectively stripped out of the magazine 2190. The rotation 2222 further elevates the rim 2148, causing the rim 2148 to enter the channel opening 2068 and to be translated/rotated upward along the channel axis 2066, sliding along the base surface 2072. Because the bullet 2143 of the cartridge 2140 is elevated above the upper through-slot 2194 of the magazine 2190, the cartridge 2140 makes sliding contact with the shoulder portions 2202 of the distal notch 2198 as the cartridge 2140 is thrust forward by the bolt 2052.

Figure 89C:
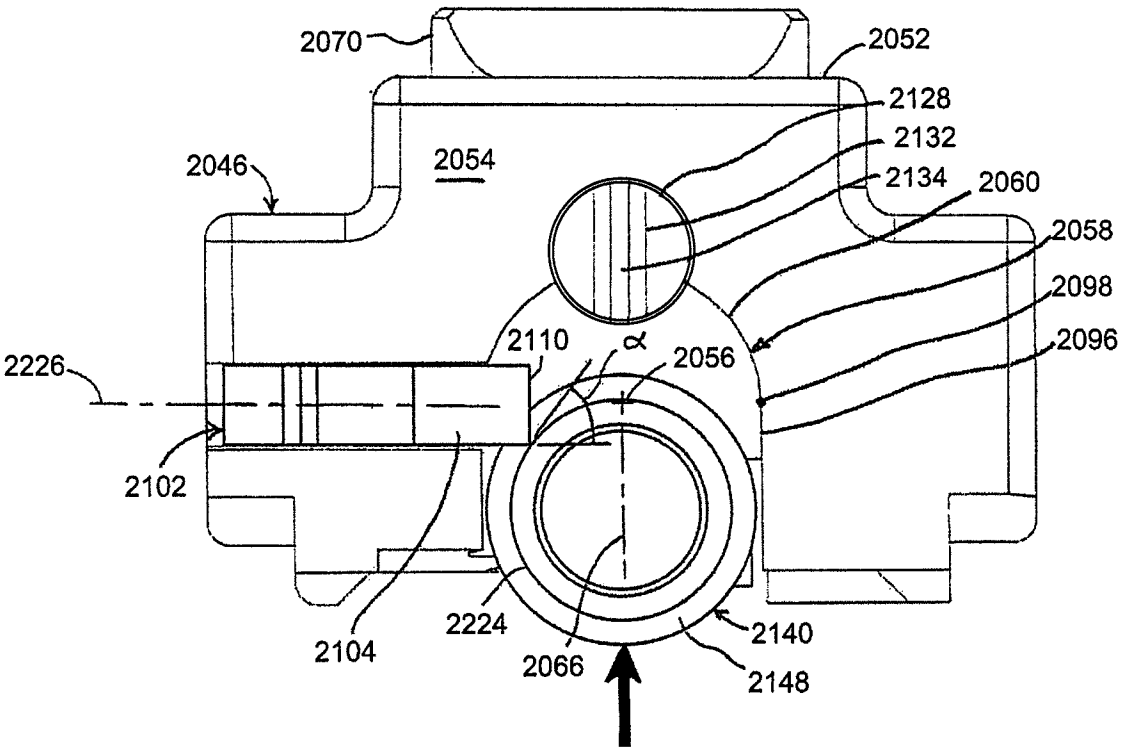
FIGS. 89C and 89D are front elevation views of the bolt assembly and the cartridge during the reloading sequence of the firearm in an embodiment of the disclosure.
Figure 89D:
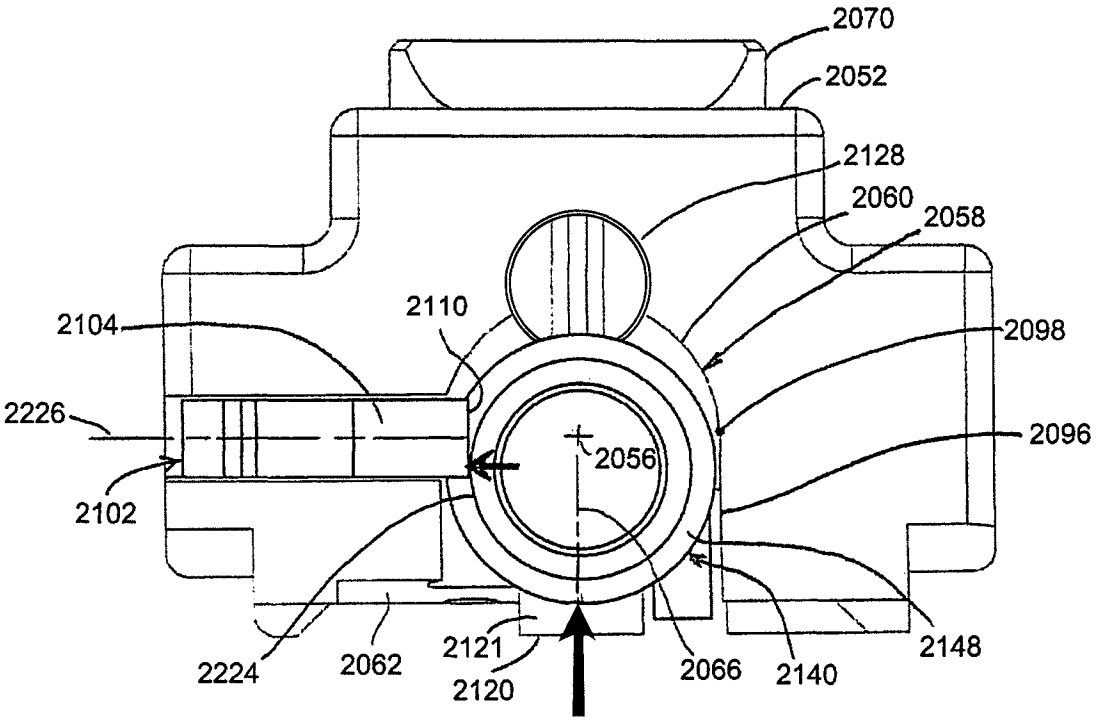

As the cartridge 2140 is translated/rotated along the channel axis 2066, an outer cylindrical surface 2224 contacts the claw portion 2104 of the claw-type extractor 2102 at an acute angle α relative to an actuation axis 2226 of the claw-type extractor 2102 (FIG. 89C). The claw-type extractor 2102 is thereby motivated away from the central axis 2056 as the cartridge 2140 slides into place within the recess 2058 (FIG. 89D).

Figure 89E:
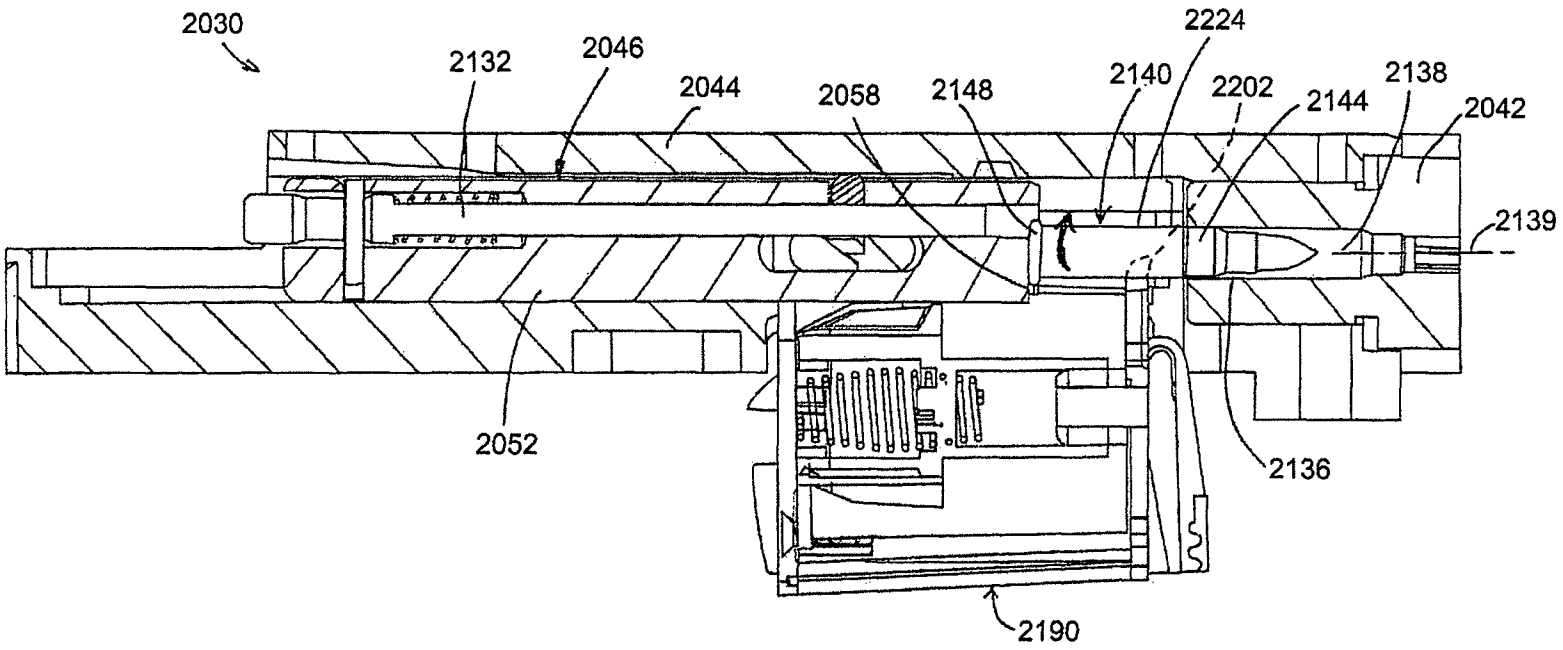

As the cartridge 2140 continues to be thrust forward, the casing 2144 rides up onto the shoulder portions 2202 of the distal notch 2198 of the magazine 2190. As the cartridge 2140 is pushed into the cylindrical interior chamber 2138 of the firing chamber 2042, the outer cylindrical surface 2224 of the casing 2144 comes into sliding contact with the chamber wall 2136. Because of the close tolerance fit between the casing 2144 and the chamber wall 2136, the cartridge 2140 becomes righted within the interior chamber 2138 such that the cartridge 2140 is in substantial alignment with the barrel axis 2139 (FIG. 89E). The alignment causes the rim 2148 of the cartridge 2140 to rotate further upward into the recess 2058 of the bolt 2052.

Figure 89F:
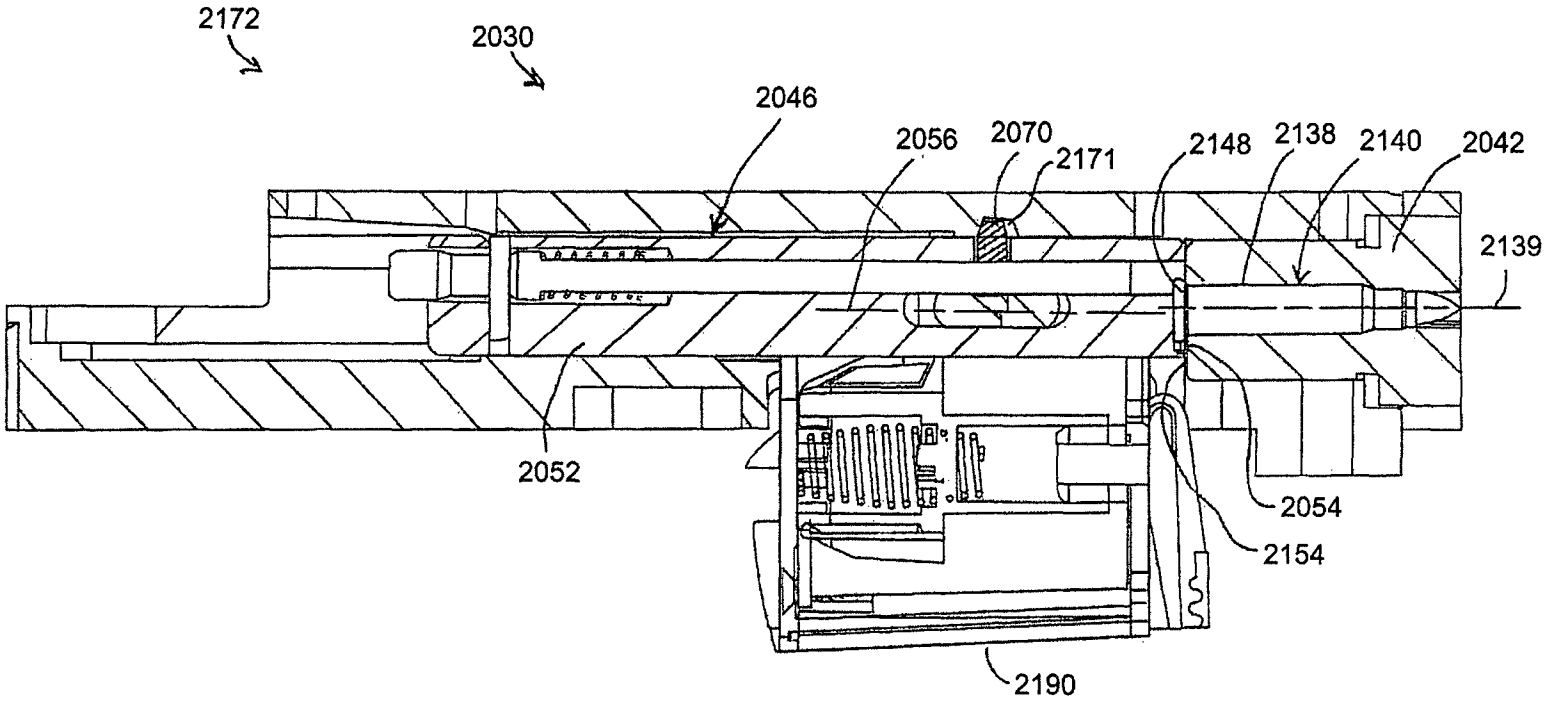

The bolt assembly 2046 continues forward until the cartridge 2140 is fully chambered within the firing chamber 2042. As the bolt face 2054 comes into pressing contact with the proximal end 2154 of the firing chamber 2042, the anchoring bar 2170 extends into the anchoring slot 2171 to secure the bolt 2052 against the firing chamber 2042 (FIG. 89F). The firearm 2030 is thereby in the firing configuration 2172 of FIGS. 86A through 86C, with the rim 2148 captured by and in contact with the inclined face 2088 of the ledge portion 2086, as depicted in FIG. 86C.

When used herein, the terminology "connect to" or "attach to" do not require direct component to component connection and intermediate components may be present.

All of the features disclosed in this specification (including the references incorporated by reference, including any accompanying claims, abstract and drawings), and/or all of the steps of any method or process so disclosed, may be combined in any combination, except combinations where at least some of such features and/or steps are mutually exclusive.

Each feature disclosed in this specification (including references incorporated by reference, any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment (s). The invention extends to any novel one, or any novel combination, of the features disclosed in this specification (including any incorporated by reference references, any accompanying claims, abstract and drawings), or to any novel one, or any novel combination, of the steps of any method or process so disclosed The above references in all sections of this application are herein incorporated by references in their entirety for all purposes.

Although specific examples have been illustrated and described herein, it will be appreciated by those of ordinary skill in the art that any arrangement calculated to achieve the same purpose could be substituted for the specific examples shown. This application is intended to cover adaptations or variations of the present subject matter. Therefore, it is intended that the invention be defined by the attached claims and their legal equivalents, as well as the following illustrative aspects. The above described aspects embodiments of the invention are merely descriptive of its principles and are not to be considered limiting. Further modifications of the invention herein disclosed will occur to those skilled in the respective arts and all such modifications are deemed to be within the scope of the invention.

We claim:

1. A trigger assembly of a semi-automatic firearm for firing rimfire ammunition, the trigger assembly comprising:

a hammer rotatable about a first axis, the hammer including structure defining a capture feature and a lip portion;

a firing trigger rotatable about a second axis, the firing trigger comprising a first finger hook and a sear portion releasably coupled to the hammer, when the firing trigger and the hammer are in a battery position of the trigger assembly;

a firing trigger return spring configured to urge the firing trigger toward the battery position, wherein the firing trigger return spring is adjustable to alter a spring force applied to the firing trigger;

an arrestor rotatable about the second axis, the arrestor comprising a claw portion configured to engage with the lip portion of the hammer;

a safety trigger rotatable about the second axis, the safety trigger comprising:

a second finger hook having a portion extending forwardly of the first finger hook when the safety trigger is in the battery position; and a catch configured to, when the safety trigger is in the battery position, arrest the capture feature of the hammer as the hammer rotates to prevent discharge of the semi-automatic firearm; and an arrestor return spring configured to urge the arrestor toward a position configured to engage with the lip portion defined by the hammer.

2. The trigger assembly of claim 1, wherein the safety trigger further comprises an arrestor return spring portion configured to engage and support the arrestor return spring.

3. The trigger assembly of claim 1, wherein, by rotation of the safety trigger, when the portion of the safety trigger is flush with the first finger hook portion, the catch of the safety trigger is positioned to allow free rotation of the hammer.

4. The trigger assembly of claim 1, wherein the claw portion of the arrestor is configured to engage with the lip portion of the hammer when the hammer is driven backward by a bolt after firing.

5. The trigger assembly of claim 1, wherein the safety trigger, when rotated from the battery position, is configured to kick the claw portion of the arrestor from engagement with the hammer.

6. The trigger assembly of claim 1, wherein the safety trigger comprises a planar component.

7. The trigger assembly of claim 1, wherein the arrestor return spring comprises a compression spring.

8. The trigger assembly of claim 1, wherein the arrestor further comprises a over-rotation stop and the firing trigger further comprises a boss protruding into a plane defined by the arrestor, and wherein, when the firing trigger is rotated about the second axis, the over-rotation stop configured to contact the boss to prevent an over-rotation of the arrestor.

9. The trigger assembly of claim 1, wherein the trigger assembly further comprises a cross bar safety configured to, when in the safe-on position, prevent a rotation of the trigger about the second axis.

10. The trigger assembly of claim 1, wherein the firing trigger return spring is configured to enable adjustment of the spring force applied to the firing trigger in a rotational range when the trigger is seared to the hammer.

11. The trigger assembly of claim 1, wherein the trigger assembly comprises a blocking member operatively coupled with the safety trigger for maintaining the blocking member in a blocking position when the safety trigger is in a battery position, the blocking member blocking the firing trigger component when in the blocking position to prevent release of the sear portion from the hammer, the blocking member being operatively coupled with the safety trigger for moving the blocking member out of the blocking position by moving the safety trigger out of the battery position to enable release of the sear portion from the hammer.

12. The trigger assembly of claim 11, wherein the blocking member includes an arcuate base portion rotatable about a third axis, the arcuate base portion defining a recess and being operatively coupled with the safety trigger for rotation about the third axis, wherein:

the arcuate base portion blocks the firing trigger component from being actuated when the safety trigger is in the battery position; and the recess aligns with the firing trigger component when the safety trigger is rotated out of the battery position to enable the firing trigger component to release the hammer.

13. The trigger assembly of claim 11, wherein the blocking member includes a lever portion operatively coupled with the safety trigger for rotation about a third axis, wherein the lever portion blocks an underside of the firing trigger component to prevent disengagement of the firing trigger component from the hammer, the lever portion being maintained in the blocking position by the safety trigger when the safety trigger is in the battery position, the lever portion being selectively rotatable out of the blocking position by rotating the safety trigger out of the battery position.

14. The trigger assembly of claim 11, wherein the trigger assembly further comprises a manual safety mechanism actuated by a push button forward of the first finger hook portion and laterally actuated for selectively placing the firearm in one of a safety mode and a firing mode, the manual safety mechanism being operatively coupled to the blocking member for preventing the safety trigger from moving the blocking member out of the blocking position when in the safety mode, and enabling the safety trigger to move the blocking member out of the blocking position when in the firing mode.

15. A semiautomatic firearm for firing rimfire ammunition, comprising:

a barrel defining a chamber for receiving and firing a rimfire cartridge;

a receiver operatively coupled to the barrel;

a bolt assembly operatively coupled to the receiver and comprising a firing pin configured to fire the rimfire cartridge; and a trigger assembly configured to actuate the firing pin, the trigger assembly comprising:

a hammer rotatable about a first axis and configured to contact the firing pin when firing the rimfire cartridge, the hammer including structure defining a capture feature and a lip portion;

a firing trigger rotatable about a second axis, the firing trigger comprising a first finger hook and a sear portion releasably coupled to the hammer, when the first trigger and the hammer are in a battery position of the trigger assembly;

a firing trigger return spring configured to urge the firing trigger toward the battery position, wherein the firing trigger return spring is adjustable to alter a spring force applied to the firing trigger;

an arrestor rotatable about the second axis, the arrestor comprising a claw portion configured to engage with the lip portion of the hammer;

a safety trigger rotatable about the second axis, the safety trigger comprising:

a second finger hook having a portion extending forwardly of the first finger hook when the safety trigger is in the battery position; and a catch configured to, when the safety trigger is in the battery position, arrest the capture feature of the hammer as the hammer rotates to prevent the hammer from contacting the firing pin; and an arrestor return spring configured to urge the arrestor toward a position configured to engage with the lip portion defined by the hammer.

16. The semiautomatic firearm of claim 15, wherein the bolt assembly is adapted for loading, firing, and ejecting the rimfire cartridge, the bolt assembly defining and being translatable rearwardly along a central axis to a rearward position for withdrawal of a spent cartridge casing from the chamber and ejection of the spent cartridge casing, the bolt assembly being translatable from the rearward position forwardly for loading the rimfire cartridge from a magazine into the chamber.

17. The semiautomatic firearm of claim 15, wherein the barrel is chambered for one of a 0.17 Winchester Super Magnum cartridge and a 0.17 Hornady Magnum Rimfire cartridge.

18. The semiautomatic firearm of claim 15, wherein the safety trigger further comprises an arrestor return spring portion configured to engage and support the arrestor return spring.

19. The semiautomatic firearm of claim 15, wherein the claw portion of the arrestor is configured to engage with the lip portion of the hammer when the hammer is driven backward by the bolt after firing.

* * * * *